US007513132B2

(12) United States Patent
Wright et al.

(10) Patent No.: US 7,513,132 B2
(45) Date of Patent: Apr. 7, 2009

(54) NON-AQUEOUS WASHING MACHINE WITH MODULAR CONSTRUCTION

(75) Inventors: Tremitchell L. Wright, Elkhart, IN (US); Daniel C. Conrad, Stevensville, MI (US); Stephen David Krefman, Paw Paw, MI (US); Joel A. Luckman, Benton Harbor, MI (US); Richard A. Sunshine, Granger, IN (US); Andrew Leitert, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 593 days.

(21) Appl. No.: 10/971,671

(22) Filed: Oct. 22, 2004

(65) Prior Publication Data

US 2005/0155393 A1 Jul. 21, 2005

Related U.S. Application Data

(60) Provisional application No. 60/516,423, filed on Oct. 31, 2003.

(51) Int. Cl.
*D06F 39/10* (2006.01)

(52) U.S. Cl. ..... 68/18 F; 68/18 R

(58) Field of Classification Search ..... 68/18 F, 68/18 C

See application file for complete search history.

(56) References Cited

U.S. PATENT DOCUMENTS 2,107,227 A * 2/1938 Woodin ..... 210/380.2
D120,681 S * 5/1940 Sutton ..... D32/10
2,629,242 A * 2/1953 Hallander ..... 68/19.2
2,987,902 A * 6/1961 Mack ..... 68/4
3,085,415 A * 4/1963 Gosnell ..... 68/12.08
3,103,112 A * 9/1963 Behrens et al. ..... 68/18 R
3,125,106 A * 3/1964 Brucken et al. ..... 134/113
3,163,028 A 12/1964 De Pas et al.
3,225,572 A * 12/1965 Robbins et al. ..... 68/27
3,232,335 A * 2/1966 Kalbfleisch ..... 165/9
3,246,493 A * 4/1966 Oles ..... 68/18 R
3,266,166 A 8/1966 Heinrich
3,269,539 A * 8/1966 Brucken et al. ..... 68/18 F
3,402,576 A * 9/1968 Krupsky ..... 68/4
3,410,118 A 11/1968 Dickey
3,423,311 A 1/1969 Hetherinton et al.
3,583,181 A * 6/1971 Brillet ..... 68/18 F
3,674,650 A * 7/1972 Fine ..... 202/176
3,691,649 A 9/1972 Pigors
3,733,267 A 5/1973 Haase et al.
3,809,924 A * 5/1974 Grunow et al. ..... 307/125

(Continued)

FOREIGN PATENT DOCUMENTS

DE 4343488 A1 6/1995

(Continued)

OTHER PUBLICATIONS

WIPO WO 98/29595 Jul. 1998.*

*Primary Examiner*—Frankie L Stinson
(74) *Attorney, Agent, or Firm*—Clifton Green; Michael D. Lafrenz

(57) ABSTRACT

The invention relates to a non-aqueous washing machine, methods of using the machine, methods of washing, and recycling and modular components and subsystems thereof.

3 Claims, 29 Drawing Sheets

U.S. PATENT DOCUMENTS

| | | | | | |
|---|---|---|---|---|---|
| 3,915,808 | A | * | 10/1975 | Wilcox | 202/160 |
| 3,930,998 | A | | 1/1976 | Knopp et al. | |
| 4,004,048 | A | | 1/1977 | Jackson | |
| 4,032,927 | A | | 6/1977 | Goshima | |
| 4,042,498 | A | | 8/1977 | Kennedy | |
| 4,045,174 | A | | 8/1977 | Fuhring et al. | |
| 4,046,700 | A | | 9/1977 | Glover | |
| 4,121,009 | A | | 10/1978 | Chakrabarti | |
| 4,153,590 | A | | 5/1979 | Mueller | |
| 4,169,856 | A | | 10/1979 | Cocuzza et al. | |
| 4,184,950 | A | | 1/1980 | Bixby | |
| 4,186,047 | A | | 1/1980 | Salmon | |
| 4,235,600 | A | | 11/1980 | Capella | |
| 4,247,330 | A | | 1/1981 | Sanders, Jr. | |
| 4,252,546 | A | | 2/1981 | Krugmann | |
| 4,331,525 | A | | 5/1982 | Huba et al. | |
| 4,388,437 | A | | 6/1983 | Ona | |
| 4,395,488 | A | | 7/1983 | Rowe | |
| 4,420,398 | A | | 12/1983 | Castino | |
| 4,421,794 | A | | 12/1983 | Kinsley, Jr. | |
| 4,434,196 | A | | 2/1984 | Robinson et al. | |
| 4,444,625 | A | | 4/1984 | Smith | |
| 4,457,858 | A | | 7/1984 | Saran | |
| 4,499,621 | A | | 2/1985 | Gasser | |
| 4,513,590 | A | * | 4/1985 | Fine | 68/18 C |
| 4,539,093 | A | | 9/1985 | Friedman et al. | |
| 4,595,506 | A | | 6/1986 | Kneer | |
| 4,601,181 | A | * | 7/1986 | Privat | 68/18 C |
| 4,610,785 | A | | 9/1986 | Russell | |
| 4,622,039 | A | | 11/1986 | Merenda | |
| 4,625,432 | A | | 12/1986 | Baltes | |
| 4,636,328 | A | | 1/1987 | Flynn et al. | |
| 4,664,754 | A | | 5/1987 | Caputi et al. | |
| 4,665,929 | A | | 5/1987 | Helm | |
| 4,678,587 | A | | 7/1987 | Voinche et al. | |
| 4,685,930 | A | | 8/1987 | Kasprzak | |
| 4,708,775 | A | | 11/1987 | McGregor et al. | |
| 4,708,807 | A | | 11/1987 | Kemerer | |
| 4,755,261 | A | | 7/1988 | McCord et al. | |
| 4,761,209 | A | | 8/1988 | Bonaventura et al. | |
| 4,767,537 | A | | 8/1988 | Davis | |
| 4,769,921 | A | | 9/1988 | Kabakov | |
| 4,790,910 | A | | 12/1988 | Havlik | |
| 4,802,253 | A | | 2/1989 | Hagiwara | |
| 4,808,319 | A | | 2/1989 | McNally et al. | |
| 4,818,297 | A | | 4/1989 | Holzmiiller et al. | |
| 4,830,710 | A | | 5/1989 | Thompson | |
| 4,834,003 | A | | 5/1989 | Reischl et al. | |
| 4,851,123 | A | | 7/1989 | Kmishra | |
| 4,857,150 | A | | 8/1989 | Rival | |
| 4,869,872 | A | | 9/1989 | Baltes | |
| 4,879,888 | A | | 11/1989 | Suissa | |
| 4,880,533 | A | | 11/1989 | Hondulas | |
| 4,904,390 | A | | 2/1990 | Schweighofer et al. | |
| 4,911,761 | A | | 3/1990 | McConnell | |
| 4,912,793 | A | | 4/1990 | Hagiwara | |
| 4,919,839 | A | | 4/1990 | Durbut | |
| 4,947,983 | A | | 8/1990 | Jost | |
| 4,961,753 | A | | 10/1990 | Donkers et al. | |
| 4,980,030 | A | | 12/1990 | Johnson et al. | |
| 4,984,318 | A | | 1/1991 | Coindreau-Palau | |
| 4,999,398 | A | | 3/1991 | Graiver et al. | |
| 5,004,000 | A | | 4/1991 | Berruex | |
| 5,028,326 | A | | 7/1991 | Littler et al. | |
| 5,043,075 | A | | 8/1991 | Dietmar et al. | |
| 5,050,259 | A | | 9/1991 | Tsubaki | |
| 5,054,210 | A | | 10/1991 | Schumacher | |
| 5,056,174 | A | | 10/1991 | Hagiwara | |
| 5,082,503 | A | | 1/1992 | Slugs | |
| 5,091,105 | A | | 2/1992 | Madore et al. | |
| 5,093,031 | A | | 3/1992 | Login et al. | |
| 5,104,419 | A | | 4/1992 | Funk | |
| 5,104,545 | A | | 4/1992 | Means et al. | |
| 5,106,507 | A | | 4/1992 | Klock et al. | |
| 5,112,358 | A | | 5/1992 | Deal | |
| 5,116,426 | A | | 5/1992 | Asano et al. | |
| 5,116,473 | A | | 5/1992 | Bostjancic | |
| 5,118,322 | A | | 6/1992 | Wasinger et al. | |
| 5,133,802 | A | | 7/1992 | Maekawa et al. | |
| 5,135,656 | A | | 8/1992 | Means et al. | |
| 5,143,579 | A | | 9/1992 | Field et al. | |
| 5,151,026 | A | | 9/1992 | Anderson et al. | |
| 5,154,854 | A | | 10/1992 | Zabotto et al. | |
| 5,164,030 | A | | 11/1992 | Casper | |
| 5,167,821 | A | | 12/1992 | Tanbo et al. | |
| 5,173,200 | A | | 12/1992 | Kellett | |
| 5,193,560 | A | | 3/1993 | Tanaka | |
| 5,199,125 | A | | 4/1993 | Otto | |
| 5,212,272 | A | | 5/1993 | Sargent et al. | |
| 5,232,476 | A | | 8/1993 | Grant | |
| 5,240,507 | A | | 8/1993 | Gray | |
| 5,248,393 | A | * | 9/1993 | Schumacher et al. | 202/158 |
| 5,256,557 | A | | 10/1993 | Shetty et al. | |
| 5,268,150 | A | | 12/1993 | Burkitt | |
| 5,269,958 | A | | 12/1993 | de Jager | |
| 5,273,589 | A | | 12/1993 | Griswold et al. | |
| 5,284,029 | A | | 2/1994 | Keuper et al. | |
| 5,287,985 | A | | 2/1994 | Hatayama | |
| 5,288,420 | A | | 2/1994 | Mandy | |
| 5,288,422 | A | | 2/1994 | Basu | |
| 5,290,473 | A | | 3/1994 | Basu | |
| 5,294,644 | A | | 3/1994 | Login et al. | |
| 5,300,154 | A | | 4/1994 | Ferber et al. | |
| 5,300,197 | A | | 4/1994 | Mitani et al. | |
| 5,304,253 | A | | 4/1994 | Grant | |
| 5,304,320 | A | | 4/1994 | Barthelemy et al. | |
| 5,308,562 | A | | 5/1994 | Wohlfahrt-Laymann | |
| 5,315,727 | A | | 5/1994 | Lee | |
| 5,316,690 | A | | 5/1994 | Li | |
| 5,320,683 | A | | 6/1994 | Samejima | |
| 5,334,258 | A | | 8/1994 | Osano | |
| 5,340,443 | A | | 8/1994 | Heinio et al. | |
| 5,340,464 | A | | 8/1994 | Mickas | |
| 5,342,405 | A | | 8/1994 | Duncan | |
| 5,344,527 | A | | 9/1994 | Mickas | |
| 5,346,588 | A | | 9/1994 | Sixta et al. | |
| 5,354,428 | A | | 10/1994 | Clark et al. | |
| 5,354,480 | A | | 10/1994 | Robinson et al. | |
| 5,360,547 | A | | 11/1994 | Cockett et al. | |
| 5,368,649 | A | | 11/1994 | Tsukazaki | |
| 5,377,705 | A | | 1/1995 | Smith | |
| 5,392,480 | A | | 2/1995 | Ishihara | |
| 5,404,732 | A | | 4/1995 | Kim | |
| 5,405,542 | A | | 4/1995 | Trinh | |
| 5,405,767 | A | | 4/1995 | Shetty | |
| 5,407,446 | A | | 4/1995 | Sando | |
| 5,419,849 | A | | 5/1995 | Fields | |
| 5,421,049 | A | | 6/1995 | Hendren | |
| 5,423,921 | A | | 6/1995 | Saal | |
| 5,426,955 | A | | 6/1995 | Modahl | |
| 5,427,858 | A | | 6/1995 | Nakamura et al. | |
| 5,431,827 | A | | 7/1995 | Tatch | |
| 5,439,817 | A | | 8/1995 | Shetty et al. | |
| 5,443,747 | A | | 8/1995 | Inada et al. | |
| 5,447,171 | A | | 9/1995 | Shibano | |
| 5,456,856 | A | | 10/1995 | Flaningam et al. | |
| 5,460,018 | A | | 10/1995 | Werner | |
| 5,463,819 | A | | 11/1995 | Komori | |
| 5,467,492 | A | | 11/1995 | Chao et al. | |
| 5,480,572 | A | | 1/1996 | Minor | |
| 5,488,842 | A | | 2/1996 | Nishioka et al. | |
| 5,490,894 | A | | 2/1996 | Matsuhisa | |
| 5,492,138 | A | | 2/1996 | Taricco | |
| 5,493,743 | A | | 2/1996 | Schneider | |

5,494,526 A 2/1996 Paranjpe
5,494,600 A 2/1996 Surutzidis et al.
5,498,266 A 3/1996 Takagawa
5,500,096 A 3/1996 Yuan
5,501,811 A 3/1996 Flaningam et al.
5,503,681 A 4/1996 Inada
5,503,756 A 4/1996 Corona, III et al.
5,504,954 A * 4/1996 Joo et al. ..... 8/158
5,505,985 A 4/1996 Nakamura et al.
5,511,264 A 4/1996 Nishioka et al.
5,518,624 A 5/1996 Filson et al.
5,524,358 A 6/1996 Matz
5,536,327 A 7/1996 Kaiser
5,536,374 A 7/1996 Spring
5,537,754 A 7/1996 Bachmann et al.
5,538,025 A 7/1996 Gray et al.
5,538,746 A 7/1996 Levy
5,555,641 A 9/1996 Lee
5,591,236 A 1/1997 Roetker
5,593,598 A 1/1997 McGinness et al.
5,604,145 A 2/1997 Hashizume et al.
5,605,882 A 2/1997 Klug et al.
5,617,737 A 4/1997 Christensen et al.
5,622,630 A 4/1997 Romano
5,625,965 A 5/1997 Blissett et al.
5,637,336 A 6/1997 Kannenberg et al.
5,644,158 A 7/1997 Fujii et al.
5,645,727 A 7/1997 Bhave et al.
5,649,785 A 7/1997 Djerf et al.
5,653,873 A 8/1997 Grossman
5,656,246 A 8/1997 Patapoff et al.
5,668,102 A 9/1997 Severns et al.
5,676,005 A 10/1997 Balliett
5,712,240 A 1/1998 Tyerech et al.
5,759,209 A 6/1998 Adler
5,765,403 A 6/1998 Lincoln et al.
5,773,403 A 6/1998 Hijino et al.
5,776,351 A 7/1998 McGinness et al.
5,776,362 A 7/1998 Sato et al.
5,787,537 A 8/1998 Mannillo
5,789,368 A 8/1998 You et al.
5,799,612 A 9/1998 Page
5,806,120 A 9/1998 McEachern
5,814,498 A 9/1998 Mani et al.
5,814,592 A 9/1998 Kahn et al.
5,814,595 A 9/1998 Flynn et al.
5,824,632 A 10/1998 Flaningam et al.
5,840,675 A 11/1998 Yeazell
5,846,435 A 12/1998 Haase
5,849,197 A 12/1998 Taylor et al.
5,853,593 A 12/1998 Miller
5,858,240 A 1/1999 Twardowski et al.
5,865,851 A 2/1999 Sidoti et al.
5,865,852 A 2/1999 Berndt
5,868,937 A 2/1999 Back et al.
5,876,685 A 3/1999 Krulik et al.
5,885,366 A 3/1999 Umino et al.
5,888,250 A 3/1999 Hayday et al.
5,893,979 A 4/1999 Held
5,894,061 A 4/1999 Ladouceur
5,904,737 A 5/1999 Preston et al.
5,906,750 A 5/1999 Haase
5,912,408 A 6/1999 Trinh et al.
5,914,041 A 6/1999 Chancellor
5,925,469 A 7/1999 Gee
5,925,611 A 7/1999 Flynn et al.
5,935,441 A 8/1999 O'Neill et al.
5,935,525 A 8/1999 Lincoln et al.
5,942,007 A 8/1999 Berndt et al.
5,954,869 A 9/1999 Elfersy et al.
5,955,394 A 9/1999 Kelly
5,958,240 A 9/1999 Hoel
5,959,014 A 9/1999 Liebeskind et al.
5,960,501 A 10/1999 Burdick
5,960,649 A 10/1999 Burdick
5,962,390 A 10/1999 Flynn et al.
5,972,041 A 10/1999 Smith et al.
5,977,040 A 11/1999 Inada et al.
5,985,810 A 11/1999 Inada et al.
6,006,387 A 12/1999 Cooper
6,010,621 A 1/2000 Pattee
6,013,683 A 1/2000 Hill et al.
6,027,651 A 2/2000 Cash
6,029,479 A 2/2000 Pattee
6,042,617 A 3/2000 Berndt
6,042,618 A 3/2000 Berndt
6,045,588 A 4/2000 Estes et al.
6,056,789 A 5/2000 Berndt
6,059,845 A 5/2000 Berndt
6,059,971 A 5/2000 Vit et al.
6,060,108 A 5/2000 Burd et al.
6,063,135 A 5/2000 Berndt et al.
6,063,748 A 5/2000 Flynn et al.
6,086,635 A 7/2000 Berndt et al.
6,098,306 A 8/2000 Ramsey et al.
6,113,815 A 9/2000 Elfersy et al.
6,115,862 A 9/2000 Cooper et al.
6,120,587 A 9/2000 Elfersy
6,136,223 A 10/2000 Collins
6,136,766 A 10/2000 Inada et al.
6,149,980 A 11/2000 Behr et al.
6,159,376 A 12/2000 Lahti
6,159,917 A 12/2000 Baran
6,168,714 B1 1/2001 Ilias et al.
6,171,346 B1 1/2001 Yeazell et al.
6,177,399 B1 1/2001 Mei et al.
6,190,556 B1 2/2001 Uhlinger
6,207,634 B1 3/2001 Meyer et al.
6,216,302 B1 4/2001 Preston et al.
6,217,771 B1 4/2001 Boyle et al.
6,221,944 B1 4/2001 Liebeskind
6,238,516 B1 5/2001 Watson et al.
6,238,736 B1 5/2001 Smith
6,239,097 B1 5/2001 Wilson
6,241,779 B1 6/2001 Collins
6,241,786 B1 6/2001 Zarges et al.
6,254,838 B1 7/2001 Goede
6,254,932 B1 7/2001 Smith
6,258,130 B1 7/2001 Murphy
6,258,276 B1 7/2001 Mika et al.
6,261,460 B1 7/2001 Benn et al.
6,269,667 B1 8/2001 Back et al.
6,274,540 B1 8/2001 Scheibel et al.
6,277,804 B1 8/2001 Kahn et al.
6,281,187 B1 8/2001 Smerznak
6,288,018 B1 9/2001 Flynn et al.
6,299,779 B1 * 10/2001 Pattee ..... 210/694
6,309,425 B1 10/2001 Murphy
6,309,752 B1 10/2001 Dams et al.
6,310,029 B1 10/2001 Kilgour et al.
6,312,476 B1 11/2001 Perry et al.
6,319,406 B1 11/2001 Freshour et al.
6,327,731 B2 12/2001 Back
6,334,340 B1 1/2002 Kegler et al.
6,348,441 B1 2/2002 Aiken et al.
6,350,377 B1 2/2002 Kollmar et al.
6,365,051 B1 4/2002 Bader
6,379,547 B1 4/2002 Larsson
6,384,008 B1 5/2002 Parry
6,387,186 B1 5/2002 Reisig et al.
6,387,241 B1 5/2002 Murphy et al.
6,398,840 B1 6/2002 Orta-Castro et al.
6,399,357 B1 6/2002 Winge
6,402,956 B1 6/2002 Andou et al.
6,416,668 B1 7/2002 Al-Samadi
6,423,230 B2 7/2002 Ilias et al.

| | | | |
|---|---|---|---|
| 6,451,066 | B2 | 9/2002 | Estes et al. |
| 6,475,968 | B1 | 11/2002 | Murphy et al. |
| 6,552,090 | B1 | 4/2003 | Behr et al. |
| 6,558,432 | B2 | 5/2003 | Schulte et al. |
| 6,591,638 | B2 | 7/2003 | Estes et al. |
| 6,653,512 | B1 | 11/2003 | Behr et al. |
| 6,670,317 | B2 | 12/2003 | Severns et al. |
| 6,691,536 | B2 | 2/2004 | Severns et al. |
| 6,734,153 | B2 | 5/2004 | Scheper |
| 6,743,262 | B1 | 6/2004 | Behr et al. |
| 6,746,617 | B2 | 6/2004 | Radomyselski et al. |
| 6,766,670 | B2 | 7/2004 | Estes et al. |
| 6,770,615 | B1 | 8/2004 | Aouad et al. |
| 6,811,811 | B2 | 11/2004 | Gerald France et al. |
| 6,828,295 | B2 | 12/2004 | Deak et al. |
| 6,840,069 | B2 * | 1/2005 | France et al. ..... 68/12.02 |
| 6,855,173 | B2 | 2/2005 | Ehrnsperger et al. |
| 6,860,998 | B1 | 3/2005 | Wilde |
| 6,890,892 | B2 | 5/2005 | Scheper et al. |
| 6,894,014 | B2 | 5/2005 | Deak et al. |
| 6,898,951 | B2 | 5/2005 | Severns et al. |
| 7,033,985 | B2 | 4/2006 | Noyes et al. |
| 7,084,099 | B2 * | 8/2006 | Radomyselski et al. ..... 510/285 |
| 2001/0042275 | A1 | 11/2001 | Estes et al. |
| 2001/0054202 | A1 | 12/2001 | Severns et al. |
| 2002/0004950 | A1 | 1/2002 | Burns et al. |
| 2002/0004952 | A1 | 1/2002 | Deak et al. |
| 2002/0004995 | A1 | 1/2002 | Ammat et al. |
| 2002/0007519 | A1 | 1/2002 | Noyes et al. |
| 2002/0010964 | A1 | 1/2002 | Deak et al. |
| 2002/0013234 | A1 | 1/2002 | Severns et al. |
| 2002/0017493 | A1 | 2/2002 | Ehrnsperger et al. |
| 2002/0029427 | A1 | 3/2002 | Severns et al. |
| 2002/0038480 | A1 | 4/2002 | Deak et al. |
| 2002/0056163 | A1 | 5/2002 | Estes |
| 2002/0056164 | A1 | 5/2002 | Estes et al. |
| 2002/0133886 | A1 | 9/2002 | Severns et al. |
| 2003/0046963 | A1 | 3/2003 | Scheper et al. |
| 2003/0084588 | A1 | 5/2003 | France et al. |
| 2003/0097718 | A1 | 5/2003 | Evers et al. |
| 2003/0196277 | A1 * | 10/2003 | Hallman et al. ..... 8/142 |
| 2003/0204917 | A1 | 11/2003 | Estes et al. |
| 2003/0226214 | A1 | 12/2003 | Radomyselski et al. |
| 2004/0088795 | A1 | 5/2004 | Orchowski et al. |
| 2004/0088846 | A1 | 5/2004 | Murphy et al. |
| 2004/0117919 | A1 | 6/2004 | Conrad et al. |
| 2004/0139555 | A1 | 7/2004 | Conrad |
| 2005/0037938 | A1 | 2/2005 | Elhamid et al. |
| 2005/0043196 | A1 | 2/2005 | Wright et al. |
| 2005/0071928 | A1 | 4/2005 | Wright et al. |
| 2005/0076453 | A1 | 4/2005 | Lucas et al. |
| 2005/0091755 | A1 | 5/2005 | Conrad et al. |
| 2005/0091756 | A1 | 5/2005 | Wright |
| 2005/0091757 | A1 | 5/2005 | Luckman et al. |
| 2005/0092033 | A1 | 5/2005 | Luckman et al. |
| 2005/0096242 | A1 | 5/2005 | Luckman et al. |
| 2005/0096243 | A1 | 5/2005 | Luckman et al. |
| 2005/0126606 | A1 | 6/2005 | Goedhart |
| 2005/0132502 | A1 | 6/2005 | Goldoni |
| 2005/0133462 | A1 | 6/2005 | Goldini |
| 2005/0150059 | A1 | 7/2005 | Luckman et al. |
| 2005/0155393 | A1 | 7/2005 | Wright et al. |
| 2005/0222002 | A1 | 10/2005 | Luckman et al. |
| 2005/0257812 | A1 | 11/2005 | Wright et al. |
| 2005/0263173 | A1 | 12/2005 | Luckman et al. |

FOREIGN PATENT DOCUMENTS

| | | |
|---|---|---|
| EP | 0182583 | 11/1985 |
| EP | 0182583 | 7/1991 |
| EP | 0246007 | 3/1992 |
| EP | 6233898 | 8/1994 |
| EP | 0707060 | 7/1998 |
| EP | 1041189 | 10/2000 |
| EP | 1290259 | 3/2003 |
| EP | 1528138 | 10/2004 |
| EP | 1528139 | 10/2004 |
| EP | 1528140 | 10/2004 |
| EP | 1528141 | 10/2004 |
| EP | 1536052 | 10/2004 |
| EP | 1528138 | 5/2005 |
| EP | 1528139 | 5/2005 |
| EP | 153052 | 6/2005 |
| GB | 1002318 | 8/1965 |
| GB | 1500801 | 2/1975 |
| JP | 405064521 | 3/1993 |
| JP | 06233898 | 8/1994 |
| JP | 11-216483 | * 8/1999 |
| WO | WO 98/06815 | 2/1998 |
| WO | WO98/06815 | 2/1998 |
| WO | WO 99/14175 | 3/1999 |
| WO | WO 01/06051 | 1/2001 |
| WO | WO 01/34613 | 5/2001 |
| WO | WO 01/44256 | 6/2001 |
| WO | WO 01/94675 | 12/2001 |
| WO | WO 01/94677 | 12/2001 |
| WO | WO 01/94680 | 12/2001 |
| WO | WO 01/94683 | 12/2001 |
| WO | WO 01/94685 | 12/2001 |
| WO | WO0194675 | 12/2001 |

* cited by examiner

NON-AQUEOUS WASHING MACHINE WITH MODULAR CONSTRUCTION

CROSS-REFERENCES TO RELATED APPLICATIONS

This application is a non-provisional application claiming priority on provisional application U.S. Ser. No. 60/516,423 (filed Oct. 31, 2003) and is further a continuation-in-part of, claims priority to, and the benefit from both U.S. Ser. No. 10/027,160 (filed 20 Dec. 2001), and Ser. No. 10/027,431 (filed 20 Dec. 2001) both of which are divisionals of Ser. No. 09/520,653 (filed 07 Mar. 2000), which is now U.S. Pat. No. 6,451,066, which itself is a divisional of Ser. No. 09/038,054 (filed 11 Mar. 1998), which is now U.S. Pat. No. 6,045,588, which itself claims the benefit of provisional patent application Ser. No. 60/045,072 (filed 29 Apr. 1997); the disclosures of which are entirely incorporated by reference herein.

TECHNICAL FIELD OF THE INVENTION

The invention relates to a non-aqueous laundering machine, and components thereof.

BACKGROUND OF THE INVENTION

The present invention generally relates to apparatuses, methods, and chemistries employed in the home for laundering clothing and fabrics. More particularly, it relates to a new and improved method, apparatus, and chemistry for home laundering of a fabric load using a wash liquor comprising a multi-phase mixture of a substantially inert working fluid (IWF) and at least one washing adjuvant.

As used herein, the terms "substantially non-reactive" or "substantially inert" when used to describe a component of a wash liquor or washing fluid, means a non-solvent, non-detersive fluid that under ordinary or normal washing conditions, e.g. at pressures of 0 Pa to $0.5\times10^6$ Pa and temperatures of from about 1° C. to about 100° C., does not appreciably react with the fibers of the fabric load being cleaned, the stains and soils on the fabric load, or the washing adjuvants combined with the component to form the wash liquor. An IWF ideally does very little or nothing except act as a carrier or vehicle to carry an adjuvant to the clothes so that the adjuvant can work on the clothes.

Home laundering of fabrics is usually performed in an automatic washing machine and occasionally by hand. These methods employ water as the major component of the washing fluid. Cleaning adjuvants such as detergents, enzymes, bleaches and fabric softeners are added and mixed with the water at appropriate stages of the wash cycle to provide cleaning, whitening, softening, and the like.

Although improvements in automatic washing machines and in cleaning agent formulations are steadily being made, as a general rule, conventional home laundering methods consume considerable amounts of water, energy, and time. Water-based methods are not suitable for some natural fiber fabrics, such as silks, woolens and linens, so that whole classes of garments and fabrics cannot be home laundered, but instead, must be sent out for professional dry cleaning. During water washing, the clothes become saturated with water and some fibers swell and absorb water. After washing, the water must be removed from the clothes. Typically, this is performed in a two-step process including a hard spin cycle in the washer and a full drying cycle in an automatic dryer. The hard spin cycles tend to cause undesirable wrinkling. Even after spinning, drying cycle times are undesirably long.

The solution to this problem was the advent of the traditional dry cleaning business. Consumers had to travel to the dry cleaners, drop off clothes, pay for dry cleaning, and pick the clothes up. While the dry cleaning process is useful to the consumer, it plays terrible havoc with the environment. Traditional dry cleaning uses halogenated hydrocarbons, such as perchloroethylene (nefariously known as "perc"). Because the use of perc is calamitous, strict environmental regulations exist to control its use and disposition. The stricter controls sent many in the dry cleaning industry towards petroleum-based solvents. These solvents are inflammable and are smog-producers. Accordingly, the use of these solvents in the home is out of the question.

A further non-aqueous solvent based washing method employs liquid or supercritical carbon dioxide solvent as a washing liquid. As described in U.S. Pat. No. 5,467,492, highly pressurized vessels are required to perform this washing method. In accordance with these methods, pressures of about $3.45\times10^6$ Pa to $6.89\times10^6$ Pa are required. Pressures of up to about $0.206\times10^6$ Pa are approved for use in the home. The high pressure conditions employed in the carbon dioxide create safety hazards that make them unsuitable for residential use.

Various perfluorocarbon materials have been employed alone or in combination with cleaning additives for washing printed circuit boards and other electrical substrates, as described for example in U.S. Pat. No. 5,503,681. Spray cleaning of rigid substrates is very different from laundering soft fabric loads. Moreover, cleaning of electrical substrates is performed in high technology manufacturing facilities employing a multi-stage apparatus which is not readily adapted for home use.

SUMMARY OF THE INVENTION

The foregoing problems are solved and a technical advance is achieved by the present invention. Disclosed is a laundering machine, methods, and chemistries for home laundering of fabrics as well as components and subsystems thereof. The machine may include one or more wash units and a reclamation unit. Various modular alternatives are disclosed. In addition, methods of washing, recirculating, drying, reclaiming, and disposing as well as wash fluid chemistries, and combinations, thereof are disclosed.

DETAILED DESCRIPTION OF THE INVENTION

At the outset it should be noted that various Figures illustrate various components and subcomponents. Because of the relative complexity involved, many Figures omit nonessential features such as means for connecting components to a frame, or showing various conduits, piping, or wiring. Accordingly, while it may be appear that certain components are unconnected, it is understood that the components are connected to something. In addition, various structural features, such as frames may be omitted to avoid confusion. In addition, although certain systems, subsystems, and loops are described as having pumps, it should be noted that in any part of the machine and along any part of a system, more than one pump may be used to assist in fluid flow, solid flow, recycling, recirculation, etc. Accordingly, it is intended that between any two parts described, there may be a pump to assist in flow. Furthermore, any part or conduit may have an anti-static agent associated therewith. In addition, for any numeric parameter, it is understood that embodiments of the invention may include any range within a stated range (for example, for a stated range of between X and Y shall be interpreted to mean that any range between X and Y is contemplated), or may include a base figure that has no upper or lower limit (for example, a parameter>X shall be interpreted to mean that the parameter has no upper limit and that the inventors may impose any upper limit as desired; and a parameter<X shall be interpreted to mean that the parameter is less than X and has no lower limit and that the inventors may impose any lower limit as desired).

Figure 1:
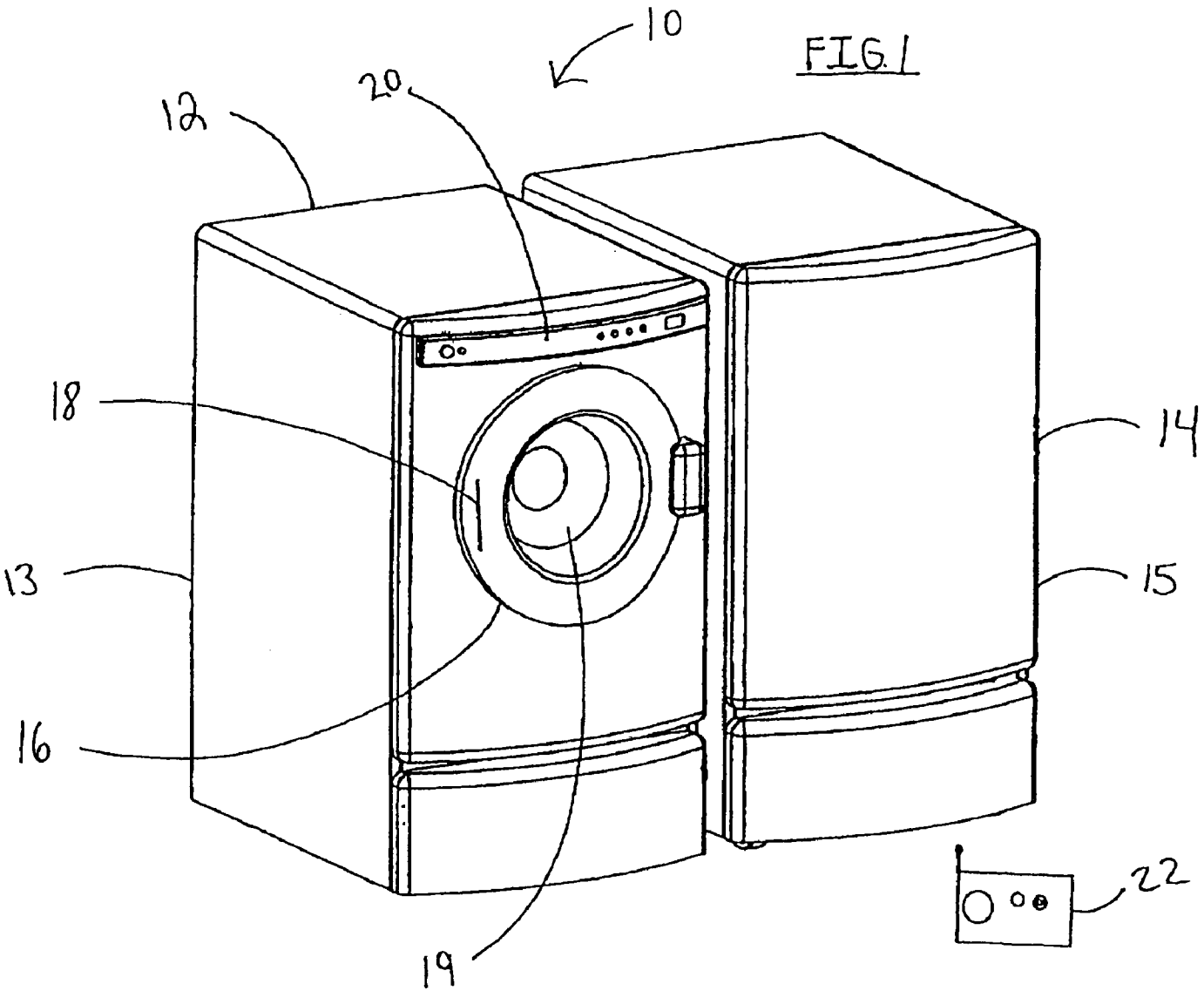
FIG. 1 demonstrates an embodiment of the invention.

FIG. 1 shows an embodiment of the invention. Shown is the non-aqueous washing machine 10, comprising a wash unit 12 and a reclamation unit 14. The machine 10 also includes a wash unit outer housing 13 and a reclamation unit outer housing 15. It is understood that although FIG. 1 shows the wash unit 12 and reclamation unit 14 in a side-by-side position, the units may be stackable. In addition, although the units are shown as separate units, it is understood that the units may be generally within the same outer housing. Additionally, multiple wash drums may be used with a single reclamation and storage unit. For example, two wash units 12 are illustrated adjacent a single reclamation and storage unit 14 in FIGS. 15, 16, 18 and 20.

The wash unit 12 includes a wash unit door 16, preferably with a handle 18. The door 16 may be opened to add and remove the items, such as a fabric load to be washed. The door 16 may include a door window 19 so that the contents may be viewed. Although shown on the wash unit 12, a control panel 20 may be used to control the operation of the machine. In addition, the control panel 20 may be located on the reclamation unit 14. The control panel 20 may include a variety of buttons, dials, displays, gauges, lights, etc. The machine should be proportioned such that it can be transversed through the doorways conventionally found in homes and preferably with a depth of no more than 60 cm. In the preferred embodiment, the machine would have a footprint no larger than the footprint of full-size conventional aqueous automatic washers. Additionally, the reclamation and storage components of the system may be incorporated within a base unit 12-24 inches in height. This base unit is placed under the machine to provide the consumer with an ergonomically-viable height. In another preferred embodiment, the enclosures of the wash unit 12 and the reclamation unit 14 each comprises a physical structure having a width, depth, and height not exceeding 69 cm, 74 cm, and 132 cm, respectively.

Although FIG. 1 shows the wash unit 12 and the reclamation unit 14 side-by-side, it is understood that the units may be at some distance from each other. For example, the wash unit 12 may be inside, such as in a laundry room, and the reclamation unit 14 may be outside the dwelling. In this regard, servicing of the reclamation unit 14 becomes easier as the consumer need not be home in order to allow access to the reclamation unit. Another advantage of having a reclamation unit 14 outside is that any leaks, in the unlikely event they occur, will not dissipate inside the dwelling. Accordingly, where the reclamation unit 14 is intended to be located outdoors, the unit 14 may include various weather protection means, such as weather resistant paint, rust proofing, locks to prohibit intermeddling, etc.

The distance between the units is a function of the length of conduits connecting the two. For any distance, intermediate pumps may be added to assist in fluid flow between the units. To further assist in assembly, servicing, or movement, the connections between the units may include quick release hydraulic connectors, such as a Packer USA Series ST quick release connector. Of course traditional threaded nut designs may be used. It is also desirable to locate the connection between the units near the top so that as conduits are removed, any residual fluids remain in the conduits and do not leak out. The fluids would return to the lowest points in the respective units.

The machine 10 may also include a receiver such that a remote control unit 22, such as a handheld unit, may transmit one or more control signals to the machine 10 receiver to control the machine. For example, the receiver may be part of the control panel 20. The machine 10 and/or control panel 20 may also include a transmitter that sends signals to the remote unit 22. The transmitter may send any type of information to the remote unit 22, such as status information, safety information, or emergency information. In this regard, there may be two-way communication between the machine 10 and the remote unit 22. One example of such use would include the machine 10 transmitting status information, such as time remaining, cycle step, unbalanced load information; or emergency information such as blocked conduits, valve failure, clogged filters, breach of the closed system, fluid leak, pressure drops, temperature increase, chemical leakage, etc. After receiving this information, the user may use the remote unit 22 to send control signals, such as shut-off signals or a command delay start of all or part of the wash or other cycles, to the machine 10. The machine may also store any information in a memory storage unit so that the information can be retrieved later. This may be useful during servicing to assist diagnosing information. Such technology could be readily adapted from airline black box technology. Moreover, the machine may be controlled or monitored via other wireless or Internet technologies. For example, the machine may be Internet connected so that a consumer can remotely control the machine. Similarly, the machine may contact a customer service center automatically to provide information. In addition, cell phone technologies may also be used to "call" the machine and control the machine. Accordingly, in one embodiment, there is disclosed a means to remotely receive information, a means to remotely send signals to the machine 10, a means to send signals from the machine 10, and a means to receive signals at the machine 10.

Figure 2A:
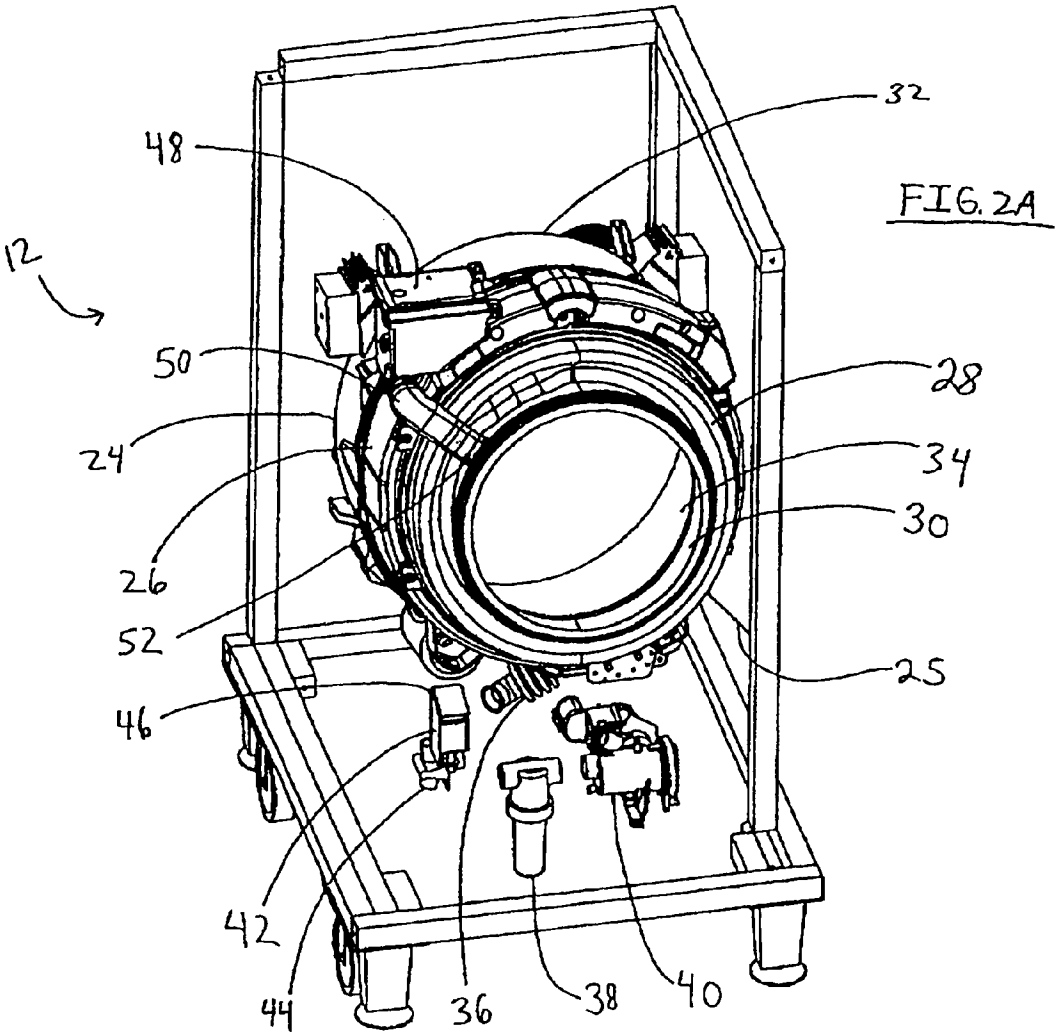
FIG. 2A demonstrates an embodiment of the invention.

FIG. 2A shows an embodiment of the wash unit 12, without the outer housing 13. Shown is a tub assembly 24, which includes a wash chamber 26 that is adapted to receive the contents to be washed, such as a fabric load (not shown). The tub assembly is connected to an outer structure via various suspension arms 25. The wash chamber 26 also includes a flexible boot 28 that circumferentially surrounds the opening 30 of the wash chamber 26. The boot 28 is adapted to provide a seal around the wash chamber 26 opening and also provide a conduit to the door 16. The wash chamber 26 also includes a rear section 32. Inside the wash chamber 26 is a basket 34 that includes one or more perforations. The perforations may be uniformly dispersed about the basket 34, randomly dispersed, or dispersed in some other fashion. The perforations provide fluid communication between the interior of the wash basket 34 to the wash chamber 26.

A. Wash Unit Recirculation System

FIG. 2A also demonstrates a wash unit recirculation system. In various embodiments of the invention described herein, wash liquor may be extracted from the wash chamber 26 and recirculated back into the wash chamber 26. One embodiment is now described. The wash chamber 26 includes a drain outlet (not shown) that is in fluid communication with a wash chamber sump 36. The wash chamber sump 36 may be designed to have a large volume capacity so that it may store the entire volume of wash liquor introduced into the wash chamber 26. For example, in the event of a system failure, the wash liquor can drain into the chamber sump 36. The drain outlet (not shown) may also include a gate or cover that can be sealed. Accordingly, in the event of a system failure, the wash liquor contents may be drained into the sump 36, the drain outlet closed, and the fabric contents can be removed.

A heater (not shown) may be optionally associated with sump 36 so that the wash liquor in the sump may be heated. In various embodiments, it may be desirable to recirculate heated wash liquor back into the fabric so that the fabric maintains an elevated temperature, or because various washing adjuvant(s) work—or work better—in a heated environment. The heater may also heat the wash liquor to deactivate adjuvant(s) in the wash liquor. Accordingly, the heater may be programmed to activate or deactivate based on the intended use.

Wash chamber sump 36 is in fluid communication with a filter 38, such as a coarse lint filter, that is adapted to filter out large particles, such as buttons, paper clips, lint, food, etc. The filter 38 may be consumer accessible to provide for removal, cleaning, and/or replacement.

Accordingly, it may be desirable to locate the filter 38 near the front side of the wash unit 12 and preferably near the bottom so that any passive drainage occurs into the sump 36 and the filter 38. In another embodiment, the filter 38 may also be backflushed to the reclamation unit 14 so that any contents may be removed from the reclamation unit 14. In yet another embodiment, the filter can be back-flushed within the wash unit to the sump and then pumped to the reclamation unit. In this regard, consumer interaction with the filter 38 can be intentionally limited.

Filtered wash liquor may then be passed to the reclamation unit 14 for further processing or may be passed to a recirculation pump 40. Although not shown, a multiway valve may also be positioned between the filter 38 and the pump 40 to direct the wash liquor to the reclamation unit 14 for the further processing. After processing, the wash liquor may be returned to the recirculation loop at an entry point anywhere along the loop. The recirculation pump may be controlled to provide continuous operation, pulsed operation, or controlled operation. Returning to the embodiment of FIG. 2A, recirculation pump 40 then pumps the wash liquor to a multi-way recirculation valve 42. Based on various programming, the recirculation valve 42 may be defaulted to keep the wash liquor in the recirculation loop or defaulted to route the wash liquor to another area, such as the reclamation unit 14. For example, recirculation valve 42 may include a recirculation outlet 44 and a reclamation outlet 46. In the embodiment where recirculation is desired, wash liquor is shunted via the recirculation outlet 44 to a dispenser 48.

Figure 2B:
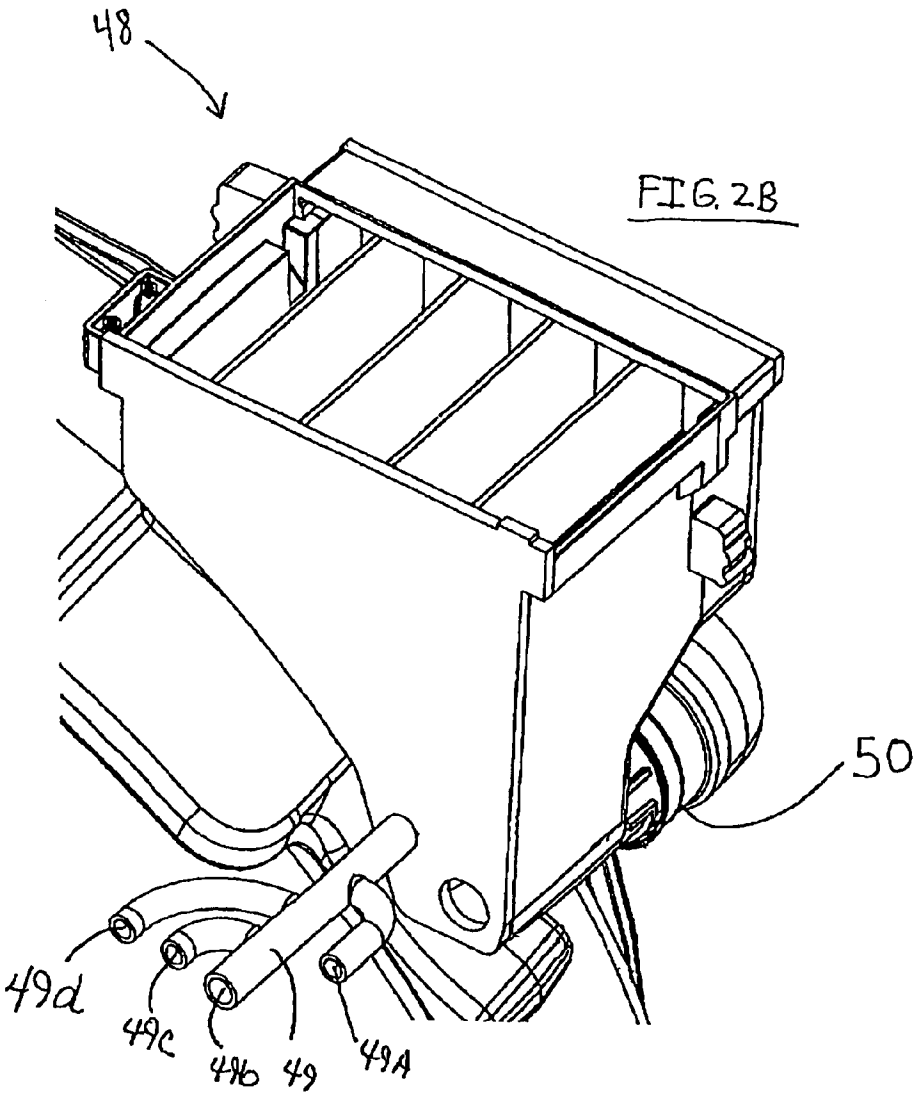
FIG. 2B demonstrates an embodiment of the invention.

FIG. 2B shows the dispenser 48. The dispenser 48 may include one or more dispenser inlets 49*a*, 49*b*, 49*c* and 49*d* on an inlet manifold 49. The dispenser 48 may also include one or more mixing means to mix the contents of the dispenser. For example, if additional adjuvants are added to the wash liquor, they may be added from independent chambers in the dispenser and then mixed in the dispenser 48. Accordingly, dispenser 48 may include mixers that actively mix the contents around or passive mixers such as baffles or fins that mix the contents via obstructing the fluid path (e.g., create turbulence, eddys, etc.). Some potential methods of mixing to create the wash liquor are vortex mixing, in-line mixing via baffles in a tube, axial flow impellers, radial-flow impellers, close-clearance stirrers, unbaffled tanks or tubes, tumbling in the drum or potentially in the pump. The wash liquor can be a micro-emulsion, macro-emulsion or a homogenous mixture dependant upon the adjuvant and the mixing means.

As mentioned above concerning the sump 36, a heater may also be associated with the dispenser to modulate the temperature of the dispenser contents. After mixing or heating, if any is to be done, the dispenser contents exit the dispenser via a dispenser outlet 50. Dispenser outlet 50 may be gated to control the outflow of the contents. In this regard, each chamber in the dispenser may be individually gated. The contents exit the dispenser via outlet 50 and enter a fill inlet 52, which is in fluid communication with the wash chamber 26. As shown in FIG. 2A, the fill inlet 52 is generally located in the boot 28. The dispenser may be consumer accessible to refill the chambers if desired.

Fill inlet may also include one or more dispensing heads (not shown), such as nozzles or sprayers. The head may be adapted to repel wash liquor or a particular adjuvant so that clogging is avoided or minimized.

Accordingly, wash liquor is reintroduced into the wash chamber 26 and a recirculation loop is formed. As mentioned earlier, at any point in the loop, a multiway valve may be used to shunt the wash liquor to another area, such as the reclamation unit 14 so that the wash liquor may be further processed before returning to the recirculation loop. In this regard, "cleaner" wash liquor is returned to the loop during various wash cycles, such as rinse cycles. In an alternative embodiment, during the rinse cycle, clean working fluid may be routed from the reclamation unit into the recirculation unit. Accordingly, rinse fluid can be derived from (i) previously used working fluid from the current wash cycle that has been cleaned and reintroduced; or (ii) clean working fluid that is from the reclamation unit working fluid reservoir (that is, "fresh" fluid that has not yet been used in the current cycle). In yet another preferred embodiment, the user can specify the select rinse fluid based upon introduction of a particular rinse module in the reclamation unit 14. In the latter embodiment, the user may include any desired number of rinse modules inside the reclamation unit 14.

In addition, the conduits between the various components of the recirculation loop may be adapted to reduce the existence of static charge. Because wash liquor is being conducted through the conduits, a static charge may be generated. To avoid this, the conduits (or surrounding shields) may be made of a material that eliminates static charge build-up in the first place or dissipates the charge as it builds-up. Moreover, the conduit may be shielded with an outer cover that is adapted to dissipate static charge, such as a conductive braid. This cover or braid can be grounded, for example, to the frame. Some potential solutions for minimizing the static charge or dissipating the charge are: using conductive polymers, coating the drum and tubing, bleeding air into the system during the drying step, bleeding electrons into the environment and/or using a relative humidity sensor to make the environment more humid; therefore, less static build-up.

After the wash cycle is over, the wash unit 12 may begin a drying cycle. Wash liquor remaining, as mentioned above, exits the wash chamber 26, exits the wash chamber sump 36, and is eventually shunted to the reclamation unit 14. Because some residual wash liquor may remain in various sumps, filters, and conduits, a series of one way valves (not shown) may be used anywhere along the system to minimize the amount of wash liquor remaining in the wash unit 12 during the drying cycle.

In addition, to the above described embodiment, other components may exist, such as sensors for temperature, humidity, vapor, oxygen, CO and $CO_2$, electrical conduction, enzyme levels, siloxane vapor, siloxane liquid, HFE vapor, HFE liquid, glycol ether vapor, glycol ether liquid, volume, IWF liquid or vapor, level, pressure, etc.

B. Wash Unit Drying System

Figure 3:
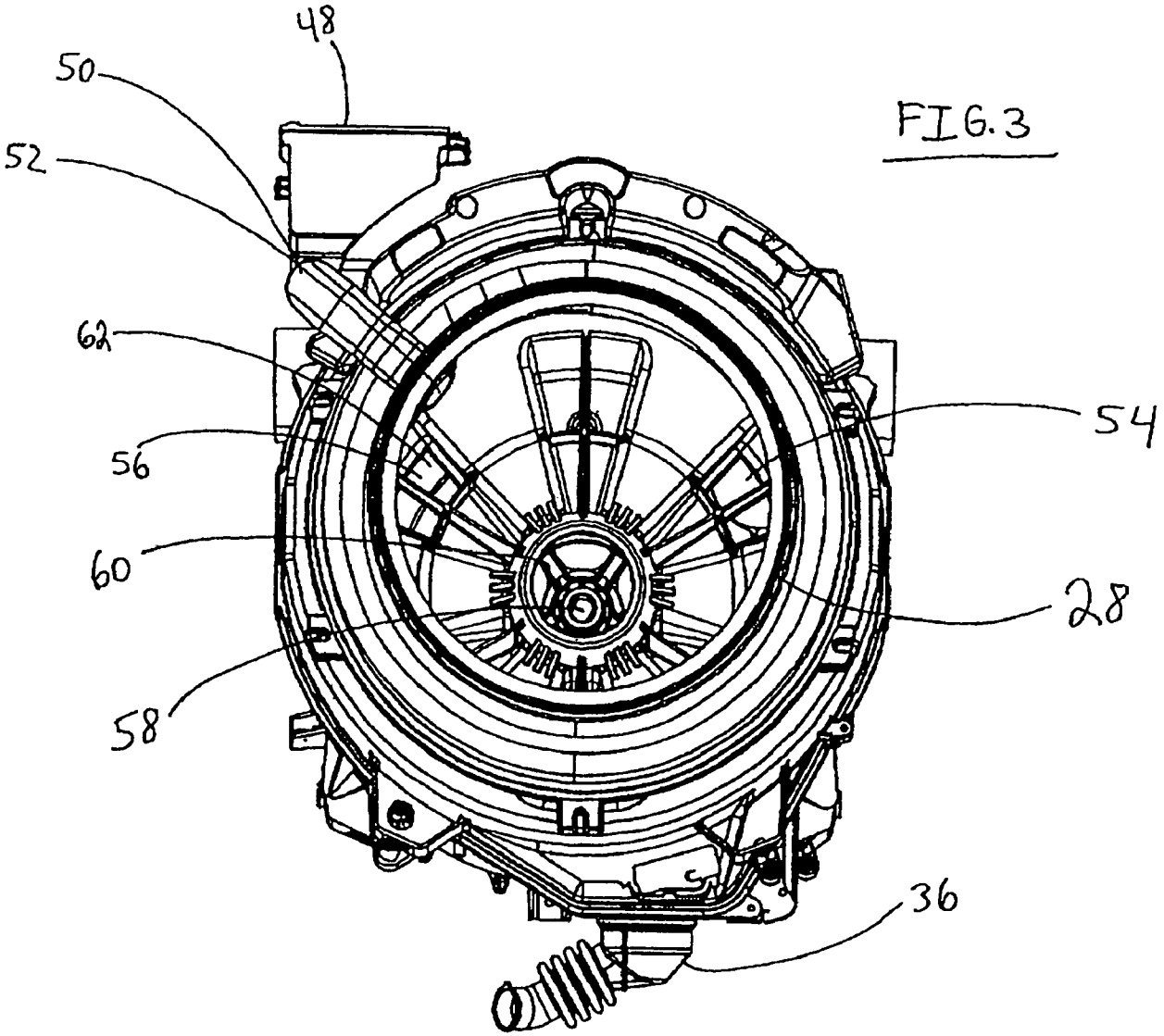
FIG. 3 demonstrates an embodiment of the invention.

FIGS. 3 to 6B illustrate a closed loop drying system. With reference to FIG. 3, shown is a front view of the wash chamber 26 with the basket 34 removed. In the upper positions of the wash chamber rear section 32 are one or more drying outlets 54. These drying outlets provide fluid communication between the interior of the wash chamber 26 and a tub assembly manifold 56. Also shown is the tub assembly central portion 58 that communicates with the drive system 60 (see FIG. 4) to drive the wash chamber. An interior surface 62 of the manifold is seen in the top left outlet 54. The position of the outlets 54 ought to be designed so that bulk fluid does not enter the drying loop in appreciable amounts or fluid entry is minimized. To this end, controlled gates (not shown) may be added to block the outlet 54 until opened. The number of outlets can be chosen to maximize the air flow in the basket 34 so that maximal contact of air with the fabrics is achieved. Similarly, the outlet size that is, the diameter of the outlet (if circular) may also affect the air flow pattern and thus the size may be altered to accommodate for optimal air flow patterns. To this end, the controlled gates (not shown) may also be used to alter the air flow pattern. In one embodiment the air flow rate is about 200 $m^3$/hour.

Figure 4:
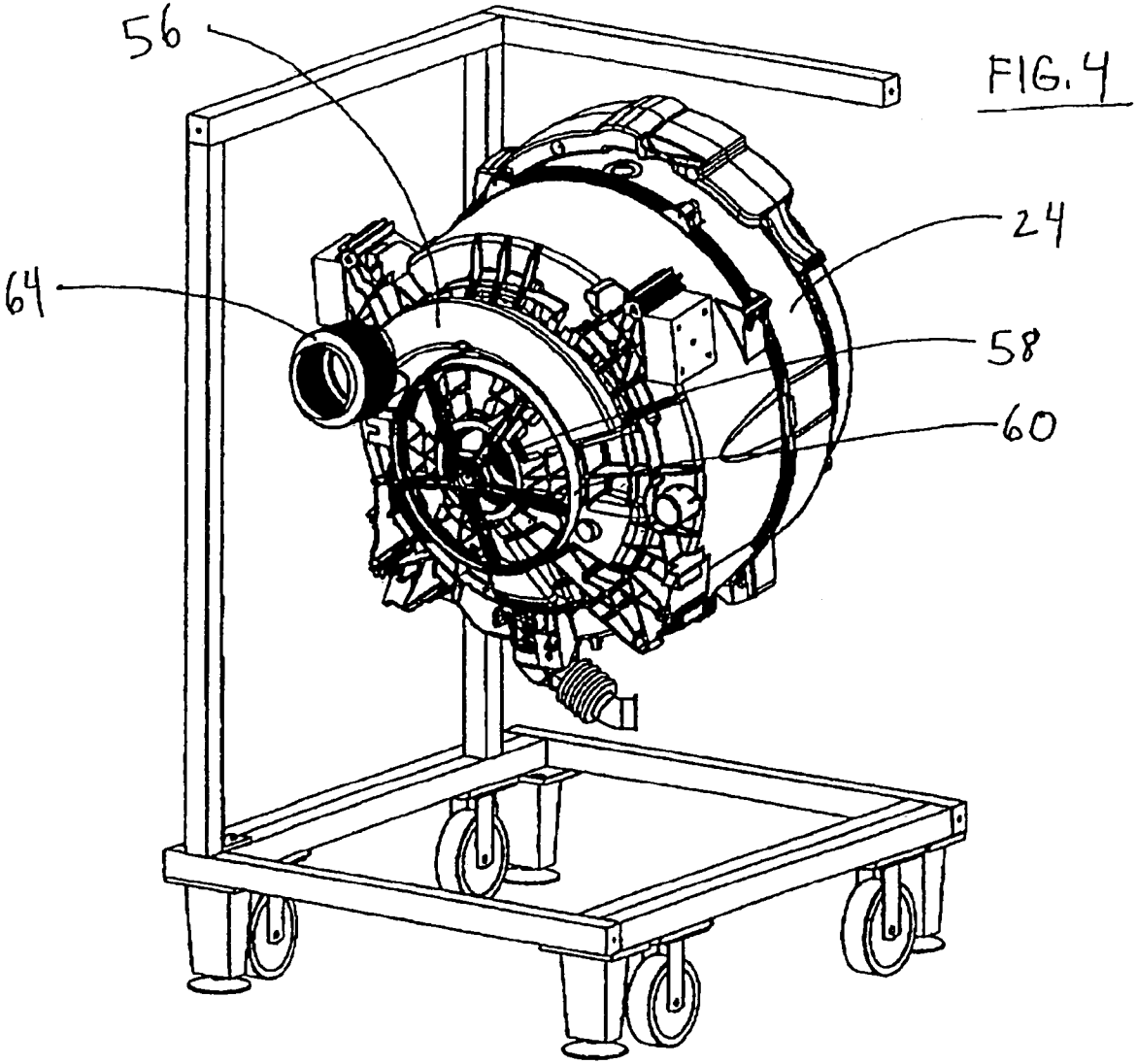
FIG. 4 demonstrates an embodiment of the invention.

FIG. 4 shows a rear view of the tub assembly 24. Shown is the tub assembly manifold 56 and the tub central portion 58, and part of the drive system 60. As part of the air flow during the drying loop, air exits the drying outlet(s) 54, enters the tub assembly manifold 56, and exits the manifold 56 through the flexible conduit 64.

Figure 5:
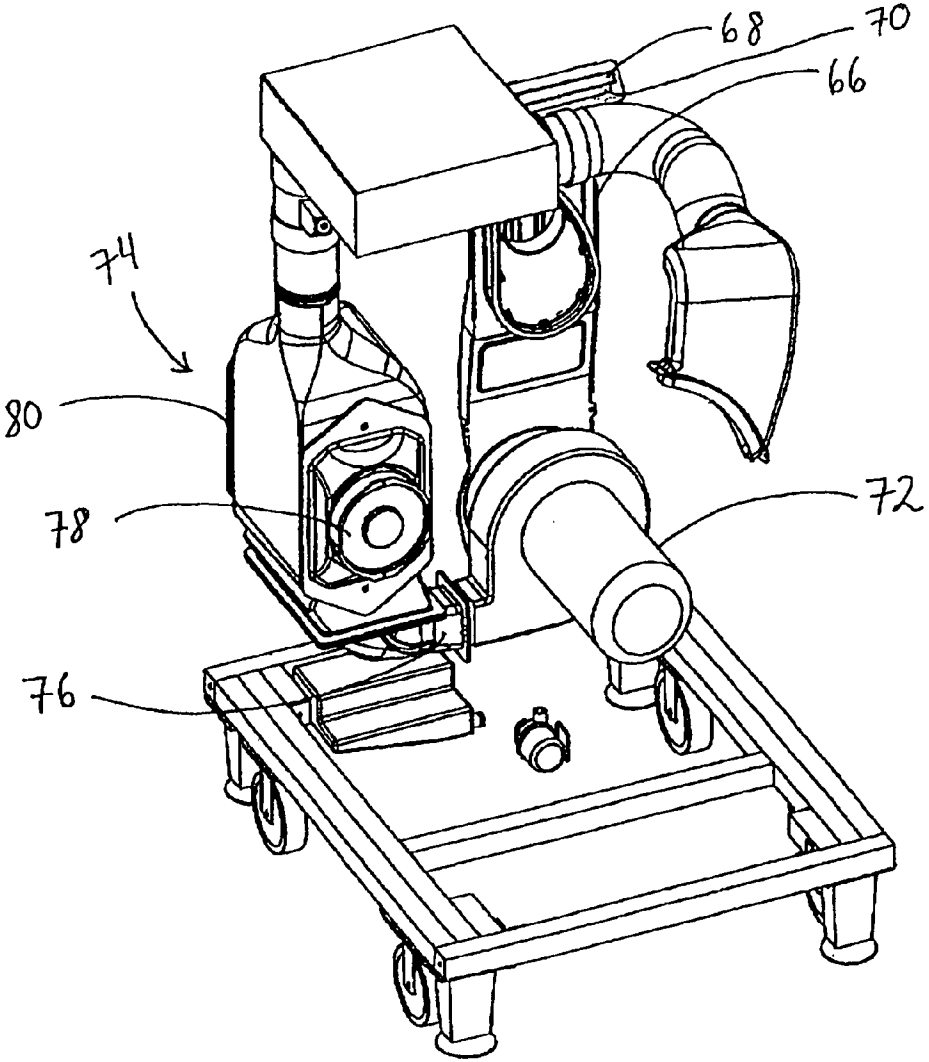
FIG. 5 demonstrates an embodiment of the invention.
Figure 6A:
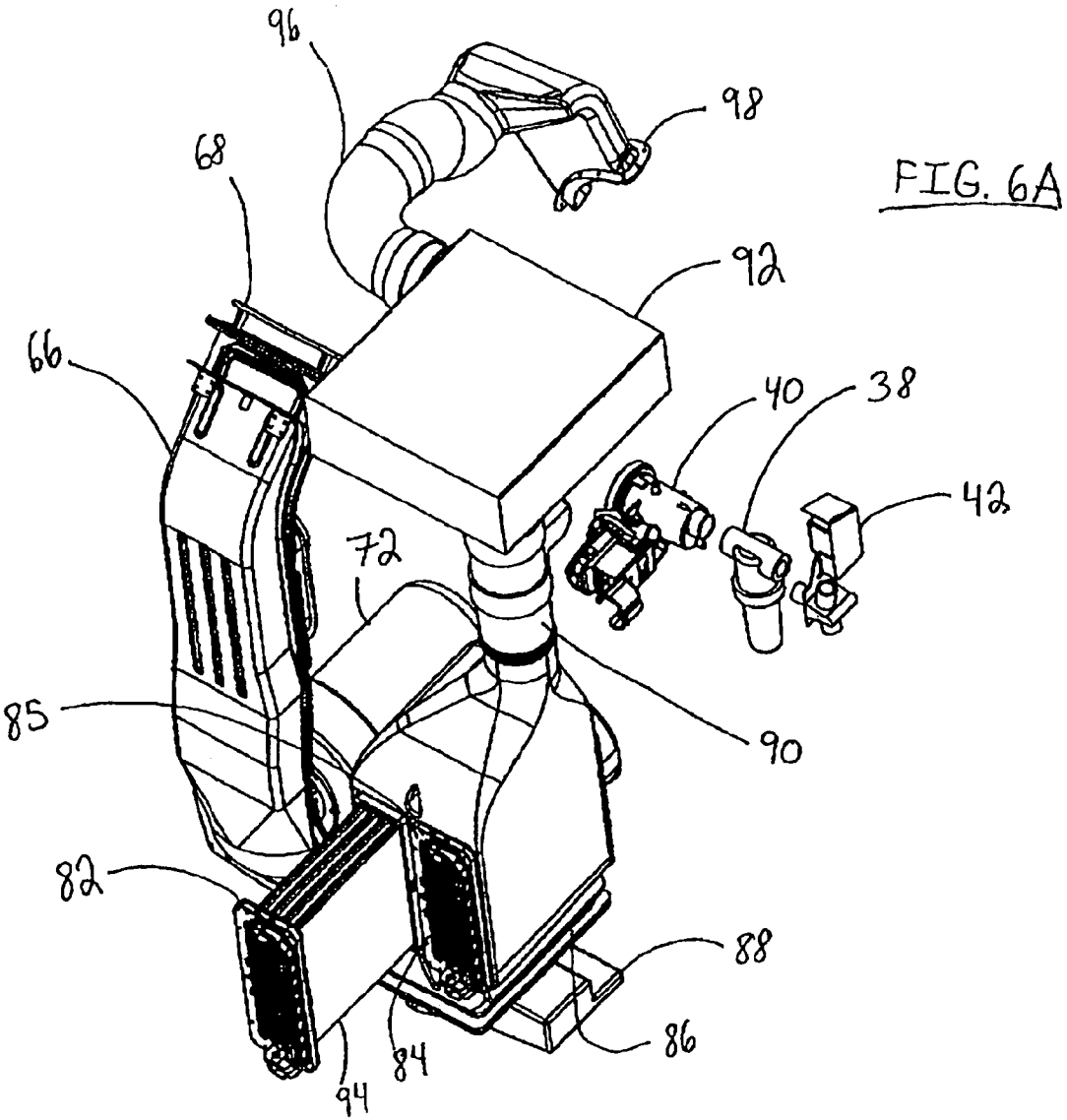
FIG. 6A demonstrates an embodiment of the invention.

FIGS. 5 and 6A show another view of the drying loop. In one embodiment, the flexible conduit 64 is in fluid communication with a lint filter housing 66, which contains a lint filter 68. Large particulates can be captured by the lint filter 68 to avoid the build-up of particulates on the components in the drying loop, such as the blower, the condenser, the heater, etc. The lint filter housing 66 may also include a filter lock 70 that is adapted to lock down the lint filter 68 when the machine 10 is activated to avoid a breach of the closed system. In addition, when the machine is deactivated, the consumer can clean the lint filter 68 as one normally would do in traditional drying machines. The lint filter 68 may also include a gasket at the interface of the lint filer 68 and the wash unit outer housing 13. While shown as one filter, there may be many lint filters in the air flow path to collect as much particulates as possible and these lint filters may be located anywhere along any path or loop or be incorporated into the condenser design. The lint filter housing 66 is in fluid communication with a blower 72. The use of multiple lint filters before the blower 72 would minimize the amount of particulates entering the remaining portion of the drying cycle.

The blower 72 is preferably a sealed blower to control the output slow rate and the output slow temperature so that the air in the drying loop is controlled. The blower may be a fixed rate blower or a variable rate blower. The blower 72 may also be sealed to prevent leakage or contamination of the air to be dried. In addition, the blower may be encased to contain any leakage. The blower 72 is in fluid communication with a condenser system 74 via a condenser conduit 76. Not shown is an optional conduit damper that may be adapted to control the flow rate into the condenser system 74. In this regard, the air flow into the condenser system 74 can be modulated by using the damper or by altering the blow rate of the blower 72 or both.

Figure 6B:
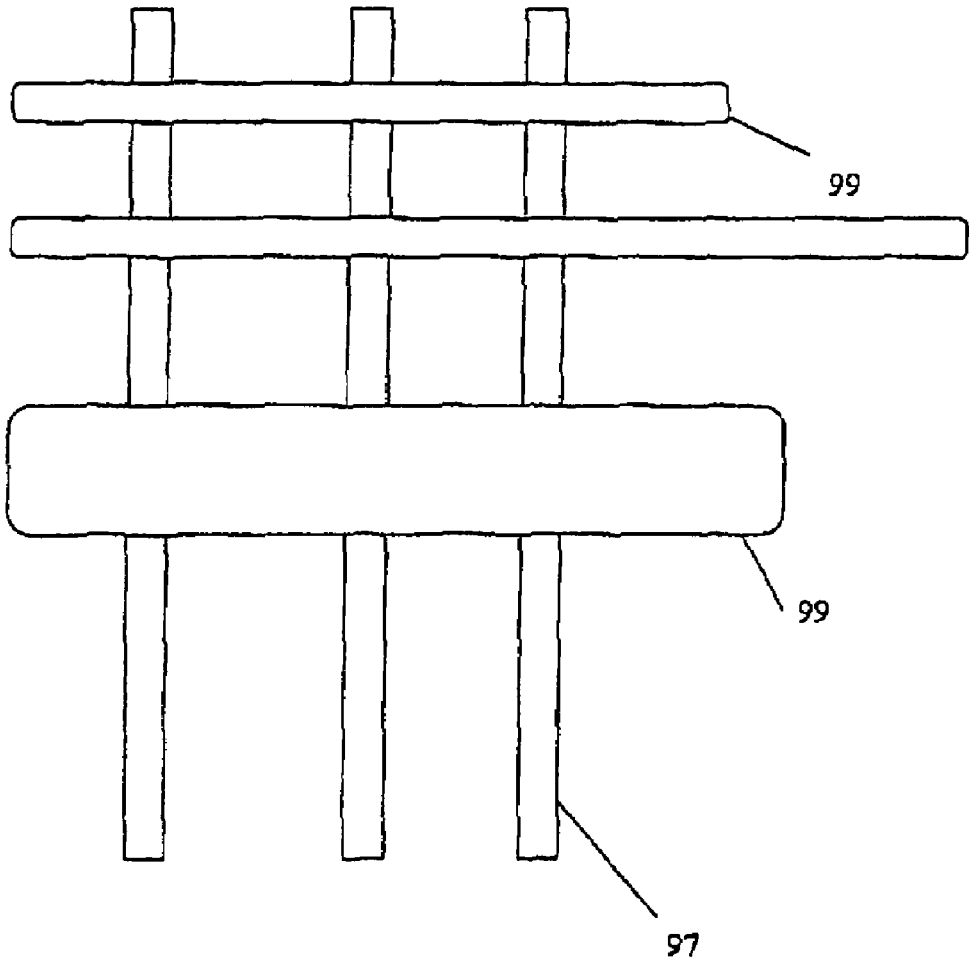
FIG. 6B demonstrates an embodiment of the invention.

FIGS. 5, 6A, and 6B show an illustrative condenser system 74. In FIG. 5, shown is a condenser fan 78 that blows air onto one or more condenser units 80. FIGS. 6A and 6B show an illustrative view of the condenser units 80, in particular showing a first condenser unit 82 and a second condenser unit 84 inside the condenser body 85. FIGS. 5 and 6A also show a condenser pan 86 generally located at the bottom of the body 85. In this regard, air is blown from the blower 72 into the condenser system 74 and is passed over the condenser units 80. In one embodiment, the air inflow may be passed over a diffuser to diffuse the air over the condenser units 80. In another embodiment, the body 85 is divided into two or more chambers by at least one septum. Accordingly, air is blown from the blower 72 into the system 74, passes into the body 85, and thereby passes over the first condenser unit 82. Condensation occurs and the condensate drips down into the pan 86. Meanwhile, the air is routed, optionally via a molded piece or a baffle, from the first chamber into a second one and over the second condenser unit 84. Condensation from the second condenser unit 82 drips down into the condenser pan 86. The condensate in the drip pan 86 is routed to a condenser sump 88. The condenser sump can be separate from or integral to the wash chamber sump (not shown). The air that passes the second condenser unit 84 is routed via a heater conduit 90 that ultimately connects to a heater 92. The condenser units 80 may be consumer accessible and may be adapted to be accessed once the machine 10 is deactivated. FIG. 6A shows a condenser unit 82 partially removed from the condenser body 85.

Although shown in FIG. 6A as a vertical condenser unit 82, 84, the condenser units may be angled relative to the air flow. In this regard, the individual plates 94 of the unit are in maximum contact with the air flow. In addition, as condensation forms on the plates, the condensation may form droplets that further increase the surface area in contact with the air flow. This stimulates further condensation. In addition, as the droplet size increases beyond the point where the droplet can remain static on the plate 94, it will drip down into the pan. The stream of liquid caused by the droplet movement also increases the surface area exposed to the air flow and thereby stimulates further condensation.

Figure 11:
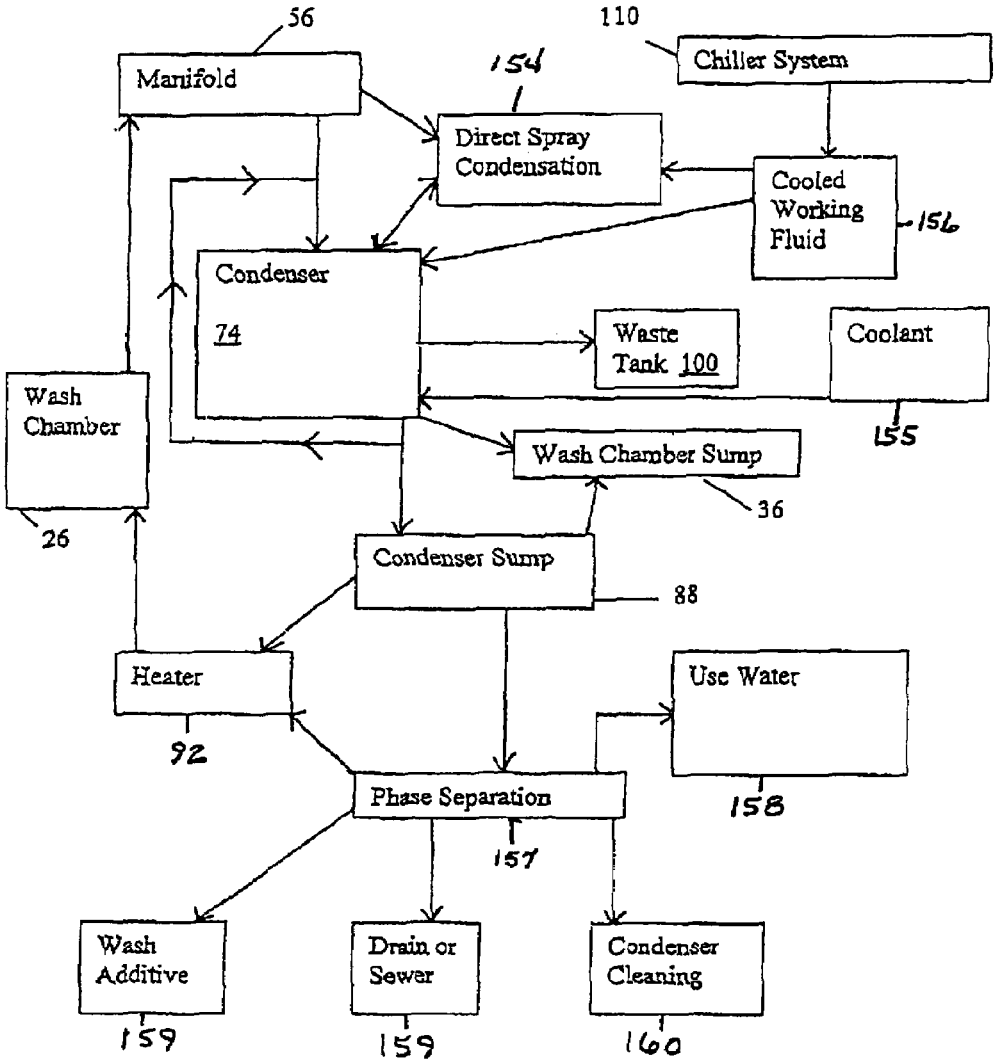
FIG. 11 demonstrates an embodiment of the invention.

In addition, the condenser system 74 may also be provided with a direct-spray condensation method that utilizes a direct contact condensation phase change mode. "Cold" working fluid (that is, working fluid that is at a temperature less than the temperature of the air flow) may be sprayed into the air flow stream. As the sprayed fluid impacts the vapor in the air flow stream, the sprayed fluid absorbs some of the vapor's latent heat causing some of the vapor to condense into a liquid. This condensate will also fall into the condenser pan 86. This cold working fluid may be obtained from the chiller process described in the reclamation loop, as shown in FIG. 11.

Although mentioned in the context of the condenser system 74, this direct contact condensation method may also be used as air enters the manifold 56. A sprayer may spray cold working fluid into the air flow stream causing the vapor to condense in the manifold 56. Cold working fluid may be routed from the reclamation unit after the working fluid has been chilled (see FIG. 11). The condensate will drip down into the lower portion of the manifold 56. A conduit (not shown) may be in fluid communication with the condenser pan 86 thereby routing manifold derived condensate to the pan 86 or to the condenser sump 88. Alternatively, the condensate may be routed to the sump 36. In another embodiment, direct contact condensers may be used at either the manifold 56, at the condenser system 74 as described above, or both. One advantage of using a manifold direct contact condensation method is that particulates can be trapped by the condensate, shunted to any pan or any sump, and later filtered. In this regard, the amount of particulates that enter the lint filter 68 and the subsequent drying loop is reduced.

An alternate condensation system includes a condenser system similar to a radiator condensation system. For example, in the reclamation unit (see FIG. 11), chilled coolant is produced. This chilled coolant can be shunted into a condenser coil in the condenser body 85. As such, air that enters the system 74 passes over the condenser coils carrying the coolant and thus causes condensation on the coils. The condensation accumulates in the condenser pan 78. The coolant is recirculated back to the coolant compressor system in the reclamation unit. In yet another embodiment, the condenser units 82, 84 may be used in conjunction with the coolant compressor system of the reclamation unit. In yet another embodiment, during the reclamation process, working fluid that has been cooled via the chiller (see FIG. 11) can be routed into the radiator condensation system just described. In any condensation system, water may be used as a coolant in tubing or for direct contact condensation.

In any embodiment where condensation is occurring, the condenser can be used as a lint collector as condensation forming on the units will attract lint and condensation droplets dropping will impact lint. Accordingly, an embodiment of the invention resides in using a condensation system to minimize the amount of lint in an air flow.

In yet another embodiment, in the condenser system, the working fluid, water, and some residual adjuvants, may condense in the first pass. As these components have different phases, the working fluid may have a different phase than water. As such, the water (and residual adjuvants for that matter) can be captured and returned to the reclamation unit. The water can be captured via gravimetric separation or membrane separation or can be collected in an absorption bed and re-used as needed in another cycle or later in the same cycle.

To ensure that air flow is maximized in the condenser system, in an alternate embodiment, the blower 72 may blow air into the condenser system 74 from the bottom of the condenser body 85. A diffuser may be used at the bottom of the condenser body 85 to break up the air flow and diffuse the air over the condenser units 82, 84 (or the radiator tubing as described above). The condenser fan 78 may also be large enough to blow air over the entire surface area of the condenser units 82, 84. That is, a diffuser may be used to diffuse the incoming air over the condenser units 82, 84, or over the condensing radiator coils.

Another alternate condensation system includes a spinning disk system. The description and drawings can be found in DE19615823C2, hereby incorporated by reference. In addition to water as a cooling media, IWF from the storage tank can be placed over the spinning disc and this can be accomplished at room temperature but also at a below room temperature via the chiller/compressor. Any other cooling technology may be utilized.

FIG. 6B shows another alternate condensation system of a fin-tube arrangement. In this arrangement, condenser tubes 99 pass through a plurality of fins 97. On each fin, there are a plurality of condenser tubes. The fins may be spaced very close to each other. As coolant travels through the condenser tubes, it cools part of the fin. Because many tubes are attached to a fin, the net effect is that the fin cools. In addition, the fin may be shaped to create an airflow change across the width or length of the fin. This change exposes more air to the fin for a longer period of time. Accordingly, as the air flow passes, it contacts the condenser tubes and starts a condensation process along the tubes. In addition, the air flow contacts the vertical fins and starts a condensation process along the fin. As such, condensation forms along the tubes and the fins. This greatly enhances the condensation efficiency, and hence the drying efficiency. Thus, a great deal of condensation is removed in the first pass. In those embodiments where a mini-recondensation loop is formed (that is, a second loop which takes the first pass air flow and recirculates it through the condensing system before being routed to the heater), the condensation system efficiency is greatly enhanced before that vapor is routed to the heater to be warmed up.

Another alternate condensation system includes a bubble condensation system. A bubble condensation system works on the principle that the airflow or vapor stream passes through one or more perforated conduits, such as an air diffuser. The vapor stream escapes from these perforations, in a bubble fashion, into a chilled condensation bath. The chilled condensation bath may comprise a bath of the working fluid. In this regard, the vapor stream is bubbled into the condensation bath of the chilled working fluid. The chilled working fluid cools the vapor stream, thereby condensing it into a liquid. The contents of the condensation bath may then be directed to the reclamation unit for reclamation. An advantage of using a bubble condensation system is that the condenser fan 78 is eliminated. Only the blower 72 need be used. In another embodiment, the condensation can take place in the storage tank. The chilled working fluid may be obtained from the chiller system of the reclamation unit. Another advantage is that the condensation bath acts as a particulate and lint filter such that upon condensation, the particulates are trapped in the condensation bath. Because of the various boiling points of the chemicals in the airflow, the condensation bath may be adapted to capture various chemicals as they condense out. For example, water may be captured separately from the working fluid. Various beds, such as a zeolite bed or silica bed, may be used to capture the water. Accordingly, an embodiment of the invention resides in blowing an airflow through a bubble forming mechanism to bubble the airflow into a chilled condensation bath.

Alternative condensing technologies include, but are not limited to thermoelectric coolers, peltier elements, thermo-acoustic and membrane technologies. Membranes, more specifically, cross-flow membranes, will generate a pressure drop across the membrane material that will act as a driving force to condense the IWF from the air.

Similarly, in any condensation modality described herein, controlling the condensation may control chemical separation. As mentioned, various chemical absorbing beds may be used to select out chemicals. In addition, temperature may be altered in the condensation system to control condensation rates. Because various chemicals have differing densities or miscibility quotients, liquid layer separation techniques, such as skimming, siphoning, or gravimetric methods may be used.

When using a condenser sump 88, the contents of the condenser sump 88 or the condensation bath may take several routes. Contents may be routed directly into the reclamation unit by a conduit. On the other hand, the contents may be routed to the wash unit recirculation system previously described. For example, contents may be routed to the wash chamber sump 36, to a position before or after the filter 38, to a position before or after the recirculation pump 40, to a position before or after the recirculation valve 42, or to an area between the wash chamber 26 and the basket 34. In this regard, routing the contents to the wash unit recirculation system permits the use of the existing plumbing. It is advantageous to avoid introducing the contents directly into the basket 34 so as to avoid wetting the fabrics that are intended to be dried. Notwithstanding, the contents may be selectively introduced back into the basket 34 (either directly or through the dispenser system) so that the fabrics are not over-dried and that the desired amount of fabric humidity is maintained.

In addition, the condensation may be selectively routed to the reclamation unit or the wash unit recirculation system. For example, the initial drying airflow may contain residues from the wash cycle. Accordingly, upon condensation, this residue containing liquid may be routed to the reclamation unit for processing. As the drying cycle progresses, the amount of residue decreases and thus the condensation contents may be routed to the wash unit recirculation system until it is selectively reclaimed.

As with any sump, tank, container, dispenser described herein, a fill sensor, such as a float sensor may be used to monitor the volume of the item so that a pump can be activated to pump out the volume and avoid overflowing or spillage. Similarly, fill sensors may be used to activate or deactivate the recirculation process, drying, or the reclamation loops.

Returning now to FIGS. 5 and 6A, a heater conduit 90 is shown in communication with a heater 92. In this embodiment, the heater 92 heats the air so that hotter air is returned to the fabric load to be dried. To optimize the heat transfer from the heating units within the heater 92 to the air flow, the heater conduit 90 may be in a position away from the wash chamber conduit 96 (which may be insulated), which connects to the wash chamber inlet 98. The chamber inlet 98 may be located in the boot 28. In this embodiment, the heater conduit 90 is in an opposite corner than the wash chamber conduit 96 such that the air flow entering the heater 92 is heated optimally before exiting the heater 92 into the wash chamber conduit 96. To further optimize heat transfer, the heater 92 may contain various baffles, mazes, walls, deflectors, etc. that are configured to steer the air flow into a long path while inside the heater 92. Optimization may occur by increasing the number of heater elements within the heater 92, increasing the time spent by the air in the heater, and/or increasing the flow distance that the air travels in the heater. For example, if resistance wire thermocouple type heating is being used, then the number of thermocouples may be increased accordingly. In addition, to optimize heating, various circuits may be used with various controllers to control the heat application in various sectors of the heater. The heater 92 itself may be designed to create optimized air flow, such as being conical, football, or triangular shaped so as to steer the air to the wash chamber conduit 96 during heating.

In one embodiment, the condenser conduit 76 enters the condenser system 74 from the bottom and provides a substantially straight path through the condenser system 76 to the heater conduit 90 and a substantially straight path to the heater 92. In this regard, flow losses are significantly reduced and flow rates can be better controlled.

In addition, although shown in FIGS. 5 and 6 as one wash chamber conduit 96, there may be several outlets from the heater into the same conduit 96. Furthermore, there may be one conduit 96 splitting into multiple wash chamber inlets 98. In effect, it may be desirable to have multiple inlets into the wash chamber so that hot airflow may be maximized and that excellent drying achieved.

In one embodiment, a heater capable of maintaining about 70° C. may be used. A heater that is capable of doing so is a 3300 W, 240 V, 15 Amp heater. The heater ought to be designed as to keep the air hot but not so hot as to approach the flash point of the residual vapor in the air flow. Accordingly, an embodiment of the invention resides in a heater that is adapted to maintain a temperature that is less than the flash point of a working fluid. Preferably, the heater is adapted to maintain a temperature that does not exceed a maximum temperature of within 30° F. below the flash point temperature of selected working fluid used during the operation of the wash cycle of the cleaning machine. Any heater may be insulated to assist in heat retention. In addition, the heater can be located near the wash chamber inlet 98 as to minimize the heat loss in the wash chamber conduit 96. The heater 92 may also be located above the condenser system 74 to avoid any liquid condensate from entering the heater. Accordingly, an embodiment of the invention resides in a heater that is at a location higher than a condenser system 74. Furthermore, the heater control may be designed as to increase the heating capacity if the initial fabric load was a wet load. (Commonly, the fabric load is generally dry prior to washing. A wet load, such as rain soaked clothing or wet towels, starts off wet.) Accordingly, the machine 10 may sense that the initial fabric load is a wet load or the consumer may initiate the wash cycle and select a wet load start cycle. This auto-detection or consumer selection may control the heating cycle at a later time. The heater 92 may also include a sensor to measure the humidity of the air flow.

The heater 92 may also include a working fluid sensor to sense the presence of any working fluid. If the sensor detects very little to no residual working fluid, the heating control may step up the heating to achieve a reduced drying time cycle. For example, the heating may increase to above 70° C. An additional feature that may be incorporated in the heater is a sensor to measure the concentration of IWF present inside the heater. If a critical concentration is exceeded, the shut-off procedure will be activated.

Although not shown, the drying cycle may include a means to add drying adjuvants. Some potential adjuvants that may be added to improve the drying process include, but are not limited to heating the IWF prior to extraction via a sump heater, heating the air during the extraction step, alcohol or other solvents that have any affinity for water and the IWF, additives that decrease the viscosity of the IWF, anionic or cationic surfactants added during the rinse or during the extraction to further facilitate the decrease in interfacial tension and the subsequent improvement in the extraction rate, a lower pressure in the system to facilitate increased temperatures and increased vapor removal, an increase in an inert gas such as nitrogen in the environment which can be accomplished via a gas purge or a membrane that selectively removes oxygen from the environment thus increasing the temperature allowed in the drum as well as the removal rate of vapor and/or a perfume to deodorize or mask any odors.

The drying cycle also may take into consideration the tub assembly characteristics. For example, to effectively and efficiently dry fabrics, the air flow ought to travel through the fabrics to the rear section 32. It is undesirable to have a constant patterned air flow through the basket if that air flow pattern does not pass through a substantial portion of the fabrics. To this end, it is desirable to change the air flow in the basket so that hot air will pass through the fabrics. Accordingly, the tub assembly may include a drive motor that is adapted to change the speed of the basket rotation, change the direction of the basket rotation, and a means to create a partial low pressure area at the rear section 32. In this last regard, the air flow travels from the high pressure area by the wash chamber inlet 98 across the gradient to the low pressure area at the rear section 32. Various flappers or baffles may be used to change the air flow pattern. These flappers or baffles may be molded into the basket or may be retractable. In addition because some baskets are tilted towards the back, a baffle may be added to the rear section of the basket that pushes fabrics away from the back to avoid clumping at the rear section. Other modes to change the air flow pattern include varying the perforation openings, closing some perforations during the drying cycle, or the like.

C. Reclamation of Fluids and Waste Disposal

Figure 7:
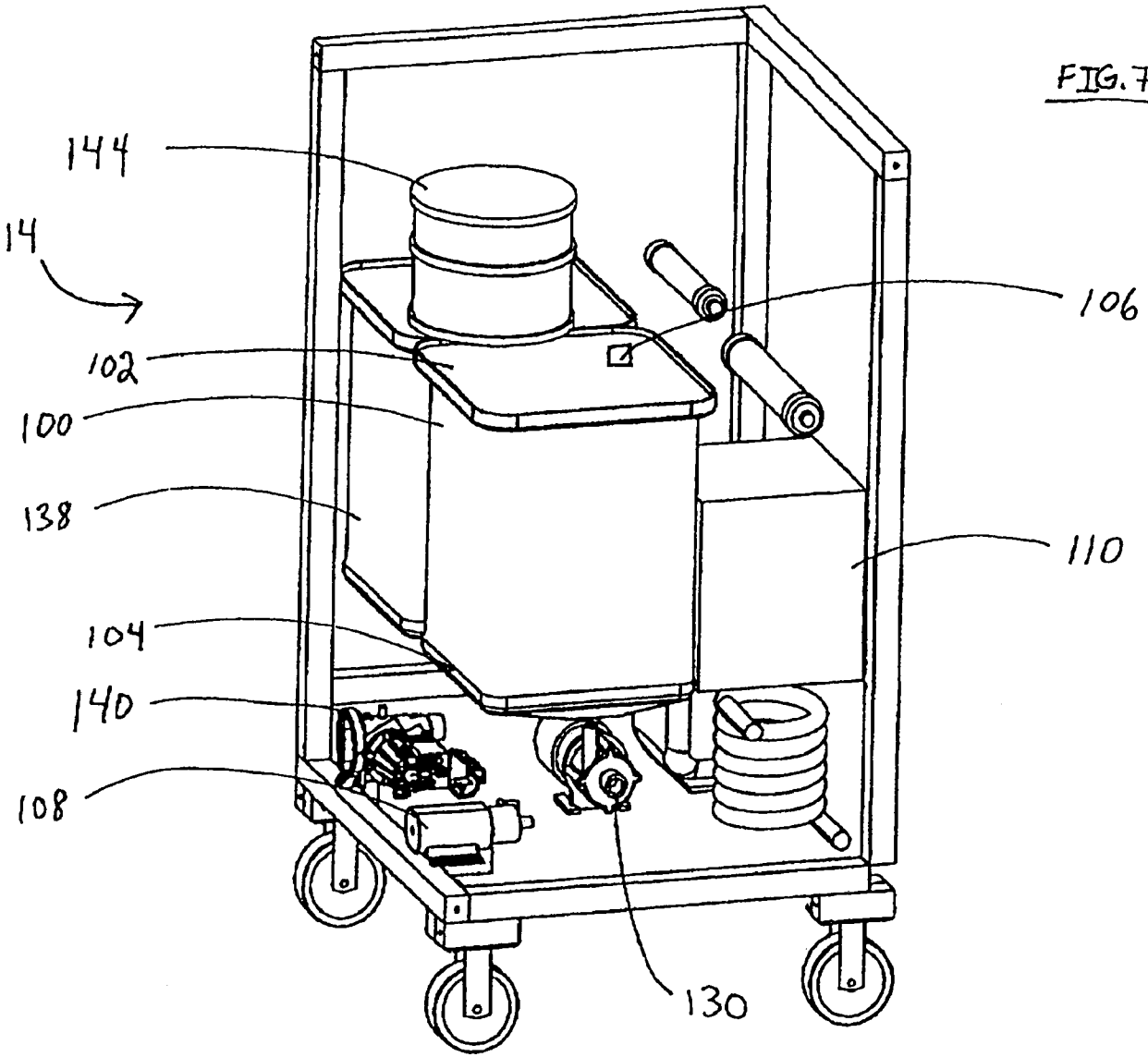
FIG. 7 demonstrates an embodiment of the invention.

FIG. 7 demonstrates an embodiment of the reclamation unit 14 with the reclamation unit outer housing removed. Fluid returned from the wash unit 12 is preferably routed to an optional waste tank 100. The optional waste tank 100 includes a waste tank top surface 102, a waste tank bottom area 104, and a waste tank outlet (not shown). The waste tank 100 comprises a material compatible with the working fluid used. The tank is preferably clear or semi-opaque so that the fluid level of the tank can be readily determined. In addition, the tank may also include internal or external fluid level indicators, such as graduated markings. The tank volume may be greater than the sum total volume of working fluid plus any adjuvants used such that the entire fluid volume of the machine can be adequately stored in the waste tank. The waste tank bottom area 104 may be shaped as to direct the waste tank contents towards the waste tank outlet (not shown). In one embodiment, the waste tank outlet is generally located at the bottom of the waste tank so that gravity assists the fluid transport through the waste tank outlet. The waste tank may also include a pressure relief valve 106 to relieve accumulated pressures in the tank.

With regard to tank construction, if the tank is not uniformly molded, then any seals ought to be tight and resistant to wear, dissolution, leaching, etc. The inside walls of the tank can be microtextured to be very smooth, without substantial surface defects, so that waste fluid entering the tank is easily flowed to the tank bottom. In addition, the inside wall should be easily cleanable. To this end, the tank may include a series of scrapers that periodically scrape the side walls and bottom to ensure that little or no waste sticks to the walls and the bottom and that such waste is channeled to the tank outlet. The scrapers may be controlled via programming. Although not shown, the tank outlet may also include a removable particulate filter. Additionally, the tank may include a layer of insulation material that helps sustain the desired temperatures for each systems' heating/cooling mechanisms either within or surrounding the tanks.

The tank outlet is in fluid communication with a high pressure pump 108, which pumps the waste tank contents into a chiller 110, which further cools the waste tank contents. The chiller preferably resides in an insulated box to maintain a cooler environment.

Figure 8:
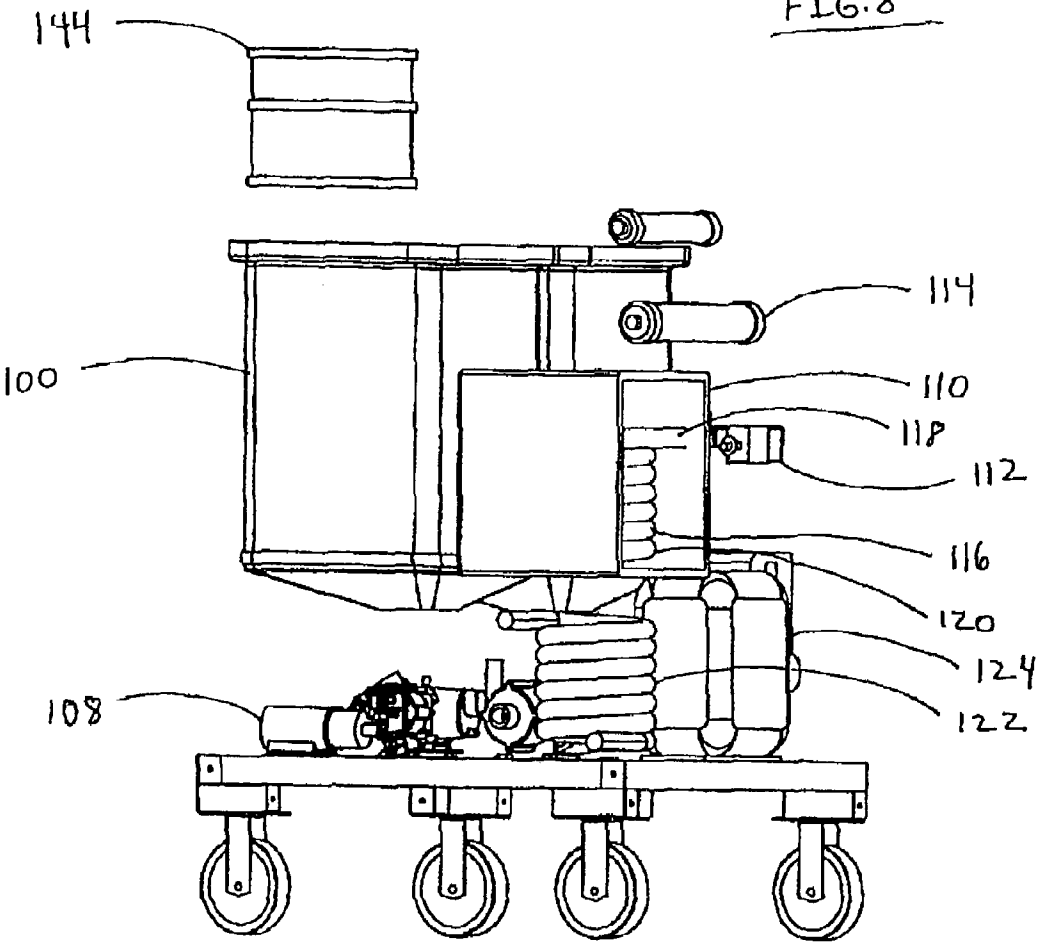
FIG. 8 demonstrates an embodiment of the invention.

FIG. 8 demonstrates a partial back end view of the reclamation unit. The cooled waste tank contents are then pumped from the chiller to a chiller multiway valve 112. Between the chiller and the multiway valve 112 is a temperature sensor (not shown). The default position of the valve shunts the cooled waste tank contents back into the waste tank 100. Thus, cooled waste tank contents are returned to the waste tank 100. The waste tank 100 may also include a temperature sensor to measure the temperature of the waste tank contents. When the desired temperature is achieved, for example, less than 0° C., the multiway valve 112 may shunt the cooled waste tank contents into a cross flow membrane 114. A less than 0° C. temperature is desirable as water will freeze and thus not permeate in the cross flow membrane.

FIG. 8 also shows the chiller 110 with the back panel removed to show the chiller contents. The chiller 110 may comprise a chilling coil 116 that has an coil inlet (not shown) and a coil outlet 118. The chilling coil 116 may include an outer cover 120 such that the chilling coil 116 and the outer cover 120 form a coaxial arrangement. Disposed between the coil 116 and the outer cover 120 is a coolant. Accordingly, the coolant being carried by the outer cover 120 chills waste tank contents flowing through the coil 116. The coolant is circulated into the chiller 110 via a compressor system, which includes a coolant coil 122 and a coolant compressor 124. Thus, the compressor 124 cools the coolant in the coolant coil 122. This cooled coolant is then pumped into the coaxial space between the outer cover 120 and the chilling coil 116, such that the waste tank contents are ultimately cooled. This default loop continues for as long as necessary.

It is also understood that other cooling technologies may be used to cool the waste tank contents as desired. For example, instead of having water cool the compressor system, an air-cooled heat exchanger similar to a radiator can be used. Alternatively, the IWF may be cooled by moving water through cooling coils, or by thermoelectric devices heaters, expansion valves, cooling towers, or thermo-acoustic devices to cool the waste tank contents.

In addition, as mentioned earlier, and in reference to FIG. 11, because this cooled coolant is being generated, it may be used for the condensation system in the wash unit 12. As such, various multiway valves may be used to shunt coolant to the wash unit 12, for example, for use as a coolant in radiator-type tubing. Moreover, as mentioned above, cooled working fluid 156 may be used to assist in condensation in the direct condensation methods described above. Accordingly, the multiway valve may shunt cooled working fluid to the wash unit to assist in condensation.

Figure 9:
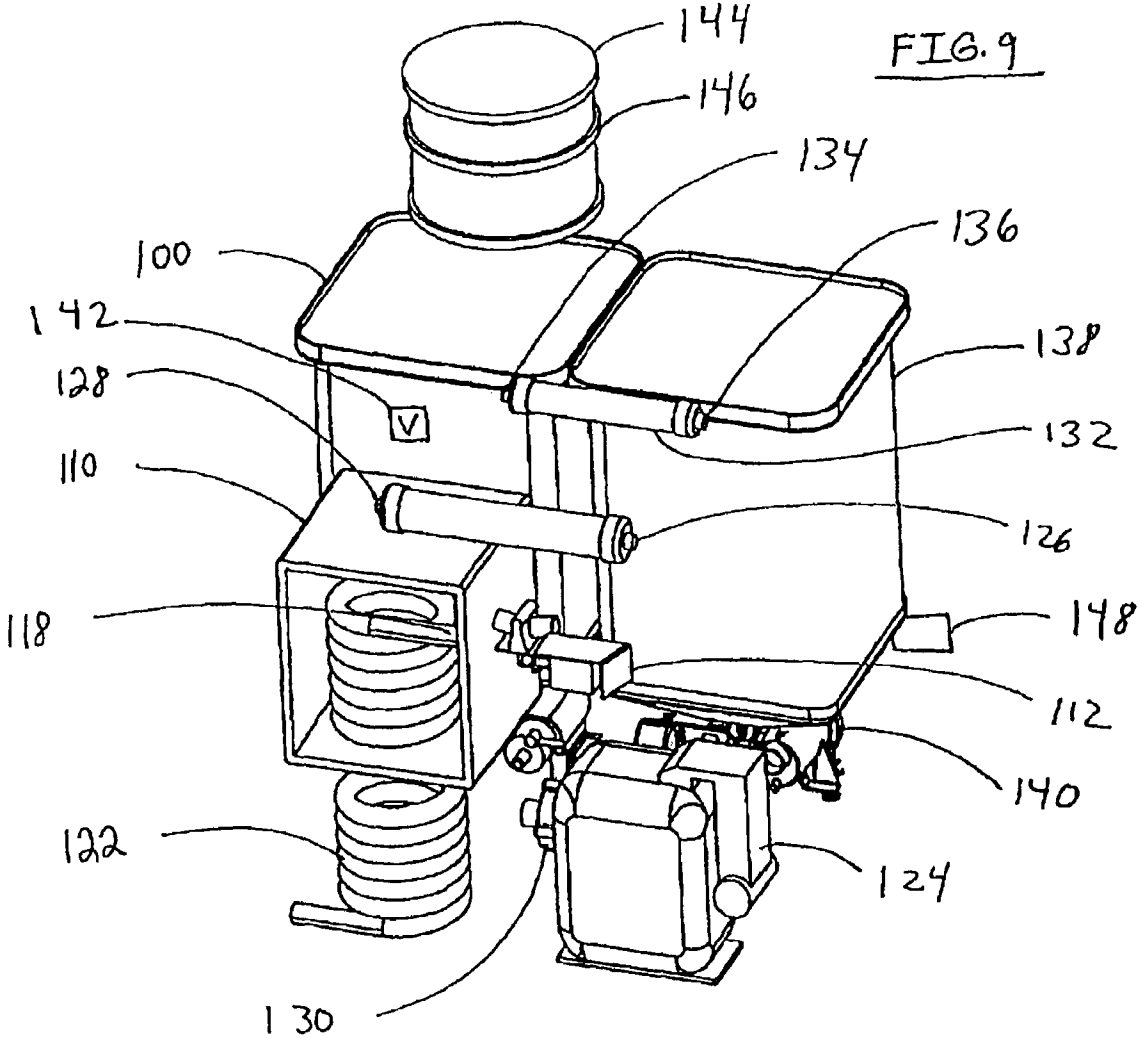
FIG. 9 demonstrates an embodiment of the invention.

FIGS. 8 and 9 demonstrate the waste tank content flow. As mentioned above, once the desired temperature is achieved, the multiway valve 112 shunts the flow to the cross flow membrane 114. In an alternate embodiment, a recirculation loop may be set up such that the waste tank contents are recirculated through the chiller 110, as opposed to being routed back into the waste tank 100. In this regard, the chiller multiway valve 112 may have an additional shunt that shunts the contents back into the path between the high pressure pump 108 and the chiller 110. Once the desired temperature is achieved, the multiway valve 112 shunts the flow to the cross flow membrane 114. The cross flow membrane 114 has a proximal end 126 and a distal end 128. As waste tank contents are pumped into the proximal end 126, filtration begins and a permeate and a concentrate waste are formed 169.

The permeate flows down to the bottom of the cross flow membrane and exits the membrane 114 and enters a permeate pump 130. This permeate pump 130 pumps the permeate into a permeate filter 132, such as a carbon bed filter. The permeate enters the permeate filter 132 via the permeate filter proximal end 134, travels across the filter media, and exits via the permeate filter distal end 136. The permeate filter is selected for its ability to filter out organic residues, such as odors, fatty acids, dyes, petroleum based products, or the like that are miscible enough with the bulk solvent to pass through the cross flow membrane. Such filters may include activated carbon, alumina, silica gel, diatomaceous earth, aluminosilicates, polyamide resin, hydrogels, zeolites, polystyrene, polyethylene, divinyl benzene and/or molecular sieves. In any embodiment, the permeate may pass over or through several permeate filters, either sequentially or non-sequentially. In addition, the permeate filter may be one or more stacked layers of filter media. Accordingly, the flow may pass through one or more sequential filters and/or one or more stacked and/or unstacked filters. The preferred geometry for liquid and vapor removal for activated carbon is spherical and cylindrical. These systems may have a density between 0.25 to 0.75 g/cm$^3$ with preferred ranges of 0.40 to 0.70 g/cm$^3$. Surface areas may range from 50 to 2500 m$^2$/g with a preferred range of 250 to 1250 m$^2$/g. The particle size may range from 0.05 to 500 μm with a preferred range of 0.1 to 100 μm. A preferred pressure drop across the packed bed would range from 0.05 to $1.0\times10^6$ Pa with a preferred range of 0.1 to 1000 Pa. A porosity may range from 0.1 to 0.95 with a preferred range from 0.2 to 0.6.

For silica beds, the following characteristics may be present. The preferred geometry for liquid and vapor removal is spherical and cylindrical. These systems may have a density from 0.25 to 0.95 g/cm$^3$ with a preferred range from 0.60 to 0.85 g/cm$^3$; a particle size range of 0.0005 to 0.010 m with a preferred range of 0.001 to 0.005 m; a preferred pressure drop across the packed bed between 0.05 to $1.0\times10^6$ Pa with a preferred range of 0.1 to 1000 Pa; and a porosity ranging from 0.1 to 0.95 with a preferred range from 0.2 to 0.6.

After the permeate is filtered, the permeate is routed into the clean tank 138, where the permeate, which is now substantially purified working fluid, is stored. The purified working fluid should be greater than 90% free from contaminants with a preferred range of 95% to 99%. As desired, the working fluid is pumped from the clean tank 138 via a fill pump 140 to the wash unit 12.

The cross flow membrane 114 is also selected for its ability to filter out the working fluid as a permeate. Cross flow membranes may be polymer based or ceramic based. The membrane 114 is also selected for its ability to filter out particulates or other large molecular entities. The utility of a cross flow membrane, if polymer based, is a function of, inter alia, the number of hollow fibers in the unit, the channel height (e.g., the diameter of the fiber if cylindrical), length of the fiber, and the pore size of the fiber. Accordingly, it is desirable that the number of fibers is sufficient to generate enough flow through the membrane without significant back up or clogging at the proximal end. The channel height is selected for its ability to permit particulates to pass without significant back up or clogging at the proximal end. The pore size is selected to ensure that the working fluid passes out as permeate without significant other materials passing through as permeate. Accordingly, a preferred membrane would be one that would remove all particulate matter, separate micelles, separate water and other hydrophilic materials, separate hydrophobic materials that are outside the solubility region of the working fluid, and remove bacteria or other microbes. Nano-filtration is a preferred method to remove bacteria and viruses.

Ceramic membranes offer high permeate fluxes, resistance to most solvents, and are relatively rigid structures, which permits easier cleaning. Polymer based membranes offer cost effectiveness, disposability, and relatively easier cleaning. Polymer based membranes may comprise polysulfone, polyethersulfone, and/or methyl esters, or any mixture thereof. Pore sizes for membranes may range from 0.005 to 1.0 micron, with a preferred range of 0.01 to 0.2 microns. Flux ranges for membranes may range from 0.5 to 250 kg/hour of working fluid with a preferred minimum flux of 30 kg/hour (or about 10-5000 kg/m$^2$). Fiber lumen size or channel height may range from 0.05 to 0.5 mm so that particulates may pass through. The dimension of the machine determines the membrane length. For example, the membrane may be long enough that it fits across a diagonal. A length may, preferably, be between 5 to 75 cm, and more preferably 10 to 30 cm. The membrane surface area may be between 10 to 2000 cm$^2$, with 250 to 1500 cm$^2$ and 300 to 750 cm$^2$ being preferred.

The preferred membrane fiber size is dependent upon the molecular weight cutoff for the items that need to be separated. As mentioned earlier, the preferred fiber would be one that would remove all particulate matter, separate micelles, separate water and other hydrophilic materials, separate hydrophobic materials that are outside the solubility region of the working fluid, and remove bacteria or other microbes. The hydrophobic materials are primarily body soils that are mixtures of fatty acids. Some of the smaller chain fatty acids ($C_{12}$ and $C_{13}$) have lower molecular weights (200 or below) while some fatty acids exceed 500 for a molecular weight. A preferred surfactant for these systems are silicone surfactants having an average molecular size from 500-20000.

For example, in siloxane based working fluid machines, the fiber should be able to pass molecular weights less than 1000, more preferably less than 500 and most preferably less than 400. In addition, the preferred fibers should be hydrophobic in nature, or have a hydrophobic coating to repel water trying to pass. For the contaminants that pass through the fibers, the absorber and/or absorber filters will remove the remaining contaminants. Some preferred hydrophobic coatings are aluminum oxides, silicone nitrate, silicone carbide and zirconium. Accordingly, an embodiment of the invention resides in a cross flow membrane that is adapted to permit a recovery of the working fluid as a permeate.

Returning to FIGS. 8 and 9, the permeate took the path that led to a permeate pump. The concentrate, however, takes another path. The concentrate exits the cross flow membrane distal end 128 and is routed to a concentrate multiway valve 142. In the default position, the concentrate multiway valve 142 shunts the concentrate to the waste tank 100. The concentrate that enters the waste tank 100 is then routed back through the reclamation process described above. Once the concentrate multiway valve is activated, the concentrate is routed to a dead end filter 144.

Because a goal of the concentrate multiway valve 142 is to shunt (by default) to the waste tank 100, the result is that more waste tank contents are filtered and more working fluid is recovered as permeate. Eventually though, it becomes necessary for the multiway valve 142 to shunt the concentrate to the dead end filter. This activation may be triggered by various events. First, the activation may be timed, either in terms of real-time monitoring or by the number of times the reclamation process has occurred. For example, the real time monitoring may control the shunting to occur every hour, day, week, month, etc. For cycle timing, the shunting may occur every $n^{th}$ wash cycle or every $n^{th}$ reclamation cycle (where n>0). In addition, various sensors may be used to control the valve activation. For example, a turbidity sensor may be used to measure how turbid the concentrate is. In addition, a conductivity sensor may be used. One potential application of a conductivity sensor is to measure the water concentration. A viscosity sensor may be used to measure the viscosity. A light transmittance sensor may be used to measure the relative opacity or translucence of the concentrate. Drawing off a fixed volume of concentrate into a loop, measuring the mass, and calculating the density may use a density sensor. A volumetric sensor may be used to measure the amount of working fluid recovered by comparing the volume of working fluid at the beginning of the wash cycle to the volume of working fluid recovered after some of the reclamation process. The comparison would result in an estimate of the amount of working fluid in the concentrate. Finally, the activation may be simply a manual activation as desired. In any sensor use, once reaching a desired threshold, the sensor activates the valve to shunt to the dead end filter 144.

The dead end filter 144 may be a container that includes an internal filter 146. As concentrate enters the dead end filter 144, the concentrate collects on the internal filter 146. Based on the type of filter used, permeate will pass through the filter 146 and be routed to the waste tank 100 or eventually into the clean tank. The concentrate will remain in the dead end filter. To assist in drawing out remaining liquids from the concentrate so that it passes to the waste tank, a vacuum may be created inside to draw out more liquid. In addition, the dead end filter 144 may include a press that presses down on the concentrate to compact the concentrate and to squeeze liquids through the internal filter 146. The dead end filter 144 may also include one or more choppers or scrapers to scrape down the sides of the filter and to chop up the compacted debris. In this regard, in the next operation of the press, the press recompacts the chopped up debris to further draw out the liquids. The dead end filter may be consumer accessible so that the dead end filter may be cleaned, replaced, or the like; and the remaining debris removed. In addition, the dead end filter may be completed without the assistance of a vacuum, in a low temperature evaporation step or an incineration step. Capturing the concentrate/retentate and then passing a low heat stream of air with similar conditions to the drying air over the filter will complete the low temperature evaporation step. The IWF will be removed and then routed to the condenser where it will condense and then be returned to the clean tank.

Another concern that needs to be addressed in the re-use of the filters beds. Some potential means to prevent fouling or to reduce fouling are via chemical addition or cleaning, reducing the temperature and phase changing the water to ice and then catching the ice crystals via a filter mechanism, or coating the membranes with special surfaces to minimize the risk of fouling. A way to regenerate the filters includes but is not limited to the addition of heat, pH, ionic strength, vacuum, mechanical force, electric field and combinations thereof.

D. Sensors

Various sensors may be located along any path, such as the drying, recirculation, wash, or reclamation paths. For example, temperature sensors may be associated with the waste tank 100 to measure the temperature of the waste tank contents; with the chiller 110 to monitor the temperature of the contents and to activate the chiller multiway valve 112; with the clean tank 138 to monitor the temperature of the working fluid; with the coolant compressor-coil system to ensure that the chiller 110 operates efficiently; or anywhere else as desired.

Other sensors may include a single pressure sensor to monitor the pressure at a given point. For example, a single pressure sensor may be associated with the waste tank 100 to ensure that pressure is adequately relieved via the pressure relief valve 106; with the clean tank 138; with the coolant compressor-coil system; with the high pressure pump 108 to ensure that the high pressure pump is operating at a high enough pressure; or as desired anywhere else. In addition, double paired pressure sensors in which one-half of the pair is located on either side of a component, may be used. This arrangement permits a pressure gradient measurement across the component. For example, the double pressure sensor system may be associated with the cross flow membrane 114 to measure if there is a questionable pressure drop across the membrane that may indicate that the membrane is becoming clogged; with the permeate filter 132 to measure a pressure drop that may indicate that the filter is becoming clogged; or anywhere else as desired. Additionally, the present sensors can be used to measure the levels in the tank and/or the drum.

Other sensors may include leak sensors in the pans to sense if leaking occurs, leak sensors to sense for fluid leaks, flow rate sensors or meters to measure the quantity of fluid or quantity of air that has moved past the flow meter point; a weight sensor to estimate the size of a load or the saturation of a load; sensors to indicate when the machine is deactivated so that the consumer may interact with it (e.g., ready to clean lint filter, clean condenser units, clean condenser radiator coils, ready to swap out cartridges, ready to load/unload fabrics, etc.)

Level detection is an important feature that may be used to determine if service needs to be scheduled, when the reclamation cycle is complete, potential leaking of the system, etc. Some potential methods to detect levels in the drum, storage tanks and condensing reservoirs are continuous and point level sensing. One method for continuous level sensing is through pressure, but these sensors need to be robust to the IWF and isolated from the system. Another continuous level sensor is ultrasonic and the material choices are PVDF, ceramic crystals, quartz cyrstals, electrostatic and MEMS. Shaped electromagnetic field (SEF), float sensing, laser deflection and petrotape/chemtape are other continuous level sensing techniques. Potential point level sensing techniques are capacitive, float sensing, conductivity and electric field imaging.

Turbidity is another important sensing feature useful in determining contamination level that could facilitate more detergent dispensing or another cycle through the reclamation system. Turbidity sensors can be placed in the storage tanks or the sump area of the wash system and can be accomplished via conductivity measurements, infrared technology and the combination of level sensor such as SEF and flow measurements.

Flow sensing can be used to determine the amount of fluid in the storage tanks, the drum, and the condenser as a possible means to terminate the drying cycle, the fullness of the filter beds, etc. This can be completed using turbines or positive displacement sensors.

Another useful sensor measurement is humidity for both water vapor and IWF detection. This can be utilized to help determine the presence of a leak, the termination of the drying cycle, if a dehydration step to remove water needs to be completed before an IWF wash. Some technologies that may be useful are non-dispersive infrared, solid state, acoustic wave and metal oxide semiconductors.

Other sensors that are considered within the spirit of the invention include any type of sensor that can detect a physical property of the working fluid within either the wash unit 12 or the reclamation unit 14. Such sensors include those which detect temperature, pressure, humidity, vapor, moisture, oxygen, CO, $CO_2$, electrical conduction, enzyme levels, siloxane vapor, siloxane liquid, HFE vapor, HFE liquid, glycol ether vapor, glycol ether liquid, volume, IWF liquid level, vapor level, turbidity, optical spectrum, ultrasonic, shaped electromagnetic fields (SEF), float sensing, laser deflection, petrotape/chemtape, electric field imaging, capacitance, resistance, pH, non-dispersive infrared, solid state, acoustic wave, oxidation-reduction potential, metal oxide semiconductors, etc.

E. Alternate Heat Use

Figure 10:
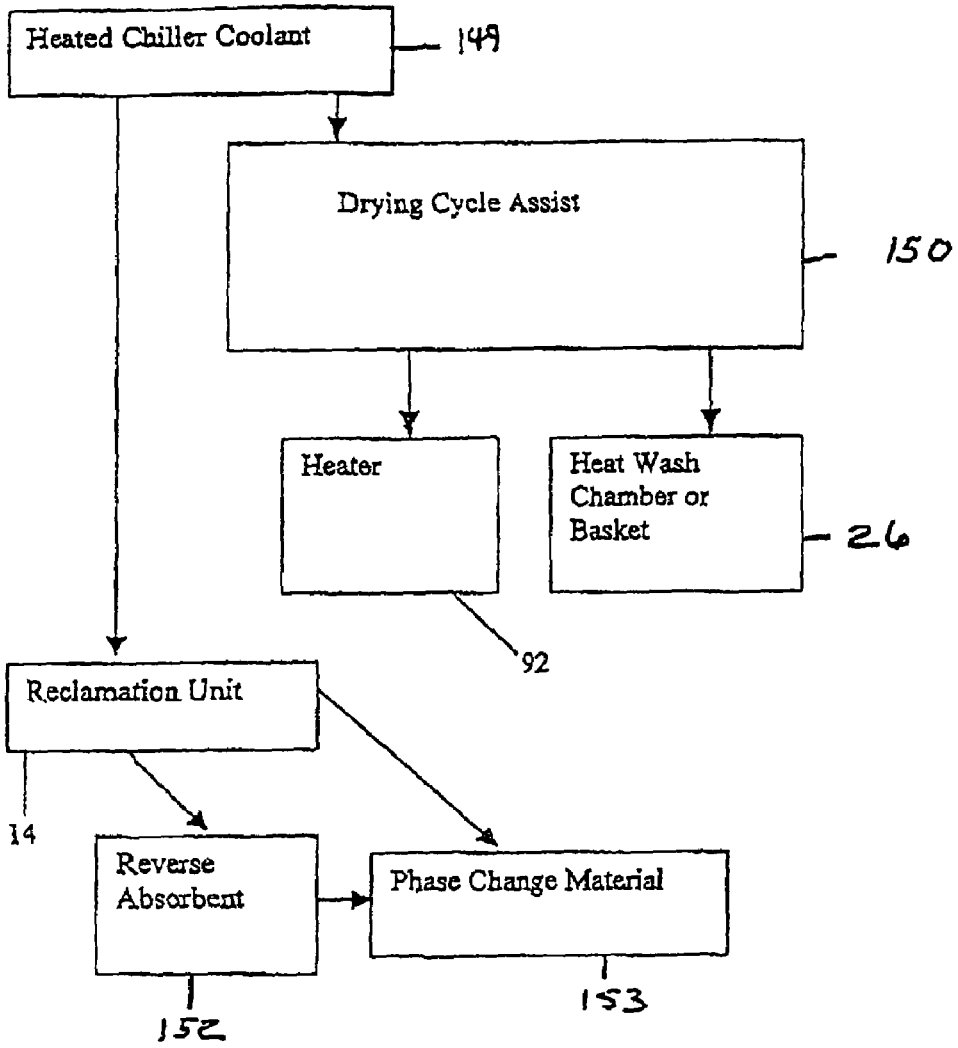
FIG. 10 demonstrates an embodiment of the invention.

FIG. 10 describes an alternate embodiment for utilizing the heat from the chiller system. As shown above, the compressor system includes a series of coolant coils that assist in cooling the waste tank contents. As such, that coolant begins to heat up. The coolant, as the compressor is cooling it, can be shunted to the wash unit for use in the condensation loop, the heated coolant may be used also. Accordingly, heated chiller coolant 149 may be shunted to the drying cycle to assist 150 in drying. The heat in the coolant may be used in the heater 92 to assist in heating the air. That is, it can be used to assist the heater wires. In addition, the heated coolant may be directed to the wash chamber 26 to assist in heating the wash chamber 26 or the basket 34. In this regard, energy savings is achieved because heat generated elsewhere is being used in the drying cycle.

The heated coolant 151 may, however, be used in the reclamation unit 14. In some embodiments, various adsorbent beds may be used to trap various chemicals. The heated coolant may be used to remove the adsorbed 152 chemical from the bed, thereby refreshing the bed. In addition, the heated coolant may be passed through a phase change material 153 for storage. For example, the phase of certain chemicals may be changed by the introduction of the heat. Later when necessary, the phase can be returned to the original phase thereby liberating the heat in an exothermic reaction. In this regard, the heat may be stored until desired.

In some instances, thermal management may be very effective in such a process. The motors turning the drum and operating the pump traditionally give off heat. This heat may be effectively used in heating the non-aqueous fluid for drying, spinning and/or heating the rinse fluid to promote increased cleaning. Additionally, some type of cooling mechanism is a preferred embodiment to the reclamation system and this cooling system can be interspersed throughout the product to provide more energy efficient heating and cooling.

F. Alternate Condensation Loop

FIG. 11 demonstrates an alternate condensation loop 161. In this case, fluid from the manifold 56 may be collected 162 for direct spray condensation 154 as described above. Similarly, fluid collected in the condenser 74 may be used for direct spray condensation. As described above, the chiller system 110 may be used for direct spray condensation either in the manifold 56 or in the condenser 74. Coolant 155 from the chiller system may be used in the condenser system 74. Fluid in the condenser 74 may also be directed to the waste tank 100, such as when the last wash cycle is over. Condenser 74 fluid may be routed to the wash chamber sump for recondensation, especially if phase separation 157 is desired. Similarly, fluid collected in the condenser sump 88 can be rerouted back through the condenser system 74. All heaters in the fluid path are optional, but in FIG. 11, it shows a heater between the condenser sump 88 and the wash chamber 26. Also shown is that the condenser sump 88 may be used for phase separation. The various phases, whether water 158, working fluid, adjuvants, etc., may be used elsewhere or recovered. Optionally, the water may be used to send to the drain 159 and/or used for condenser cleaning 160.

G. Alternate Recirculation Loop

Figure 12:
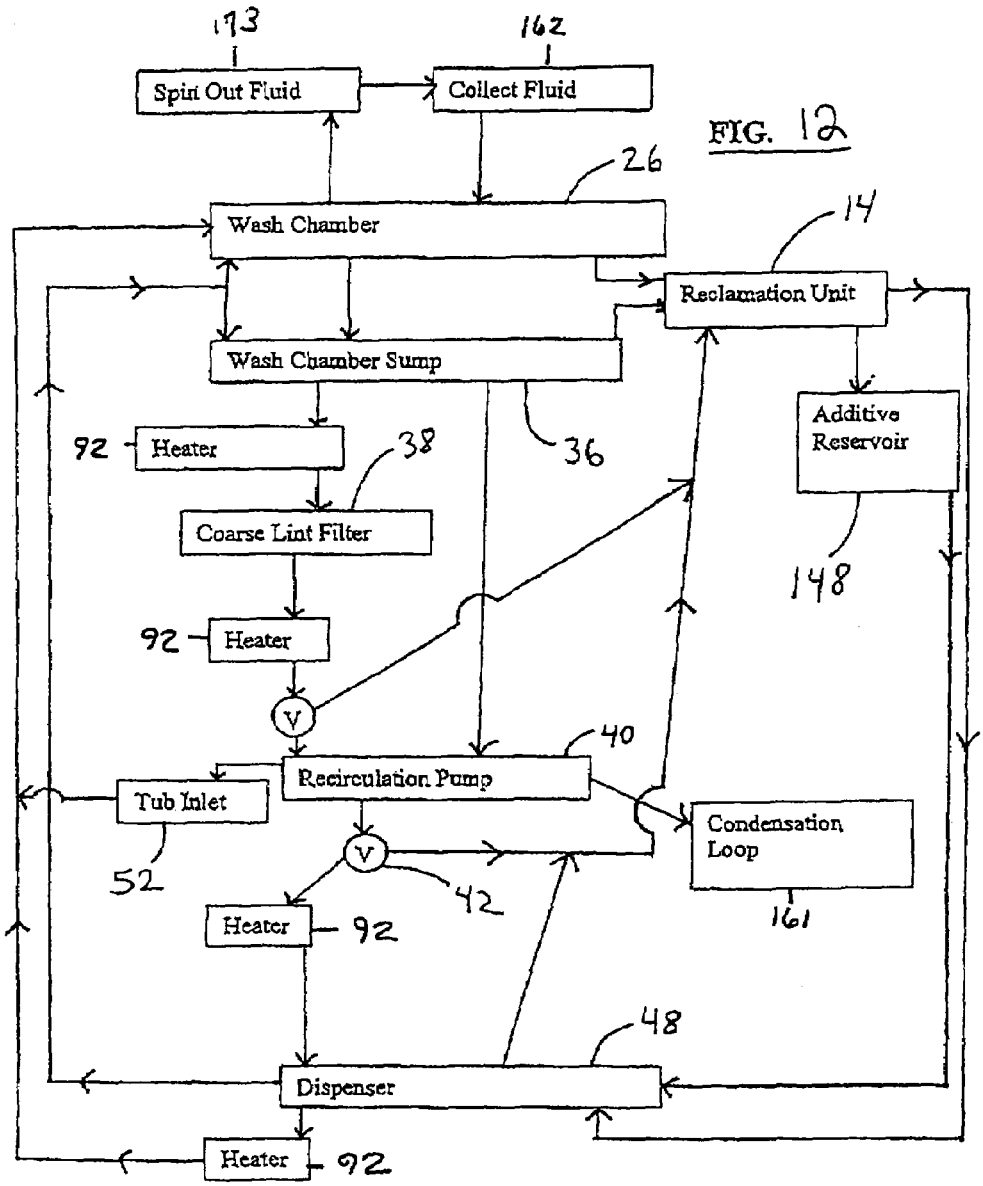
FIG. 12 demonstrates an embodiment of the invention.

FIG. 12 shows an alternate recirculation loop. Various pathways exist if the intent is to heat the fluid, although any heater shown is optional. Valves may exist to direct the fluid to the reclamation unit 14 from the wash chamber 26, the wash chamber sump 36, after the coarse lint filter 36, or after the recirculation pump 40. Similarly, a path may exist from the recirculation pump 40 to the tub inlet 52 directly, thereby bypassing the dispenser 48. In another path, fluid may travel from the dispenser 48 to the wash chamber 26 via a heater (e.g., to heat the dispenser additions).

Although the dispenser may be routed to the wash chamber sump 36, so that any addition added to the fluid from the dispenser is not added to the fabrics in the wash chamber 26, but that is routed to the sump, for example, to be used in the reclamation unit 14. In other words, an adjuvant intended for use in the reclamation unit may be added to the recirculation loop but by-passing the wash chamber. Similarly, the dispenser may have a separate conduit to the reclamation unit 14. In addition, the reclamation unit 14 may have conduits to the dispenser via an additive reservoir 148 (which may be in the reclamation unit 14 or in the wash unit 12) so that adjuvants may be added. Reclamation unit fluids may be routed into the dispenser 48, for example, cleaned working fluid for cleaner rinsing. Accordingly, the dispenser may dispense additions that are washing specific, reclamation unit specific or both.

Figure 13:
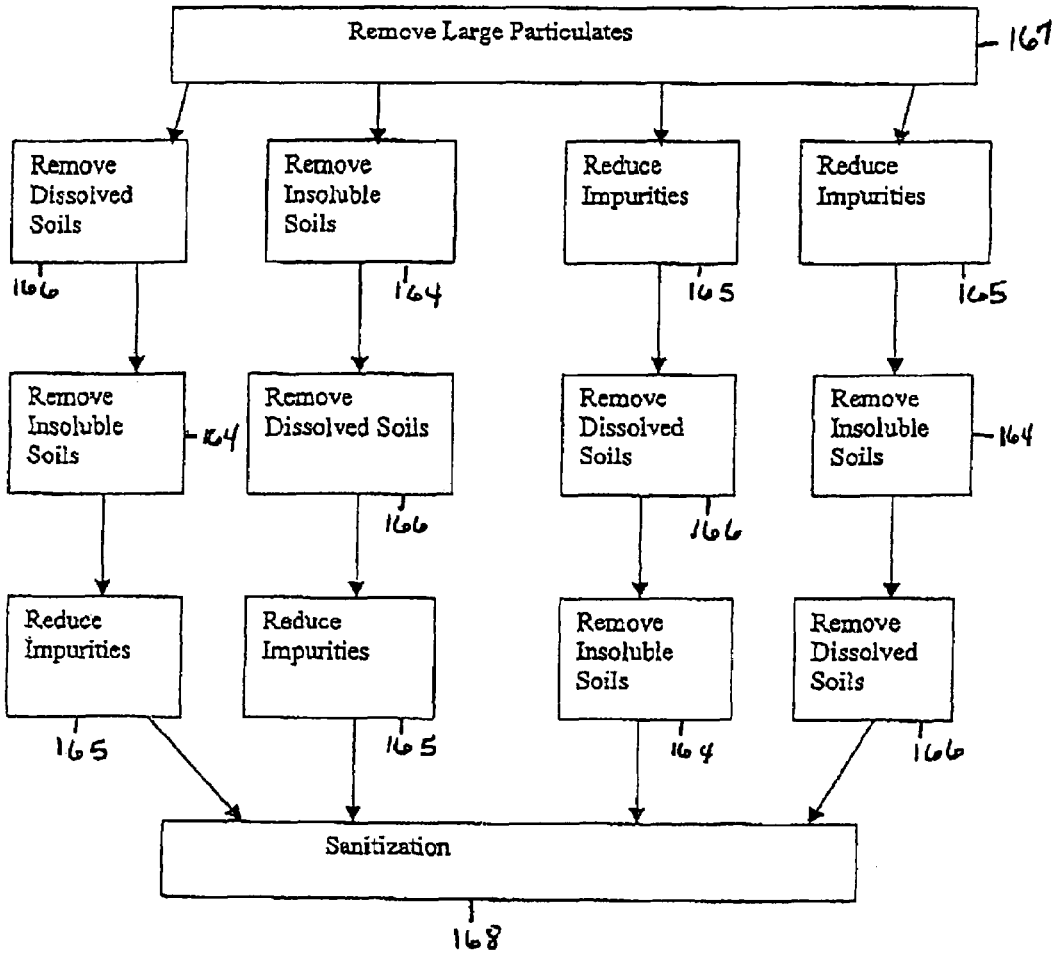
FIG. 13 demonstrates an embodiment of the invention.
Figure 14:
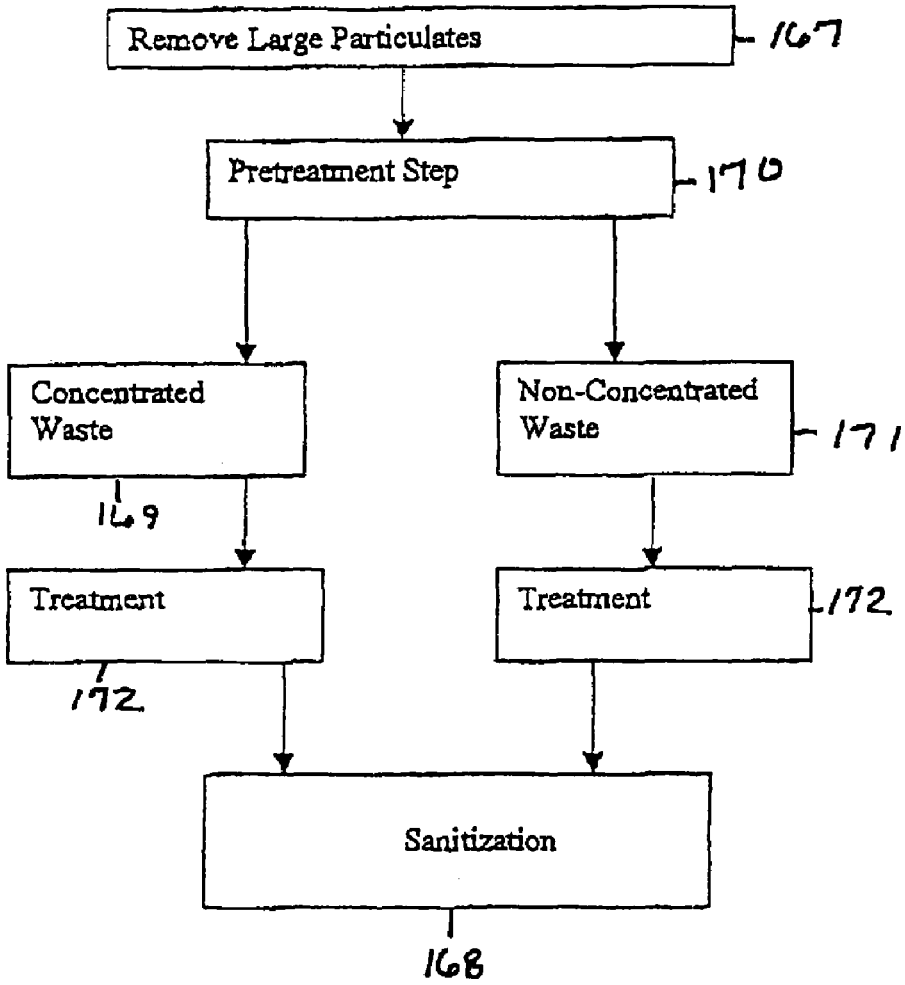
FIG. 14 demonstrates an embodiment of the invention.

FIGS. 13 and 14 show other embodiments of the invention generally related to reclamation. Although not shown, any loop or path may be re-looped so that it is repeated. In addition, it should be recognized that any step may be combined with another step or omitted entirely. That is, each step is optional, may be combined, or its order changed. FIG. 13 shows that one of the initial steps in the reclamation process is to remove large particulates 167. As mentioned herein, any mode of large particulate removal is contemplated, including using the coarse lint filter, filtration, and other separation techniques. Large particulates can be buttons, lint, paper clips, etc., such as those having a size of greater than 50 microns. Small particulates may be less than 50 microns. A method of particulate removal may include a dehydration step in the wash chamber by heating the fabrics so that any residual water is removed. By doing so, the electrostatic bond between the dirt and fabric is broken, thereby liberating the dirt. This dirt can then be recovered. Other methods of particulate removal includes vortex separation and chemical digestion.

Dissolved soils include those items that are dissolved in the working fluid, such as oils, surfactants, detergents, etc. Mechanical and chemical methods, or both may remove dissolved soils 166. Mechanical removal includes the use of filters or membranes, such as nano-filtration, ultra-filtration and microfiltration, and/or cross flow membranes. Pervaporation may also be used. Pervaporation is a process in which a liquid stream containing two or more components is placed in contact with one side of a non-porous polymeric membrane while a vacuum or gas purge is applied to the other side. The components in the liquid stream sorb into the membrane, permeate through the membrane, and evaporate into the vapor phase (hence the word pervaporate). The vapor, referred to as "the permeate," is then condensed. Due to different species in the feed mixture having different affinities for the membrane and different diffusion rates through the membrane, a component at low concentration in the feed can be highly enriched in the permeate. Further, the permeate composition may widely differ from that of the vapor evolved after a free vapor-liquid equilibrium process. Concentration factors range from the single digits to over 1,000, depending on the compounds, the membrane, and process conditions.

Chemical separation may include change of state methods, such as temperature reduction (e.g., freeze distillation), temperature increase, pressure increase, flocculation, pH changes, and ion exchange resins.

Other removal methods include: electric coalescence, absorption, adsorption, endothermic reactions and thermo-acoustic cooling techniques.

Insoluble soils 164 may include water, enzymes, hydrophilic soils, salts, etc. Items may be initially insoluble but may become soluble (or vice versa) during the wash and reclamation processes. For example, adding dissolvers, emulsifiers, soaps, pH shifters, flocculants, etc., may change the characteristic of the item. Other methods of insoluble soil removal include filtration, caking/drying, gravimetric, vortex separation, distillation, freeze distillation and the like.

Reducing impurities 165 may include any of the above steps done that are done to reduce, and thereby purify, the working fluid recovery. Reducing impurities may involve the use of multiple separation techniques or separation additives to assist in reclamation. It may also involve the use of a specific separation technique that cannot be done until other components are removed.

In some instances, the surfactants may need to be recovered. A potential means for recovering surfactants is through any of the above-mentioned separation techniques and the use of $CO_2$ and pressure.

H. Sanitization

As used herein, sanitization 168 means the generic principle of attempting to keep the unit relatively clean, sanitary, disinfected, and/or sterile from infectious, pathogenic, pyrogenic, etc. substances. Potentially harmful substances may reside in the unit because of a prior ambient introduction, from the fabrics cleaned, or from any other new substance added. Because of the desire to retrieve clean clothes from the unit after the cycles are over, the amount of contamination remaining in the clothes ought to be minimized. Accordingly, sanitization may occur due to features inherent in the unit, process steps, or sanitizing agents added. General sanitization techniques include glutaraldehyde tanning, formaldehyde tanning at acidic pH, propylene oxide or ethylene oxide treatment, gas plasma sterilization, gamma radiation, electron beam, ultraviolet radiation, peracetic acid sterilization, thermal (heat or cold), chemical (antibiotics, microcides, cations, etc.), and mechanical (acoustic energy, structural disruption, filtration, etc.).

As for inherent features, one method of sanitizing is to manufacture conduits, tanks, pumps, or the like with materials that confer sanitization. For example, these components may be manufactured and coated with various chemicals, such as antibiotics, microcides, biocides, enzymes, detergents, oxidizing agents, etc. Coating technology is readily available from catheter medical device coating technology. As such, as fluids are moving through the component, the fluids are in contact with the inner surfaces of the component and the coatings and thereby achieves contact based sanitization. For tanks, the inner surfaces of tanks may be provided with the same types of coatings thereby providing longer exposure of the coating to the fluid because of the extended storage times. Any coating may also permit elution of a sanitizer into the fluid stream. Drug eluting stent technology may be adapted to permit elution of a sanitizer, e.g., elution. via a parylene coating.

Another inherent feature is to manufacture any surface by micro-texturing the surface. For example, it is known that certain organisms seek to adhere to surfaces and rough surfaces provide areas for adhesion. Accordingly, micro-texturing the surface to become very smooth eliminates any rough area where organisms can adhere.

Components may also exist that specifically provide sanitization. For example, a UV light may be provided anywhere along the washing, drying, or reclamation cycles. One convenient location for the UV light can be at the entrance of the reclamation unit from the wash unit. As such, as fluid enters the reclamation unit from the wash unit, it is exposed to UV light prior to any initial reclamation steps. In addition, other locations may include prior to any filtration, upon exit of a tank, or anywhere where the conduit length is lengthy. Conduits may be made of a clear material wherever necessary to permit UV exposure.

Another component available for sanitization is a filter. The filter may be sized to permit continued progress of a desired permeate but trap undesirable concentrates. For example, filtration can include large size filtration, micro-filtration, ultra-filtration, or the like. As with any embodiment herein using filters, the filters may be sequential with varying filtering capabilities. For example, sequential filters may be used that have decreasing pore sizes. These pore size changing filters may also be stacked. In addition, to facilitate any filtration (e.g., in the wash unit or the reclamation unit), any particle may be subject to additional processing such as chopping, grinding, crushing, pulverizing, sonic pulverization, etc., to reduce the particle size.

In addition, various sanitization additives may be added to assist in periodic cleaning. For example, bleach, oxidizers, enzymes, acids, alkalis, degreasers, ozone, plus the other organism cleaners mentioned above, may be added to the wash chamber and the unit cycled. For example, ozone in a level greater than 1 ppm at less than 20° C. may be used.

FIG. 14 shows yet another reclamation embodiment. In this embodiment, shown is an initial pretreatment step 170, which may include stabilizers, precipitators, flocculants, etc. Then a separation step occurs in which concentrated 169 and non-concentrated 171 waste is created. Each component can then be treated separately depending on the desired treatment 172. There is an optional sanitization step.

I. Service Plan Method

Yet another embodiment of the invention resides in interacting with the apparatus. For example, because the unit can be a closed system, it may be necessary to replace components. Accordingly, an embodiment of the invention resides in inspecting components for usage, determining if the component requires replacement, and replacing the component. For example, filters may become irreversibly clogged in the machine and thus require periodic maintenance or replacement. Because some of the components may require special handling, the service technician may possess special implements to successfully clean and/or replace components. The technician may, for instance, possess special hazardous waste disposal bags to dispose of replaced components. The technician may also possess specialized cleaning implements or diagnostic implements to clean non-replaceable components or to calibrate certain components. In another embodiment, a method involves receiving information about use from the apparatus, analyzing the information to generate diagnostic information, and performing a service in response to the diagnostic information generated. As mentioned earlier, the unit may include a memory storage that stores information about the unit's performance, safety information, status information, or the like. The technician may read the information, perform a diagnostic or treatment, and reset the unit for operation. Similarly, the unit may be provided with a lock down mechanism that locks down the unit by sealing off door and entry points, so that no leakage occurs. In this regard, the technician may be provided with a special code or tool to unlock the machine and reset it for re-use.

J. Working Fluid Description

In an embodiment, the working fluid is a liquid under washing conditions and has a density of greater than 1.0. The working fluid has a surface tension of less than or equal to 35 dynes/cm$^2$. The oil solvency of the working fluid should be greater than water without being oleophilic. Preferably, the working fluid has an oil solvency as measured by KB value of less than or equal to 30. The working fluid also has a solubility in water of less than about 10%. The viscosity of the working fluid is less than the viscosity of water under ordinary washing conditions. The working fluid has a pH of from about 6.0 to about 8.0. Moreover, the working fluid has a vapor pressure higher than the vapor pressure of water and has a flash point of greater than or equal to 145° C. The working fluid is substantially non-reactive under washing conditions with fabrics in the fabric load, with the adjuvants present in the at least one washing adjuvant and with oily soils and water soluble soils in the fabric load.

In another embodiment, the working fluid may include a surface tension less than 25 dynes/cm$^2$, a vapor pressure less than 150 [Pa], and a KB value less than 20.

The working fluid is substantially non-swelling to natural fabrics present in the fabric load. In an embodiment, the working fluid is a fluorine-containing compound selected from the group consisting of: perfluorocarbons, hydrofluoroethers, fluorinated hydrocarbons, and fluoroinerts.

Working fluids that are acceptable as non-aqueous working fluids as mentioned above include but are not limited to terpenes, halohydrocarbons, glycol ethers, polyols, ethers, esters of glycol ethers, esters of fatty acids and other long chain carboxylic acids, fatty alcohols and other long chain alcohols, short-chain alcohols, polar aprotic solvents, siloxanes, hydrofluoroethers, dibasic esters, aliphatic hydrocarbons, carbon dioxide, ionic liquids and/or combinations thereof. Even more preferably, the working fluid is further selected from decamethylcyclopentasiloxane, dodecamethylpentasiloxane, octamethylcyclotetrasiloxane, decamethyltetrasiloxane, dipropylene glycol n-butyl ether (DPnB), dipropylene glycol n-propyl ether (DPnP), dipropylene glycol tertiary-butyl ether (DPtB), propylene glycol n-butyl ether (PnB), propylene glycol n-propyl ether (PnP), tripropylene methyl ether (TPM) and/or combinations thereof. Most preferably, the cleaning machine is capable of using multiple non-aqueous fluids that is user specified for a particular cleaning operation.

In some embodiments, the user will utilize a select rinse fluid to improve drying times. The select rinse fluid (SRF) is chosen based on its property of being miscible with the working fluid and having Hanson solubility parameters (expressed in joules per cubic centimeter) with one of the following criteria: (a) a polarity greater than about 3 and hydrogen bonding less than 9; (b) a hydrogen bonding less than 13 and dispersion from about 14 to about 17; or (c) a hydrogen bonding from about 13 to about 19 and dispersion from about 14 to about 22. More specifically, the SRF will be selected for having the following properties: (a) a viscosity less than the viscosity of the working fluid, (b) a vapor pressure greater than 5 mm Hg at standard conditions, (c) a surface tension less than the surface tension of the working fluid and (d) display non-flammable characteristics. Even more preferably, the SRF is selected from the group consisting of perfluorinated hydrocarbons, decafluoropentane, hydrofluoroethers, methoxynonafluorobutane, ethoxynonafluorobutane, and/or mixtures thereof.

As noted above, one family of chemicals particularly suited for use as IWFs in the methods and apparatuses of the present invention are "fluoroinert" liquids. Fluoroinert liquids have unusual properties that make them particularly useful as IWFs. Specifically, the liquids are clear, colorless, odorless and non-flammable. Fluoroinerts differ from one another primarily in boiling points and pour points. Boiling points range from about 56° C. to about 253° C. The pour points typically range from about 30° C. to about −115° C.

All of the known fluoroinert liquids possess high densities, low viscosities, low pour points and low surface tensions. Specifically, the surface tensions typically range from 12 to 18 dynes/cm$^2$ as compared to 72 dynes/cm$^2$ for water. Fluoroinert liquids typically have a solubility in water ranging from 7 ppm to 13 ppm. The viscosity of fluoroinerts typically ranges from 0.4 centistokes to 50 centistokes. Fluoroinerts also have low KB values. The KB value is used as a measure of solvent power of hydrocarbon solvents. Fluoroinerts have little or no solvency.

In addition to fluoroinerts, hydrofluoroethers, perfluorocarbons and similarly fluorinated hydrocarbons can be used as an IWF in the methods and apparatuses of the present invention. These additional working fluids are suitable due to their low surface tension, low vapor pressure and high fluid density.

Other types of working fluids may also be used. For example, a Class 3-A solvent (a solvent having a flash point between 140 F and 200 F) may be used. In addition, cyclic siloxanes may be used that include: octamethylcyclotetrasiloxane, decamethylcyclopentasiloxane, dodecamethylcyclohexasiloxane, tetradecamethylcycloheptasiloxane, among others.

Other compounds include linear or branched, volatile siloxane solvents, such as those containing a polysiloxane structure that includes from 2 to 20 silicon atoms. Preferably, the linear or branched, volatile siloxanes are relatively volatile materials, having, for example, a boiling of below about 300° C. point at a pressure of 760 millimeters of mercury ("mm Hg").

In a preferred embodiment, the linear or branched, volatile siloxane comprises one or more compounds of the structural formula (I):

$$M_{2+y+2z}D_xT_yQ_z \quad (1)$$

wherein:

M is $R^1{}_3SiO_{1/2}$;

D is $R^2{}_2SiO_{2/2}$;

T is $R^3SiO_{3/2}$;

Q is $SiO_{4/2}$ and wherein $R^1$, $R^2$, and $R^3$ are each independently a monovalent hydrocarbon radical; and x and y are each integers, wherein 0 x, y, z 10.

Suitable monovalent hydrocarbon groups include acyclic hydrocarbon radicals, monovalent alicyclic hydrocarbon radicals, monovalent and aromatic hydrocarbon radicals. Preferred monovalent hydrocarbon radicals are monovalent alkyl radicals, monovalent aryl radicals and monovalent aralkyl radicals.

In an embodiment, the linear or branched, volatile siloxane comprises one or more of, hexamethyldisiloxane, octamethyltrisiloxane, decamethyltetrasiloxane, dodecamethylpentasiloxane, tetradecamethylhexasiloxane or hexadecamethylheptasiloxane or methyltris(trimethylsiloxy)silane. In another embodiment, the linear or branched, volatile siloxane comprises octamethyltrisiloxane, decamethyltetrasiloxane, or dodecamethylpentasiloxane or methyltris(trimethylsiloxy)silane. In another embodiment, the siloxane component of the composition consists essentially of decamethyltetrasiloxane. Mixtures of any working fluid are also contemplated, e.g., any mixture of one or more siloxanes, fluorinated compounds, or a combination of fluorinated compounds plus siloxanes.

I. Adjuvants

One or more washing adjuvants may used in combination with the working fluid to form a wash liquor combination. Such adjuvants include, but are not limited to, builders, surfactants, enzymes, bleach activators, bleach catalysts, bleach boosters, bleaches, alkalinity sources, antibacterial agents, colorants, perfumes, pro-perfumes, finishing aids, lime soap dispersants, composition malodor control agents, odor neutralizers, polymeric dye transfer inhibiting agents, crystal growth inhibitors, photobleaches, heavy metal ion sequestrants, anti-tarnishing agents, anti-microbial agents, anti-oxidants, linkers, anti-redeposition agents, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters, fabric softeners, antistatic agents, dye fixatives, dye abrasion inhibitors, anti-crocking agents, wrinkle reduction agents, wrinkle resistance agents, soil release polymers, soil repellency agents, sunscreen agents, anti-fade agents, and mixtures thereof.

(a) Other Additives—These may include: phase transfer catalysts, alkylboronic acids, silicone-based boronic acids, bleach boronic acids, crown ether, PEOs, potassium hydroxide, magnesium hydroxide, amine salts, APMS; soil stabilizers (e.g., carboxymethyl cellulose, acrylates, methacrylates, colloidal suspensions).

(b) Surfactants. Surfactants suitable for inclusion in the composition, include anionic, cationic, nonionic, Zwitterionic and amphoteric surfactants, alkylbenzene sulfonates, ethoxylated alkyl phenols, ethoxylated fatty alcohols, alkylester alkoxylates, alkyl sulfonates, quaternary ammonium complexes, block propyleneoxide, ethyleneoxide copolymers, sorbitan fatty esters, sorbitan ethoxylates, Tergitols, tridecylalcohol ethoxylates, alkanolamides, sodium lauryl sulfonate, sodium stearate, sodium laureth sulfate, ammonium lauryl ether sulfonate, and silicone surfactants, such as for example, quaternary alkyl ammonium siloxanes, carboxyalkyl siloxanes, and polyether siloxane surfactants. In one embodiment, the surfactant exhibits an hydrophilic-lipophilic balance ("HLB") of from 3 to 14, more preferably 5 to 11, as for example polyether siloxanes. Surfactants are generically known in the art and are available from a number of commercial sources.

Examples of cationic surfactants include: didodecyldimethylammonium bromide (DDAB), dihexadecyldimethyl ammonium chloride, dihexadecyldimethyl ammonium bromide, dioctadecyldimethyl ammonium chloride, dieicosyldimethyl ammonium chloride, didocosyldimethyl ammonium chloride, dicoconutdimethyl ammonium chloride, ditallowdimethyl ammonium bromide (DTAB). Commercially available examples include, but are not limited to: ADOGEN, ARQUAD, TOMAH, VARIQUAT.

Nonionic surfactants which may be employed are octylphenoxypoly(ethyleneoxy) (11)ethanol, nonylphenoxypoly(ethyleneoxy) (13)ethanol, dodecylphenoxypoly(ethyleneoxy) (10)ethanol, polyoxyethylene(12)lauryl alcohol, polyoxyethylene(14)tridecyl alcohol, lauryloxypoly(ethyleneoxy) (10)ethyl methyl ether, undecylthiopoly(ethyleneoxy) (12)ethanol, methoxypoly(oxyethylene(10)/(oxypropylene(20))-2-propanol block co-polymer, nonyloxypoly(propyleneoxy) (4)/(ethyleneoxy) (16)ethanol, dodecyl polyglycoside, polyoxyethylene(9)monolaurate, polyoxyethylene(8)monoundecanoate, polyoxyethylene(20) sorbitan monostearate, polyoxyethylene(18)sorbitol monotallate, sucrose monolaurate, lauryldimethylamine oxide, myristyldimethylamine oxide, lauramidopropyl-N,N-dimethylamine oxide, 1:1 lauric diethanolamide, 1:1 coconut diethanolamide, 1:1 mixed fatty acid diethanolamide, polyoxyethylene(6)lauramide, 1:1 soya diethanolamidopoly(ethyleneoxy)(8)ethanol, and coconut diethanolamide. Other known nonionic surfactants may likewise be used.

A surfactant for HFE systems is Zonyl-UR, in a range of 0.1-2.5% for cleaning and 0.05-15% for emulsification. A surfactant for siloxane systems is: Fabritec 5550, Tegopren 7008, 7009, 6920, Crodofos 810A, Dow Corning 8692, 1248, 5097, 5329, 5200, 5211, FF400, Sylgard 309, SF 1528, 1328. A range of 0.05 to 15% is desirable, with a range of less than 5% for emulsion purposes. For cleaning purposes the range is less than 5%, preferably less than 2%, and more preferably is less than 1.5% up to 5% but preferably less than 2% and even further preferred less than 1.5%.

(c) Perfumes or Deodorizers—Perfumes include: aromatic and aliphatic esters, aliphatic and aromatic alcohols, aliphatic ketones, aromatic ketones, aliphatic lactones, aliphatic aldehydes, aromatic aldehydes, condensation products of aldehydes and amines, saturated alcohols, saturated esters, saturated aromatic ketones, saturated lactones, saturated nitrites, saturated ethers, saturated acetals, saturated phenols, saturated hydrocarbons, aromatic nitromusks and mixtures thereof.

Enduring perfumes include: allyl cyclohexane propionate, ambrettolide, amyl benzoate, amyl cinnamate, amyl cinnamic aldehyde, amyl cinnamic aldehyde dimethyl acetal, iso-amyl salicylate, aurantiol (trade name for hydroxycitronellal-methyl anthranilate), benzophenone, benzyl salicylate, iso-butyl quinoline, beta-caryophyllene, cadinene, cedrol, cedryl acetate, cedryl formate, cinnamyl cinnamate, cyclohexyl salicylate, cyclamen aldehyde, dihydro isojasmonate, diphenyl methane, diphenyl oxide, dodecalactone, iso E super (trade name for 1-(1,2,3,4,5,6,7,8-octahydro-2,3,8,8-tetramethyl-2-naphthalenyl)-ethanone-), ethylene brassylate, ethyl methyl phenyl glycidate, ethyl undecylenate, iso-eugenol, exaltolide (trade name for 15-hydroxypentadecanoic acid, lactone), galaxolide (trade name for 1,3,4,6,7,8-hexahydro-4,6,6,7,8,8-hexamethylcyclopenta-gamma-2-benzopyran), geranyl anthranilate, hexadecanolide, hexenyl salicylate, hexyl cinnamic aldehyde, hexyl salicylate, lilial (trade name for para-tertiary-butyl-alpha-methyl hydrocinnamic aldehyde), linalyl benzoate, 2-methoxy naphthalene, methyl cinnamate, methyl dihydrojasmonate, beta-methyl naphthyl ketone, musk indanone, musk ketone, musk tibetine, myristicin, delta-nonalactone, oxahexadecanolide-10, oxahexadecanolide-11, patchouli alcohol, phantolide (trade name for 5-acetyl-1,1,2,3,3,6-hexamethylindan), phenyl ethyl benzoate, phenylethylphenylacetate, phenyl heptanol, phenyl hexanol, alpha-santalol, thibetolide (trade name for 15-hydroxypentadecanoic acid, lactone), tonalid, delta-undecalactone, gamma-undecalactone, vetiveryl acetate, yara-yara, allyl phenoxy acetate, cinnamic alcohol, cinnamic aldehyde, cinnamyl formate, coumarin, dimethyl benzyl carbinyl acetate, ethyl cinnamate, ethyl vanillin (3-methoxy-4-ethoxy benzaldehyde), eugenol, eugenyl acetate, heliotropine, indol, isoeugenol, koavone, methyl-beta-naphthyl ketone, methyl cinnamate, methyl dihdrojasmonate, beta methyl naphthyl ketone, methyl-n-methyl anthranilate, delta-nonalactone, gamma-nonalactone, para methoxy acetophenone (acetanisole), phenoxy ethyl iso butyrate, phenoxy ethyl propionate, piperonal, triethyl citrate, vanillin, and mixtures thereof.

Deodorizers may include: molecular encapsulation agents (e.g., cyclodextrin), quaternary amines (e.g., Pinesol, etc.), pH adjusters to neutralize odors, or agents that are capable of saturating a double bond or cleaving a double bond. Other odor absorbents may also include, but are not limited to, silica gel, fullers earth, alumina, diatomaceous earth, magnesium silicate, granular activated carbon, molecular sieves, powdered decolorizing charcoal, magnesium sulfate, corn cob powder, zeolites, clays, hydrogel-forming polymers, surfactants, binders and high surface area materials desirably hydrophobic glass micro-fibers, glass wool, cellulose and acetate fibers. Preferably, the adsorbent is granular activated carbon, 4A molecular sieves, or 13X molecular sieves.

(d) Enzymes—Enzymes are incorporated in the formulations herein to enhance and provide superior fabric cleaning, including removal of protein-based, carbohydrate-based, or lipid (triglyceride-based) stains. The enzymes to be incorporated include lipases, proteases and amylases, as well as mixtures thereof. The enzymes may be of any suitable origin, such as vegetable, animal, bacterial, fungal, and yeast origin.

Suitable lipase enzymes for use herein include those produced by microorganisms of the *Pseudomonas* group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum,* e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli.* The LIPOLASE enzyme (Lipolase 100L (9001-62-1), Lipolase 100T (9001-62-1)) derived from *Humicola lanuginosa* and commercially available from Novo is a lipase for use herein.

Suitable protease enzymes are the subtilisins that are obtained from particular strains of *B. subtilis* and *B. licheniforms.* Another suitable protease is obtained from a strain of *Bacillus,* having maximum activity throughout the pH range of 8-12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985). Protease enzymes are usually present in such commercial preparations at levels sufficient to provide from 0.005 to 0.1 Anson units (AU) of activity per gram of composition.

Amylases include, for example, alpha-amylases described in British Patent Specification No. 1,296,839 (Novo), RAPIDASE, International Bio-Synthetics, Inc. and TERMAMYL, Novo Industries.

A wide range of suitable enzymes are also disclosed in U.S. Pat. No. 3,553,139 (McCarty et al.); U.S. Pat. No. 4,101,457 (Place et al); U.S. Pat. No. 4,507,219 (Hughes); and U.S Pat. No. 4,261,868 (Hora et al). Enzymes for use in detergents can be stabilized by various techniques. Enzyme stabilization techniques are disclosed and exemplified in U.S. Pat. No. 3,600,319 (Gedge, et al) and European Patent Application Publication No. 0 199 405, Application No. 86200586.5, published Oct. 29, 1986 (Venegas). Enzyme stabilization systems are also described, for example, in U.S. Pat. No. 3,519,570.

(e) Bleach—Bleaching agents include perborates, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Also useful are sources of available oxygen such as persulfate bleach (e.g., OXONE, manufactured by DuPont). Sodium perborate monohydrate and sodium percarbonate are particularly preferred. Other examples include TAED (hydrophilic), percarbonate(hydrophilic), steel(hydrophilic), dragon(hydrophilic), alkyl-hydroperoxides(hydrophobic), SNOBS, P15, hydroperoxides, titanium dioxide, lucine, peroxysilicones, perborate, and combinations of percarbonate, perborate, BzCl, BOBS, NOBS, LOBS, DOBA, sodium percarbonate, organic peroxides, metal containing bleach catalysts, bleach boosting compounds, performed peracids, photobleaches, enzyme bleaches, cationic imines, zwitterionic imines, anionic imines, polyionic imines & TAED.

(f) Co Solvents—Co-solvents may include: N-methylpyrrolidone (used with HFE), THFA (tetrahydrofurfuryl alcohol), α-terpinene, ethyl lactate ELS, ethyl L-(−)-lactate, 2-ethyl lactate, Vertrel (trans-dichloroethylene, 2-propanol), Vertrel XF (decafluoropentane), Vertrel KCD 9583, Vertrel KCD 9585, Borothene, heptanol, methanol, ethanol, isopropanol, 1-propanol, 1-butanol, 1-pentanol, 1-hexanol, 1-heptanol, 1-octanol, ethylene glycol, propylene glycol, ethylene glycol dimethyl ether, propylene glycol n-propyl ether, propylene glycol n-butyl ether, dipropylene glycol methyl ether, dipropylene glycol propyl ether, dipropylene glycol n-butyl ether, dipropylene glycol t-butyl ether, tripropylene glycol methyl ether, tripropylene glycol n-butyl ether, t-butyl methyl ether, t-amyl mether ether, tetrahydrofuran, tetrahydropyran, diethyl ether, diisopropyl ether, ethyl acetate, propyl acetate, isobutyl acetate, cyclohexyl acetate, methyl propionate, ethyl propionate, 2-methylpentane, 3-methylpentane, 2,2-dimethylbutane, 2,3-dimethylbutane, hexane, heptane, iso-octane, methyl cyclohexane, 2-butanol, i-butanol, t-butanol, trifluoroethanol, pentafluoropropanol, hexafluoro-2-propanol, 1-chlorobutane, 2-chlorobutane, i-butyl chloride, t-butyl chloride, 1,2-dichloropropane, 2,2-dichloropropane, methylene chloride, t-1,2-dichloroethylene, cis-1,2-dichloroethylene, 2,3-dichloro-1-propene, 1,1,2-trichloroethylene(trichloroethylene), 1-bromopropane, 2-bromopropane, acetonitrile, 1-octene, butyl lactate, n-decane, isopar-M, petroleum SA-70, perfluorohexane, fluorinated isopropyl alcohol, undecane, dodecane, c14-c17 cyclosol-150, D-limonene (citrus terpene), 1,2-propanediol, 2-ethoxyethanol, DS-108 solvent (Dynamo solvent), 2-ethyl hexyl lactate, acetone, propylene carbonate, benzyl alcohol, glycerine, 2-ethyl-1-hexanol, diethyl glycol butyl ether, dipropylene glycol butyl ether, propylene glycol butyl ether, ethylene glycol butyl ether, petroleum ether, cyclohexanol, diacetone alcohol, cyclohexane, n-pentane, n-octane, n-nonane, n-tridecane, methyl ethyl ketone, methyl isobutyl ketone, 2-pentanone, 3-methyl-2-butanone, cyclohexanone, trans-dichloroethylene, 1,3-dichloropropane, methylene chloride, perchloroethylene, HCFC-141b, HCFC-225 ca/cb, toluene, m-xylene, trifluorotoluene, parachlorobenzitrifluoride, hexafluoro-m-xylene, hexamethyldisiloxane, octamethyltrisiloxane, water, acetonitrile, petroferm SA-18, Petroferm SA-19, Petroferm SA-24, solventless silicones, DTE 797 oil, Mobilmet Omicron, Silicon fluid F815, Arma 245, Ecocut 322, 10W40 ATF, Soygold, NMP, Triacetin, Dowanol, cyclopentane, nitromethane, ethyl ether, THF, chloroform, 1,1,2-trichloroethane, 1,1,1-trichloroethane, DF-2000, Petroferm Solvating Agent 21, tetradecanoic acid, 1-methylethyl ester, Fluorinert (FC-72), Invert 1000, Invert 2000, Invert 5000, Castrol Kleen 3414, Arcosolv PT-8, and Shell-Sol 142H; or any mixture thereof.

EXAMPLES

| Substance | Purpose | Range |
|---|---|---|
| Water | hydrophilic soil removal | Preferred = 0-5%<br>Acceptable = 0-99.9% |
| Perfluorocarbons (fluorocarbons) | increase flash points | Preferred = 0-20%<br>Acceptable = 0-75% |
| Hydrocarbons | hydrophobic soil removal | Preferred = 0-25%<br>Acceptable = 0-80% |
| Alcohols | drying or rinse aids | Preferred = 0-25%<br>Acceptable = 0-80% |
| Hydrocarbons | fluid reclamation (provide a separation device-liquid—liquid extraction) | Preferred = 0-25%<br>Acceptable = 0-80% |
| Silicone &/or Fluorinated materials | improved fabric care | Preferred = 0-99.995%<br>Acceptable = 75-99.995% |
| Fragrances | improved odor performance | Preferred = 0-5%<br>Acceptable = 0-25% |

(g) Fabric Softeners—Fabric softeners or conditioners useful herein can have linear or branched, saturated or unsaturated hydrophobes and can include certain amines, quaternary amines, or protonated amines, or mixtures thereof. Such materials particularly include diesters of diethanolammonium chlorides, sometimes termed "diester quats"; dialkyl imidazoline esters, diesters of triethanolammonium methylsulfates, ester amide-tertiary amines sometimes termed amidoamineesters, esteramide-quaternary amine chloride salts, and diesters of dihydroxypropyl ammonium chlorides.

J. Some Working Fluid Combinations

Embodiments of invention reside in a combination of one or more types of the working fluid with one or more types of the washing adjuvant. In any embodiment, adjuvants may be added to working fluid to stabilize the working fluid. For example, a mixture of working fluids may be combined to form an azeotrope of the working fluids. Any one or more adjuvants may be added to the azeotropic mixture. The ultimate mixture or combination may be contacted with fabrics to be cleaned. Dry laundering with any composition may occur by exposing the composition (or its individual constituents) to the fabrics and moving the composition through the fabrics to be cleaned. As with any embodiment the composition, including its constituents whether initially present or subsequently added, may be recovered and/or reclaimed. The recovered constituents may be processed, such as cleaned for re-use.

Other examples of a composition are now more fully described. In one embodiment, there is a wash liquor composition for use in laundering a fabric load comprising: (a) a non-reactive, non-aqueous, non-oleophilic, apolar working fluid, and (b) at least one non-aqueous, fluid washing adjuvant selected from the group consisting of a surfactant, bleach, ozone, hydrophobic solvent, hydrophilic solvent, and mixtures thereof. In another embodiment, a wash liquor composition to assist in washing fabrics in a fabric washing machine, comprises: (a) a non-oleophilic working fluid adapted to be substantially non-reactive with the fabrics, the working fluid having a KB value of less than or equal to 30; and (b) at least one washing adjuvant selected from the group consisting of a surfactant, bleach, ozone, hydrophobic solvent, hydrophilic solvent, and mixtures thereof. And yet another embodiment is a wash liquor composition to assist in washing fabrics in a fabric washing machine, comprising: (a) at least one washing adjuvant selected from the group consisting of a surfactant, bleach, ozone, hydrophobic solvent, hydrophilic solvent, and mixtures thereof; (b) a working fluid adapted to be substantially non-reactive with the fabrics, the working fluid having a KB value of less than 30, a surface tension less than or equal to 20 dynes per square centimeter, and a vapor pressure less than 150 mm Hg. And yet another embodiment is a wash liquor composition to assist in washing fabrics in a fabric washing machine, comprising: (a) a working fluid adapted to be substantially non-reactive with the fabrics; (b) at least one washing adjuvant selected from the group consisting of a surfactant, bleach, ozone, hydrophobic solvent, hydrophilic solvent, and mixtures thereof; (c) wherein the working fluid has a surface tension of less than or equal to 35 dynes/$cm^2$; (d) wherein the working fluid has an oil solvency greater than water without being oleophilic, and the KB is less than or equal to 30; (e) wherein the working fluid has a solubility in water of less than about 10%; (f) wherein the working fluid has a viscosity less than water under normal washing conditions; (g) wherein the working fluid has a pH from about 6.0 to about 8.0; (h) wherein the working fluid has a vapor pressure higher that the vapor pressure of water; and (i) wherein the working fluid has a flash point of greater than or equal to 145° C.

The composition may also be associated with the machine, such as a wash liquor composition and laundering machine combination for use in laundering a fabric load, comprising: (a) a non-reactive, non-aqueous, non-oleophilic, apolar working fluid; (b) at least one washing adjuvant; and (c) a laundering machine. The composition may also be associated with the fabrics, such as a wash liquor composition and fabric combination for use in laundering a fabric load comprising: (a) a non-reactive, non-aqueous working fluid; (b) at least one washing adjuvant; and (c) at least one article of article of fabric interspersed with the working fluid and the at least one washing adjuvant.

In yet another embodiment, the composition may be used in laundering, such as a method of using a wash liquor composition in a laundering machine, comprising the step of adding the wash liquor combination to a fabric to clean the fabric, the wash liquor combination comprising: (a) a non-aqueous, non-oleophilic working fluid; and (b) at least one washing selected from the group consisting of a surfactant, bleach, ozone, hydrophobic solvent, hydrophilic solvent, and mixtures thereof.

As mentioned above, the composition and its constituents may be substantially or entirely recovered by a method such as, a recovered non reactive, non-oleophilic, non-aqueous working fluid made by the process of: (a) washing at least one fabric with an initial working fluid; (b) capturing at least part of the initial working fluid after washing the at least one fabric; (c) filtering the captured working fluid to generate a permeate and a retentate; (d) recovering the permeate or retentate as the recovered working fluid.

Although mentioned in greater detail above, the composition may also include a co-solvent selected from the group consisting of water, alcohol, ether, glycol, ester, ketone, and aldehyde, and wherein the mixture is sufficiently stable for a fabric washing application. Similarly, although any adjuvant described above may be used singularly or in combination with any other adjuvant, the combination may include an adjuvant that is at least one of a surfactant, bleach, enzyme, deodorizer, fragrance, hydrophobic solvent, hydrophilic solvent, and mixtures thereof and the co-solvent is selected from the group consisting of water, alcohol, ether, glycol, ester, ketone, and aldehyde, and wherein the mixture is sufficiently stable for a fabric washing application.

Another embodiment of a wash liquor combination includes a working fluid, a soda ash to increase the pH, a chelation agent (e.g., disodium EDTA), a water softener (e.g., sodium citrate), a bleach (e.g., percarbonate), an initiator for radical formation (e.g., tetraacetoethylene diamine), an enzyme (e.g., protease, lipase, amylase, cellulase), an anti-deposition agent (e.g., sodium carboxymethylcellulose or polyacrylic acid), a surfactant, an odor control, and a brightener (e.g., CBSX).

K. Safety, Service, and Other Features

As mentioned above, various sensors may be used to monitor temperature, pressure, volume, conductivity, turbidity, etc. In addition to sensors, the materials may be designed to withstand chemicals or make the material chemical compatible. For example, any tank or conduit can be made siloxane resistant or HFE resistant. This may include forming any conduit, gasket, seal, valve, etc. to be resistant.

Due to the fact that most home care systems are concerned with aqueous systems, there are some special considerations that need to be given for materials compatibility. Some examples of acceptable housing materials for silicone-based fluids are ABS. Acetal, Acrylic, Chlorinated Polyvinyl Choride, Epoxy, Ionomer, Nylon, Polytertrafluoroethylene (Teflon), Polyvinylidene Fluoride, Polycarbonate, Polyethermide, Polyethylene, Polyethylene Terephthalate, Polypropylene, Polystyrene, Polysulfone and Polyvinyl Choride (PVC), Fluorosilicone, Polydimethylsiloxane, Ethylene-Propylene Terpolymer (EPDM), Isobutylene-Isoprene (Butyl) and Acrylonitrile-Butadiene (Buna N), Aluminum, Anodized Aluminum, Beryllium, Brass, 60 Sn/40 Pb Solder and Stainless Steel and Copper. Additionally, many polymers based materials contain plasticizers in order to manipulate physical properties and provide a cost effective process. However, the IWF may remove the plasticizers destroying the physical properties, therefore, relatively pure polymer-based systems should be used.

It should be understood that the foregoing relates only to a limited number of embodiments that have been provided for illustration purposes only. It is intended that the scope of invention is defined by the appended claims and that modifications to the embodiments above may be made that do not depart from the scope of the claims.

There is some potential suggesting the use of recovered non-aqueous fluid in the same process. For example, siloxane used in the first wash can be sent through the reclamation process and then used later during the same load as a rinse option. This would suggest the importance of a reclamation system that does not necessarily need to remove all of the contaminants from a specific process but more importantly have contaminants that are stabilized so that they can not redeposit onto the fabric articles. Additionally, if some fluid is to be re-used in the same process, the cycle time for the reclamation system should be faster than that for the selected machine cycle. Another embodiment is that the fluid from the rinse portion of the system may not need go through all of the proposed reclamation operations, especially the temperature reduction step.

In an embodiment, the wash chamber oscillates for a plurality of periods of clockwise and counter-clockwise oscillations, wherein the time duration of the speed and time duration of the strokes are selected for each period. The strokes can be symmetrical or asymmetrical, and can have a speed or time duration that is selected randomly or from some predetermined varying pattern. Further, in another embodiment, the time duration of the oscillations vary for consecutive periods. The average or mean speed or time of the time-varying oscillations can be adjusted by the controller responsive to an amount of the items or to a size of the items.

The items in the wash chamber can move, for example, in a tumbling pattern.

In accordance with apparatuses consistent with the present invention, an automatic washer is provided. The automatic washer comprises a cabinet, a wash chamber with a central axis supported within the cabinet, a motor suspended outside the wash chamber and drivingly connected to the wash chamber, the wash chamber oscillating about the central axis by speed- and time-varying oscillations. The wash chamber may have a horizontal axis, a 45 degree tilted axis or a vertical axis.

Figure 15:
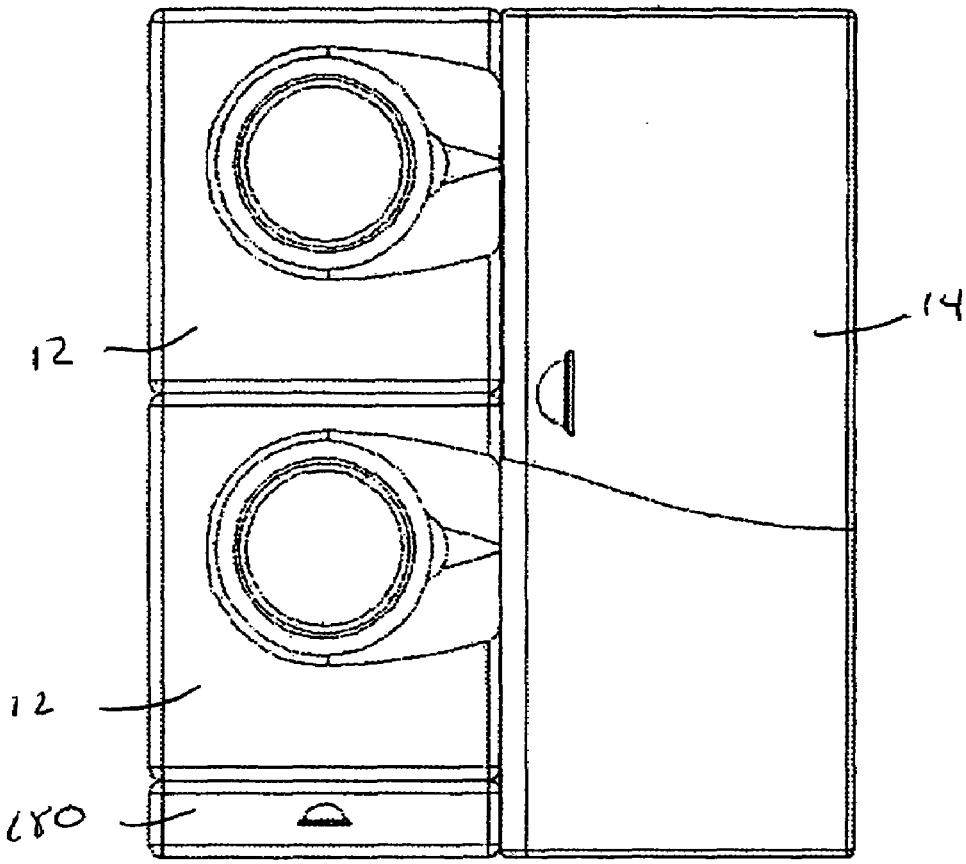
FIG. 15 demonstrates an embodiment of the invention.
Figure 16:
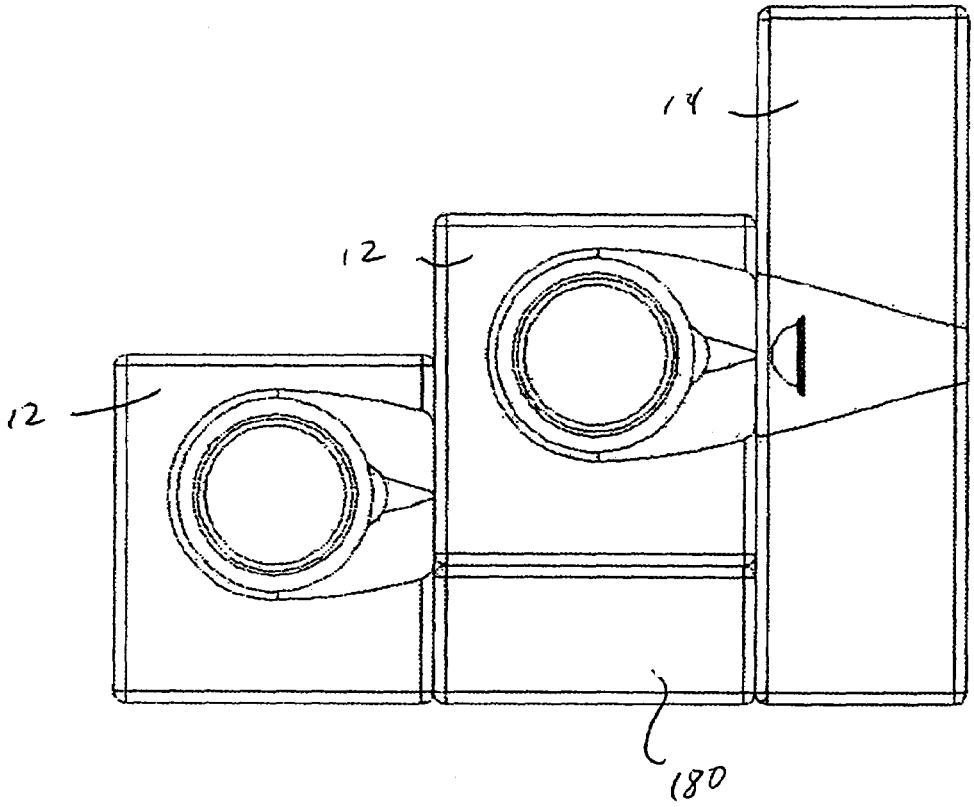
FIG. 16 demonstrates an embodiment of the invention.
Figure 17:
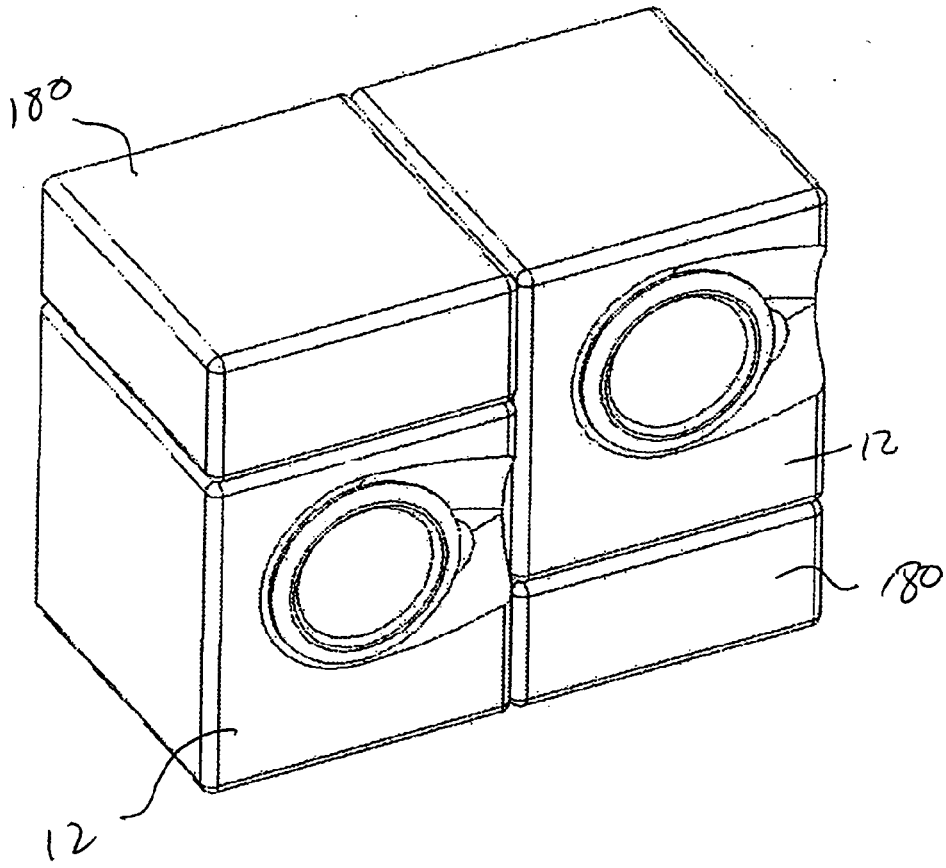
FIG. 17 demonstrates an embodiment of the invention.
Figure 18:
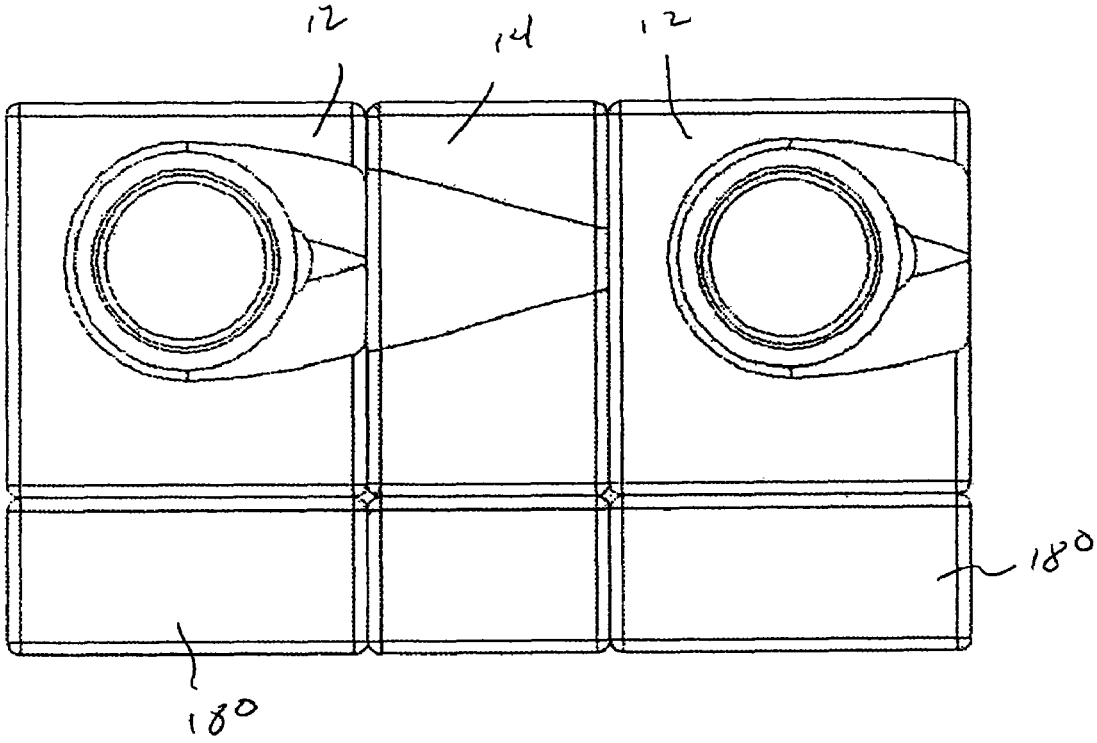
FIG. 18 demonstrates an embodiment of the invention.
Figure 19:
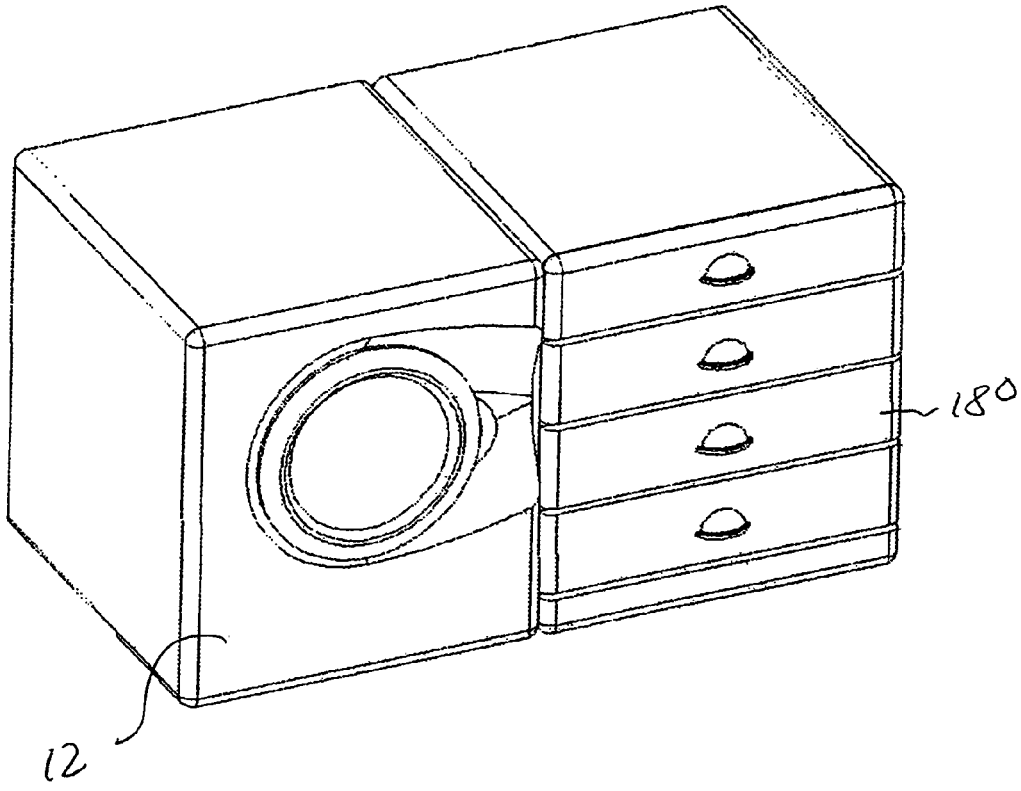
FIG. 19 demonstrates an embodiment of the invention.
Figure 20:
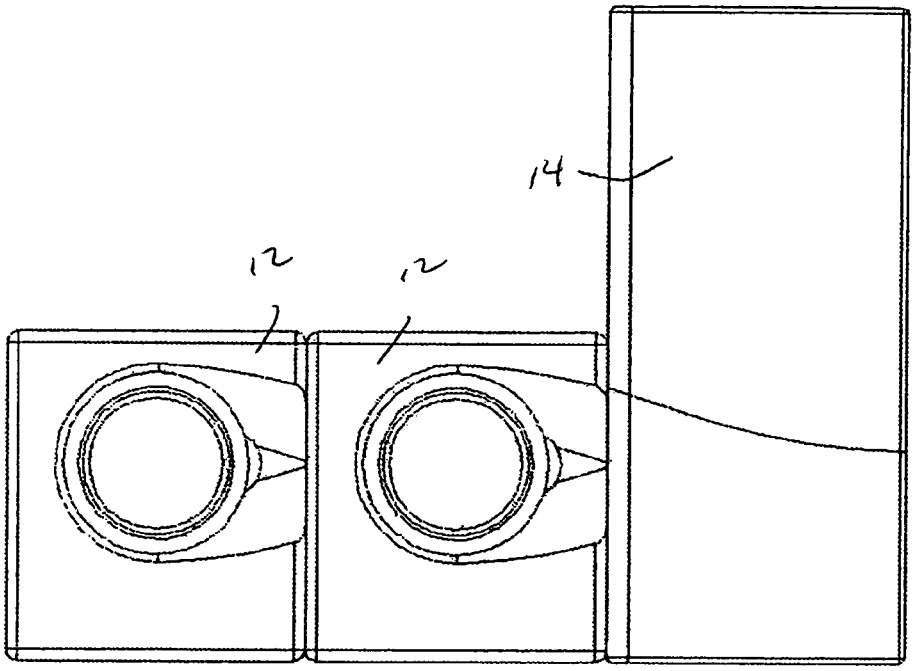
FIG. 20 demonstrates an embodiment of the invention.

As mentioned above, the arrangement of the wash unit 12 and the reclamation unit 14 may vary within the scope of the present invention. Multiple wash units may be used together such as shown in FIGS. 15-18, and 20. The wash units 12 may be stacked as shown in FIG. 15, may be arranged side by side as shown in FIGS. 16, 17, 20, or may be spaced apart, with other components arranged in between, such as shown in FIG. 18. Additional units 180 may be provided for storage, housing components, even such as the reclamation unit or other components or systems described above, or further drying units, as desired. Optionally, an additional unit 180 may be used as an enclosure for storing a spot stain station, a flat drying unit, a static drying unit, a storage unit, an ironing board storage unit, a sterilization chamber, a sanitation chamber, a perfume dispensing unit, an aroma refreshing unit, an insect repellant dispensing unit, and a fire retardant dispensing unit. These additional units 180 may be placed under (FIGS. 15-18), over (FIG. 17) or beside (FIG. 15, 16, 19) the wash unit 12.

Figure 21:
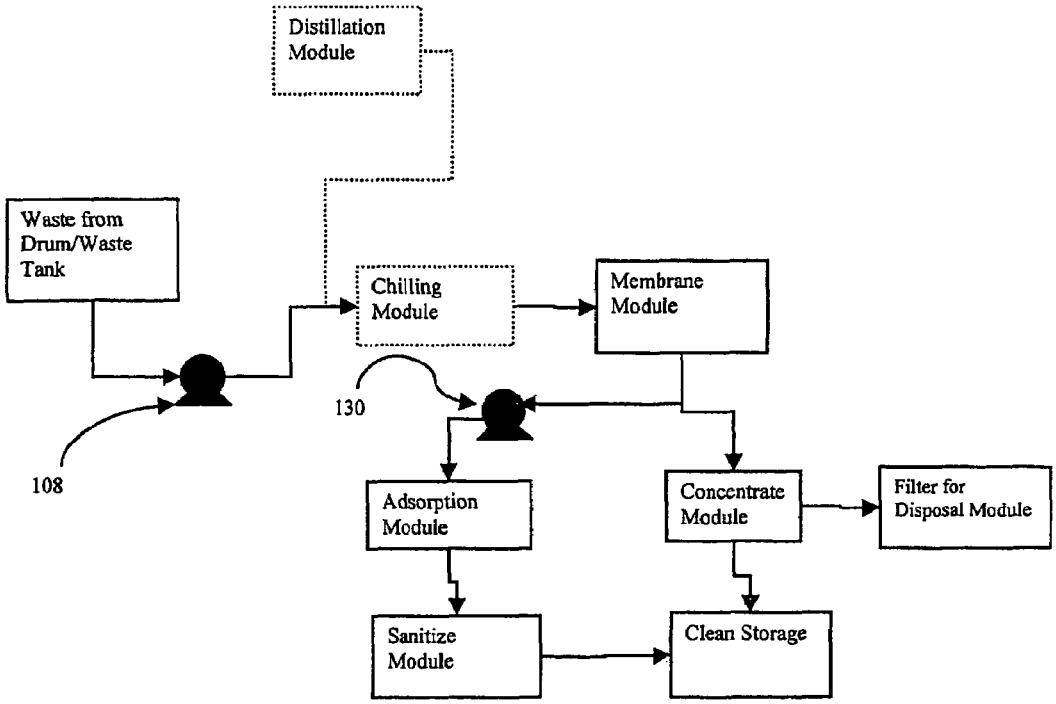
FIG. 21 demonstrates an embodiment of the invention.

Referring to FIG. 21, reclamation unit 14 may be adapted to accommodate different internal modules to permit reclamation of different working fluids, particularly those based upon a non-aqueous working fluid comprising a substantially non-reactive, non-oleophilic, apolar fluid, as compared to an aqueous working fluid comprising water. Working fluids collected in the waste tank 100 are pumped into other modules within the reclamation unit using high pressure pump 108. Optionally, the working fluid may be pumped into a distillation module to permit distillation of the working fluids into their respective constituent fractions for further reclamation of individual components of the working fluid. Optionally, the working fluid, either in crude form or distilled form, may be passed through a chilling module to permit cooling of the heated working fluid or distilled components thereof. Preferably, the working fluid or distilled components thereof may be purified further using membrane filtration located in a membrane module.

Optionally, the filtered working fluid or distilled components thereof may be concentrated using a concentrate module. Depending upon the attributes of the resultant concentrate, the concentrate may be stored in a clean storage module or filtered and stored in a disposal module.

Optionally, the filtered working fluid or distilled components thereof may be pumped across an adsorption module using permeate pump 130 to permit adsorption of particular types of subcomponents present in the working fluid solution. As described elsewhere in the specification, the adsorption module will typically contain at least one filter or a combination of filters to permit selective adsorption of different types of components from the working fluid. Thereafter, the filtrate may be pumped into a sanitization module to permit sanitization or sterilization of the remaining working fluid components for subsequent clean storage.

In one preferred embodiment, individual reclamation chemistry purification or treatment modules may be readily replaced with fresh modules once the useable lifespan of the reclamation unit has been realized. In another preferred embodiment, one set of modules that are designed to perform one type of reclamation chemistry may be exchanged for another set of modules that are designed to perform a different type of reclamation chemistry. In some preferred embodiments, some reclamation chemistry modules are intended to be replaceable or exchangeable by only qualified service personnel. Examples of such non-user replaceable or exchangeable reclamation chemistry modules may be those that present a particular safety concern or hazard to the consumer. In other preferred embodiments, the reclamation chemistry modules or subcomponents thereof may be readily replaced or exchanged by the consumer.

From the above description of the modular organization of the reclamation unit 14, it will be readily apparent to one of ordinary skill in the art that the composition of the housing for the individual modules, conduits, and connectors should be constructed of materials that can withstand the various pressures, temperatures, and compositional properties of the reclamation chemistries that may be employed during recovery of the spent working solutions and rinse solutions. Similarly, the wash unit 12, particularly the wash chamber 26, the sump 36, as well as other elements, such as conduits and connections that come into contact with the working solution should be constructed of materials that can withstand the temperature, pressure, and composition of the working solution.

Figure 22:
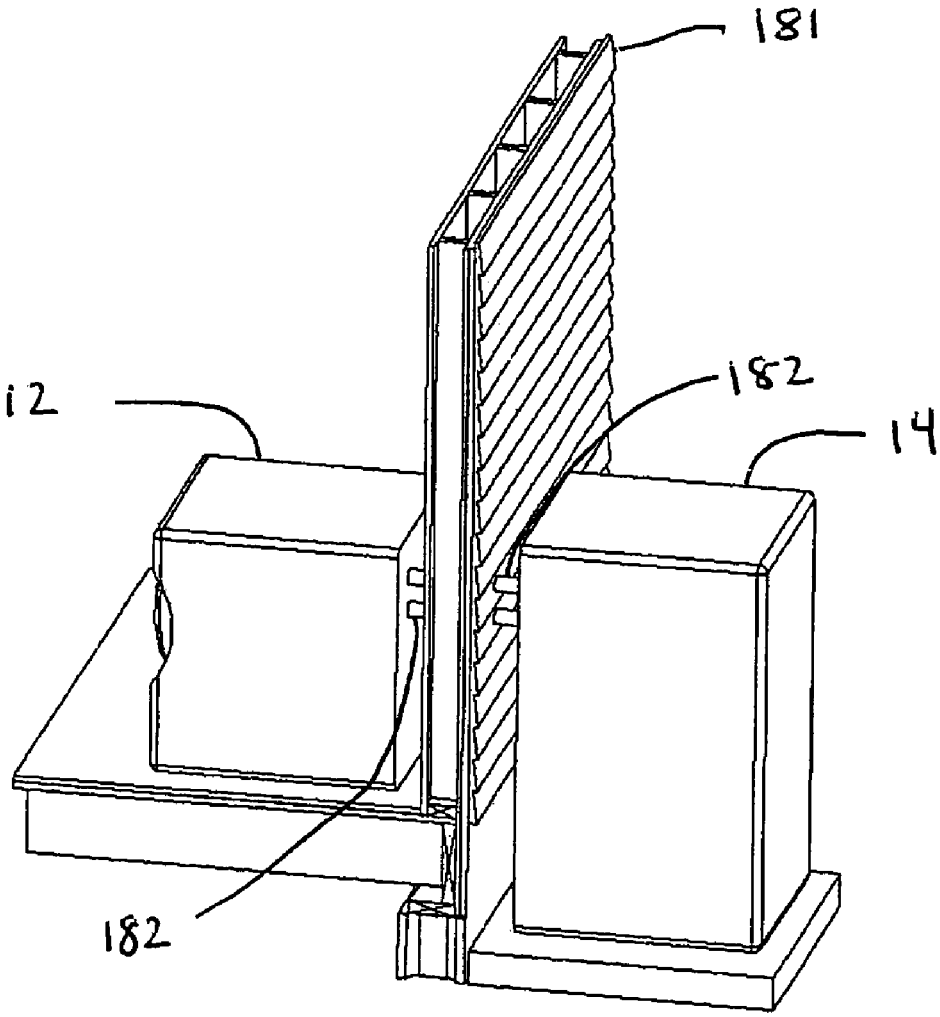
FIG. 22 demonstrates an embodiment of the invention.

Referring now to FIG. 22, the wash unit 12 and the reclamation unit 14 may be separated from one another by at least one intervening wall 181. Preferably, at least one passage in intervening wall 181 is provided for conduits 182 to enable for fluid, gas, data and/or power communication between the wash unit 12 and the reclamation unit 14. Two examples of such a split system configuration illustrate the advantages to locating the wash unit 12 and the reclamation unit 14 apart from one another. As already explained elsewhere in the specification, the wash unit 12 may be inside, such as in a laundry room, and the reclamation unit 14 may be outside the dwelling. In this regard, servicing of the reclamation unit 14 becomes easier as the consumer need not be home in order to allow access to the reclamation unit. Another advantage of having the reclamation unit 14 outside is that any leaks, in the unlikely event they occur, will not dissipate inside the dwelling. By way of another example, the wash unit 12 and the reclamation unit 14 may be positioned in different locations within the dwelling, such as placement of the wash unit 12 in a laundry room and placement of the reclamation unit 14 in a closet or a basement. One advantage to this arrangement is to acoustically isolate the noise of the reclamation unit 14 from the other locations in the dwelling.

It will be readily apparent to one of ordinary skill in the art that one reclamation unit 14 can service multiple wash units 12, regardless of whether the reclamation unit 14 is located inside the same room as the wash units 12, elsewhere in the dwelling, or outside the dwelling. Likewise, it will be readily apparent to one of ordinary skill that a single reclamation unit 14 can service multiple wash units 12, regardless of whether the multiple wash units 12 are located in the same room of the dwelling. For example, where the reclamation unit is positioned outside the dwelling and two reclamation units are located in different rooms inside the dwelling, at least two intervening walls 181 with appropriate conduits 182 will be required in order to connect the individual wash units 12 to the reclamation unit 14. All combinations and permutations of multiple wash units 12 with a reclamation unit 14, wherein at least the multiple wash units 12 are located inside the dwelling, are considered within the scope and spirit of the invention as disclosed herein. All that is required is appropriate fluid, gas, data, and/or power communication between the individual wash units 12 and the reclamation unit 14. Thus, the intervening wall 181 is understood to represent either an interior wall, an exterior wall of the dwelling, or a single or multiple combination of both types of walls.

Figure 23:
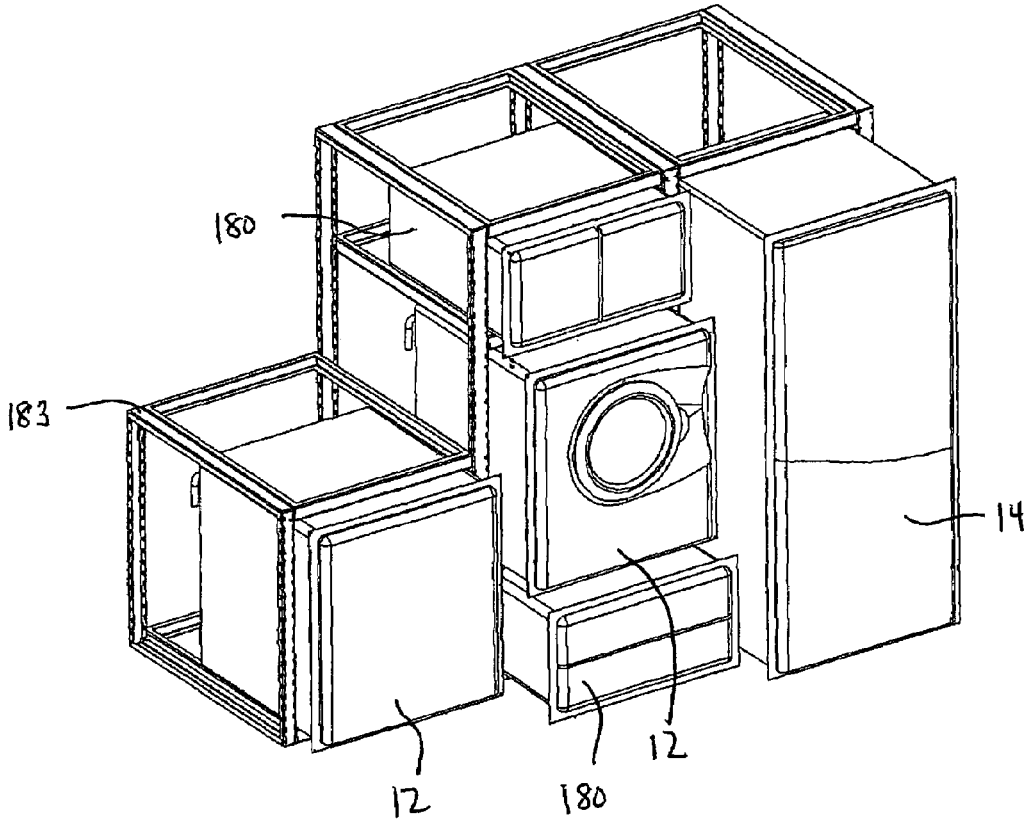
FIG. 23 demonstrates an embodiment of the invention.
Figure 24:
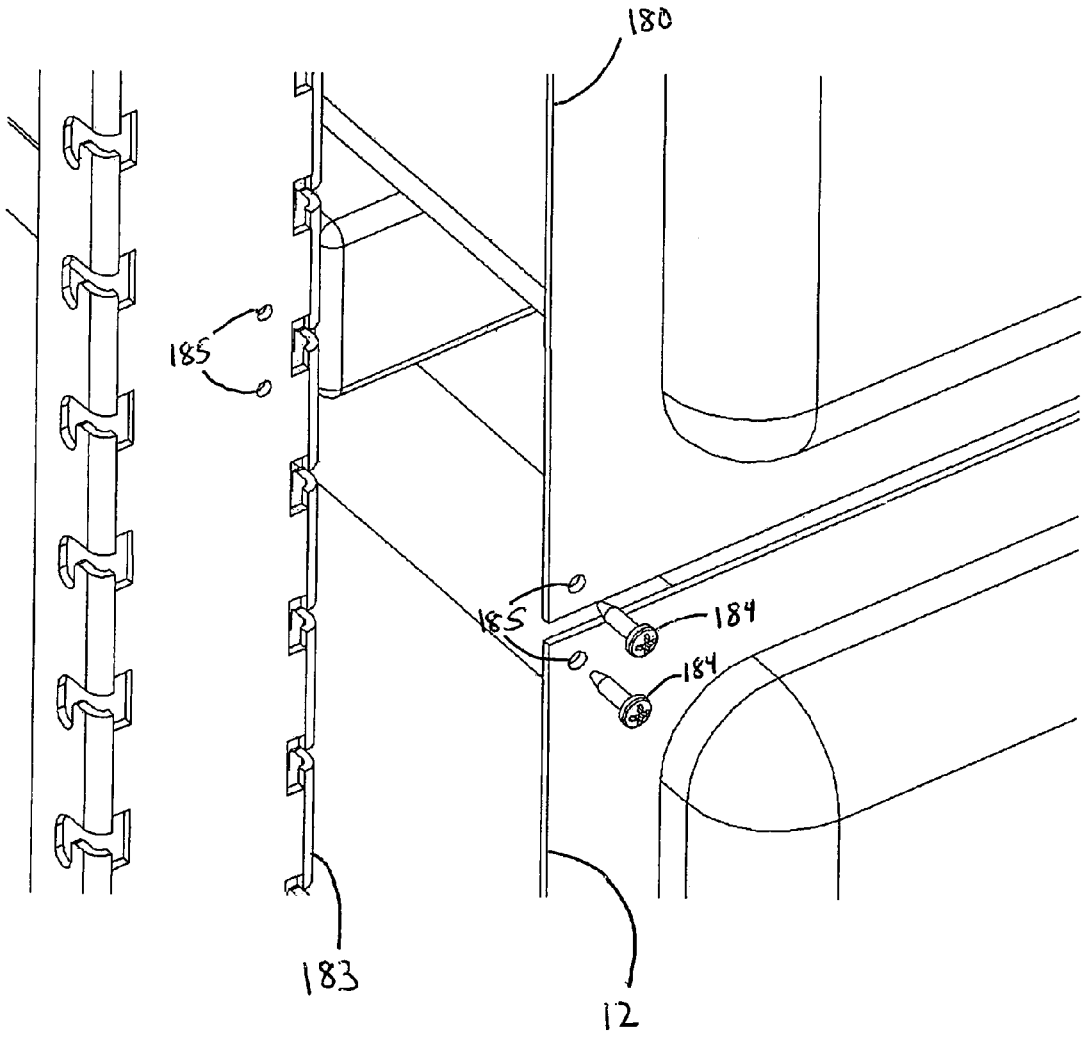
FIG. 24 demonstrates an embodiment of the invention.

Referring to FIGS. 23-24, the individual modules representing multiple wash units 12, reclamation unit 14, and multiple storage units 180 may be assembled into a modular frame 183 according to the configuration of modular frame 183. Preferably, modular frame 183 may be constructed to accommodate the functional and aesthetic design needs of the consumer. FIG. 23 illustrates that the individual modules are readily removable from their original locations within modular frame 183. The modular organization of the system permits the consumer to configure the system for a particular purpose. FIG. 24 illustrates a means for attaching the modules to modular frame 183. Preferred means for attaching include fasteners, such as nut and bolt combinations, screws 184 threaded through machined openings 185, and the like. Other preferred means for attaching include slide and lock mechanisms involving male and female compatible components built into the respective modules and module frame 183.

Figure 25:
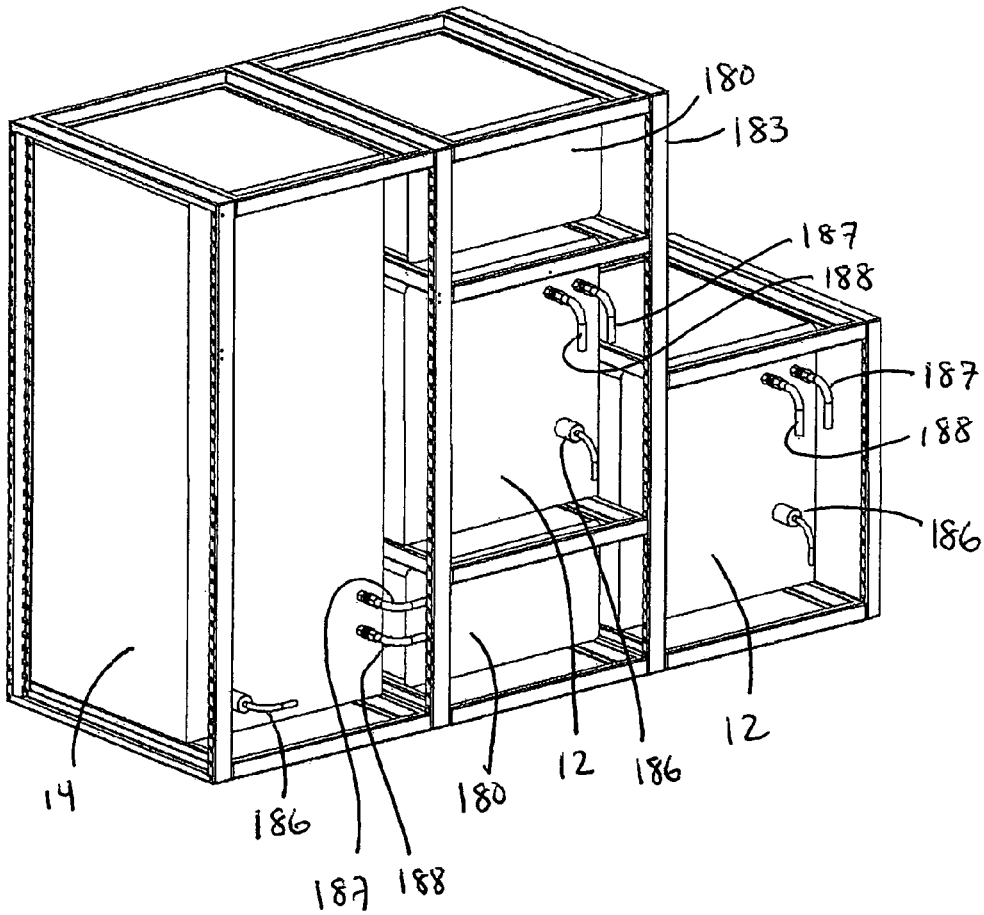
FIG. 25 demonstrates an embodiment of the invention.

FIG. 25 presents a rear view of one embodiment that illustrates the locations for connections 186, 187, and 188. Connections 186 provide for power service requirements through an appropriate conduit, which is not shown in this embodiment. Optionally, connections 186 may provide for communication between wash units 12 and reclamation unit 14 via a common communication control panel, which is not shown in this embodiment. Connections 187 and 188 provide connection to conduits for fluid or air communication between wash units 12 and reclamation unit 14, as would be necessary for providing working fluids during the wash cycle and for drying clothes following completion of the wash cycle.

Figure 26:
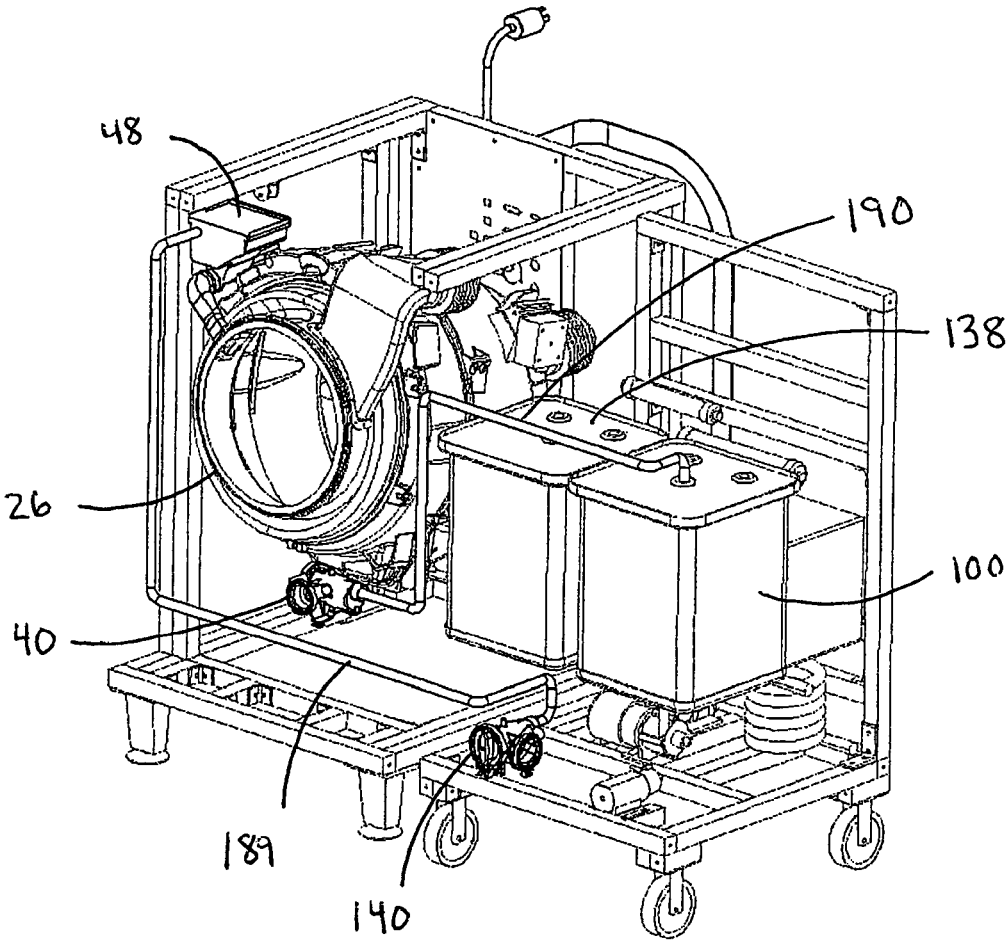
FIG. 26 demonstrates an embodiment of the invention.

Referring to FIG. 26, the working fluid is pumped from the clean tank 138 via a fill pump 140 to wash chamber 26 of wash unit 12 through conduit 189. In one preferred embodiment, the working fluid is pumped into dispenser 48 prior to entry into wash chamber 26. The fill pump 140 is in fluid communication with clean tank 138 near the base of clean tank 138 that is not shown in this representation. The wash chamber 26 includes a drain outlet (not shown) that is in fluid communication with a wash chamber sump 36. After completion of the stage that includes contacting the working fluid with th& fabric contents of the wash chamber, the working fluid is pumped from wash chamber sump 36 to waste tank 100 through conduit 190 using recirculation pump 40.

One of the safety concerns of using non-aqueous working solutions composed of silicone-based solvents is that such solvents possess flash points as well as low vapor pressures. For example, industry accepted policies and federal regulations currently state that the drying temperature can not exceed a temperature maximum of within 30° F. below the flash point of the non-aqueous solvent unless certain conditions are met: (a) the oxygen concentration does not exceed 8% (vouvol) of the non-aqueous solution or (b) the concentration of the vapor does not exceed 25% (vol/vol) of its lower flammability limit.

Figure 27:
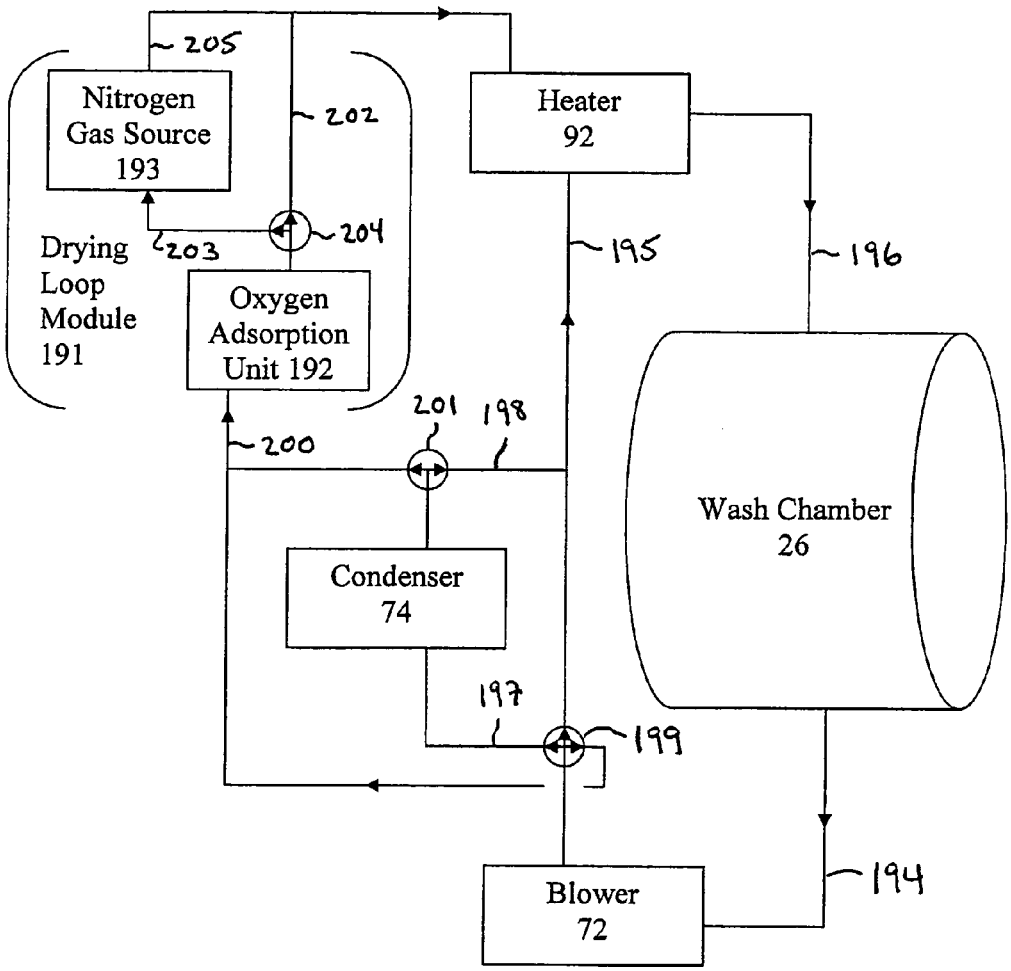
FIG. 27 demonstrates an embodiment of the invention.

Referring generally to FIG. 27, drying loop module 191 may be used in conjunction with cleaning machines adapted for cleaning clothes with non-aqueous working solutions. In particular, the drying loop module 191 and method of use will enable the oxygen concentration of the working solution to be maintained below 8% (vol/vol) threshold, thereby allowing for the drying temperature to exceed a maximum temperature to within 30° F. below the flash point of any residual working solution that remain in the wash chamber. When the user selects a more rapid drying procedure following a cleaning cycle using non-aqueous working solutions, drying loop module 191 is selectively activated to permit use of an elevated drying temperature than otherwise would be possible without drying loop module 191. The control features of the cleaning machine, typically via communication with at least two type of sensors in wash unit 12, determines the type of working solution selected during the wash cycle (working solution composition sensor) as well as the oxygen concentration present (oxygen sensor) In those instances where drying loop module 191 permits maintenance of the oxygen concentration at levels below 8% (vol/vol), the temperature of drying loop module 191 will be increased accordingly to permit more facile drying of fabrics. For example, when the oxygen concentration safely falls below 8%, then the maximum temperature for drying fabrics cleaned with working solutions comprising a decamethylcyclopentasiloxane solution can exceed 140° F.

Referring more particularly to FIG. 27, drying loop module 191 includes at least an oxygen adsorption unit 192, optionally nitrogen gas source 193, and appropriate conduits and valving. In a preferred embodiment, wash unit 12 is fitted with a drying loop comprising blower 72, heater 92, and appropriate conduits that establish communication between wash chamber 26 and blower 72 (conduit 194), between blower 72 and heater 92 (conduit 195) and between heater 92 and wash chamber 26 (conduit 196). Optionally, the preferred embodiment includes condenser 74 and appropriate conduits permitting communication between blower 72 and condenser 74 (conduit 197) and between condenser 74 and heater 92 (conduit 198), wherein inclusion of the condenser option into the air stream flow path is achieved by selective activation of valve 199. Drying loop module 191 is incorporated in the preferred embodiment through appropriate connections between blower 72 and heater 92, or optionally between condenser 74 and heater 92, in the following preferred manner: (a) the inlet of oxygen adsorption unit 192 is in communication with the outlet of either blower 72 or condenser unit 74 using conduit 200 via valves 199 and 201, respectively; (b) the outlet of oxygen adsorption unit 192 is in communication with the inlet of heater 92 using conduit 202, or optionally in communication with the inlet of nitrogen gas source 193 using conduits 203 via valve 204; and (c) the outlet of nitrogen source 193 is in communication with inlet of heater 92 using conduit 205.

Referring to FIG. 27, the valves incorporated into the drying loop have the following attributes. Valve 199, if present, operates as a three-way valve to permit the user to select one of three paths of air stream flow through the drying loop: (a) air stream flow from blower 72 directly to heater 92; (b) air stream flow from blower 72 to condenser 74; or (c) air stream flow from blower 72 to oxygen adsorption unit 192 of drying loop module 191. Valve 201, if present, operates as a two-way valve to permit the user to select one of two paths of air stream flow through the drying loop: (a) air stream flow from condenser 74 to heater 92 or (b) air stream flow from condenser 74 to oxygen adsorption unit 192 of drying loop module 191. Valve 204 of drying loop module 191, if present, operates as a two-way valve to permit the user to select one of two paths of air stream flow through the drying loop: (a) air stream flow from oxygen adsorption unit 192 to heater 92 or (b) air stream flow from oxygen adsorption unit 192 to nitrogen gas source 193. Preferably, valves 199, 201, and 204 are electronically switchable, the control of which is specified by the user when selecting the type of drying cycle during operation of the cleaning machine.

Referring to FIG. 27, the preferred operation of drying loop module 191 is as follows. The direction of air stream flow for alternate air stream flow paths is indicated by the arrows on the conduits for preferred drying loop. The air from removed from wash chamber 26 during drying operations via blower 72. The blower 72 optionally passes over a condenser bed in condenser 74 to remove some of the non-aqueous vapor that has been collected in the vapor stream. Selective activation of valve 199 permits the air stream to flow from blower unit 72 directly to oxygen adsorption unit 192 of drying loop module 191. Optionally, selective activation of valves 199 and 201 permit inclusion of condenser unit 74 into the drying loop flow module 191 flow path. The stream then passes over an adsorbent bed contained in oxygen adsorption unit 192 that permits removal of oxygen from the air stream. Optionally, the air stream passes through nitrogen gas source 193 to provide an nitrogen-enriched air stream. Selective activation of valve 204 permit inclusion of nitrogen gas source 193 into the drying loop flow module 191 flow path. Finally, the stream passes over heater 92 to permit heating of the air stream before return to the wash chamber 26.

The oxygen adsorbent of oxygen adsorption unit 192 is chosen to permit removal 3.6-angstrom molecules. One potential oxygen adsorbent material includes but is not limited to Klein Optical Light. The oxygen bed is capable of being regenerated by heat treatment. Nitrogen gas source may contain an optional nitrogen adsorbent bed, wherein if included, is preferably a zeolite 5A, calcium exchange resin. Preferably, operation of drying loop module 191 at elevated pressures (e.g., greater than 1 bar) would ensure that the air stream would not enter into the system should a breach occur the communication path of the drying loop.

It is envisaged that the drying loop module 191 would be incorporated into wash unit 12 in the usual manner as disclosed elsewhere in the specification. Such a module may be readily incorporated into wash unit 12 at the time of manufacture or added as an after sale modification to wash unit 12 by either a qualified service technician or the end user. Similarly, components with an exhaustible lifespan, (e.g., the nitrogen charge cartridge, the oxygen adsorption composite filter, and the like) the may be readily replaced with fresh components. A qualified service personnel or the end user may exchange these components, depending upon their ease and hazard of replacement.

The above-mentioned and other features, utilities, and advantages of the invention will become apparent from the following detailed description of the preferred embodiments of the invention together with the accompanying drawings.

The invention claimed is:

1. A cleaning machine adapted for the utilization of a working fluid to clean a wash load comprising:

a first enclosure comprising a wash unit, said wash unit comprising a wash chamber for containing the wash load located within said wash unit;

a second enclosure comprising a reclamation unit, said reclamation unit comprising a cross flow membrane filter;

conduits extending between the wash unit and said reclamation unit;

a control for operating said cleaning machine through a series of washing steps;

a clean tank; and a permeate filter, wherein the permeate filter is disposed between the cross flow membrane filter and the clean tank.

2. A cleaning machine adapted for the utilization of a working fluid to clean a wash load comprising;

a first enclosure comprising a wash unit, said wash unit comprising a wash chamber for containing the wash load located within said wash unit;

a second enclosure comprising a reclamation unit, said reclamation unit comprising a cross flow membrane filter;

conduits extending between the wash unit and said reclamation unit;

a control for operating said cleaning machine through a series of washing steps;

a waste tank;

a clean tank; and a dead end filter, wherein the dead end filter is disposed between the cross flow membrane filter and at least one of the following: the waste tank and the clean tank.

3. A fabric cleaning machine adapted for the utilization of a working fluid to clean a wash load, comprising:

a first enclosure having a plurality of walls;

a wash unit in said first enclosure, wherein said wash unit comprises:

a wash chamber for containing the wash load of fabric located within said wash unit;

an access door in at least one wall of said first enclosure adapted to permit selective access to said wash chamber for loading and removing the wash load; and a dispenser for directing wash liquor into said wash chamber;

a second enclosure having a plurality of walls;

a reclamation unit in a second enclosure, wherein said reclamation unit comprises:

a working fluid storage system;

a working fluid supply system for supplying working fluid to wash chamber;

a working fluid retrieval system for recovering working fluid from said wash chamber and returning said working fluid to said working fluid storage tank; and a working fluid processing system for removing contaminants from said working fluid recovered from said wash chamber; wherein the working fluid processing system further comprises a chiller disposed between the wash chamber and a cross flow membrane filter;

conduits extending between said wash unit and said reclamation unit;

a pump connected to at least one of said conduits for moving fluid through said conduit;

a control for operating said cleaning machine through a series of washing steps wherein said first and second enclosures make up a modular system arrangeable and interconnectable in a plurality of functional orientations;

a clean tank; and a permeate filter, wherein the permeate filter is disposed between the cross flow membrane filter and the clean tank.

* * * * *